US006029641A

United States Patent [19]

Suzuki et al.

[11] Patent Number: 6,029,641

[45] Date of Patent: Feb. 29, 2000

[54] AIR-FUEL RATIO CONTROL SYSTEM FOR INTERNAL COMBUSTION ENGINES

[75] Inventors: Norio Suzuki; Koichi Saiki, both of Wako, Japan

[73] Assignee: Honda Giken Kogyo Kabushiki Kaisha, Tokyo, Japan

[21] Appl. No.: 08/919,336

[22] Filed: Aug. 28, 1997

[30] Foreign Application Priority Data

Aug. 29, 1996 [JP] Japan ..... 8-245465

[51] Int. Cl.[7] ..... F02D 41/14

[52] U.S. Cl. ..... 123/673; 123/685; 123/696

[58] Field of Search ..... 123/688, 696, 123/673, 685; 60/276

[56] References Cited

U.S. PATENT DOCUMENTS

| | | | |
|---|---|---|---|
| 5,445,136 | 8/1995 | Yamashita et al. | 123/696 |
| 5,483,946 | 1/1996 | Hamburg et al. | 123/688 |
| 5,566,662 | 10/1996 | Messih | 123/696 |
| 5,596,975 | 1/1997 | Thomas et al. | 123/697 |
| 5,671,721 | 9/1997 | Aoki | 123/688 |
| 5,692,486 | 12/1997 | Tsutsumi et al. | 123/688 |
| 5,697,214 | 12/1997 | Carnevale et al. | 123/688 |
| 5,724,953 | 3/1998 | Jung | 123/688 |
| 5,758,310 | 5/1998 | Kato | 123/688 |
| 5,778,866 | 7/1998 | Uchikawa | 123/696 |

FOREIGN PATENT DOCUMENTS 6-146998 5/1994 Japan .

7-78484 8/1995 Japan .

OTHER PUBLICATIONS

"Combining Model Reference Adaptive Controllers and Stochastic Self–tuning Regulators", Landau, *Automatica*, vol. 18, No. 1, 1982, pp. 77–84.

"Computrol", *Computer and Application's Book*, No. 27, Jul. 10, 1989, pp. 28–41.

"Unification of Discrete Time Explicit Model Reference Adaptive Control Designs", Landau et al, *Automatica*, vol. 17, No. 4, 1981, pp. 593–611.

"A Survey of Model Reference Adaptive Techniques—Theory and Applications", Landau, *Automatica*, vol. 10, 1974, pp. 353–379.

*Automatica Control Handbook*, pp. 701–707.

*Primary Examiner*—Erick R. Solis

*Attorney, Agent, or Firm*—Nikaido Marmelstein Murray & Oram LLP

[57] ABSTRACT

An air-fuel ratio control system for an internal combustion engine includes an air-fuel ratio sensor arranged in the exhaust system of the engine. An ECU determines activation of the air-fuel ratio sensor and carries out feedback control of the air-fuel ratio of a mixture supplied to the engine in response to the output from the air-fuel ratio sensor. An intermediate state of the air-fuel ratio sensor corresponding to a transient state of the air-fuel ratio sensor from an inactive state thereof to an active state thereof is determined. The output from the air-fuel ratio sensor for use in execution of the feedback control is corrected when the air-fuel ratio sensor is in the intermediate state.

18 Claims, 31 Drawing Sheets

ECU
IG
TW
LAF
O2
PBA
θTH
TA
PA
SPN
ECU5
1
2
3
4
5
6
7
8
9
10
11
12
13
14
15
16
17
18
19
20
21
22
23
60
70

NE
PBA
θTH
PA
B1
TIMF
B2
B3
B4
B5
B6
B7
B8
B9
KTOTAL
KCMDM
1
ENG
TOUT
TOUT
TOUT
TOUT
KOBSV#1
PID
PID
PID
PID
KCMD
B12
B14
KOBSV#3
B15
KOBSV#4
B13
KOBSV#2
B11
OBSV
B10
SELV
LPF
22
17
LAF
CAT
19
CAT
20
O2
18
B17
LPF
B16
LPF
B19
STR
B18
PID
KSTR
KLAF
KCMD
B20
SW
KFB
23
LPF
B21
KCMD
B22
MIDO2
FB
KCMD
B23
KCMDM

FIG.6A
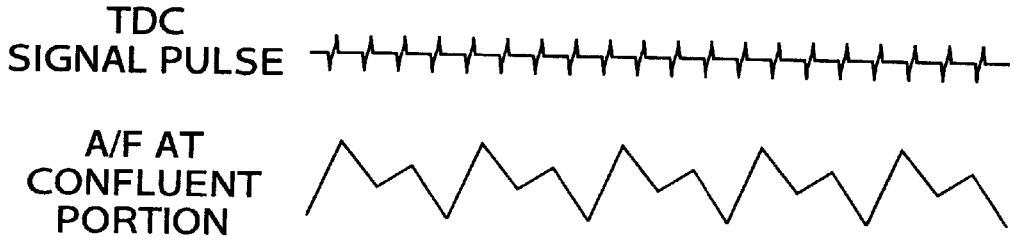
FIG.6B
FIG.12
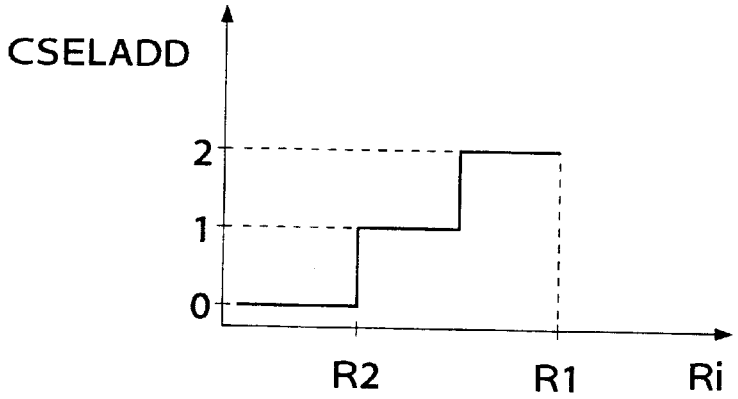

AIR-FUEL RATIO CONTROL SYSTEM FOR INTERNAL COMBUSTION ENGINES

BACKGROUND OF THE INVENTION

1. Field of the Invention

This invention relates to an air-fuel ratio-control system for internal combustion engines, which controls the air-fuel ratio of a mixture supplied to the engine in a feedback manner responsive to an output from an air-fuel ratio sensor arranged in the exhaust system of the engine.

2. Prior Art

There is conventionally known a method of controlling the temperature of an air-fuel ratio sensor used in the air-fuel ratio feedback control of an internal combustion engine, for example, from Japanese Patent Publication (Kokoku) No. 7-78484, in which the air-fuel ratio sensor is provided with an electric heater for controlling the temperature thereof, and the sensor temperature is detected based on the internal resistance of the sensor, to thereby control an amount of electric current flowing in the heater according to the detected sensor temperature. Further, there is also known a method of determining activation of the air-fuel ratio sensor by measuring the internal resistance of the sensor as a parameter representative of the sensor temperature, and determining whether or not the sensor temperature has reached a predetermined value, i.e. whether or not the air-fuel ratio sensor has been activated, based on the measured resistance value.

To satisfy stricter regulations of exhaust gas in recent days, there is an increasing necessity to start the air-fuel ratio feedback control as soon as possible after the start of the engine. Therefore, prompter activation of the air-fuel ratio sensor is desired.

One way to more promptly activate the air-fuel ratio sensor is to heat the air-fuel ratio sensor by a heater as employed by the above known method and further improve the performance of the heater. This method, however, can not only incur increased power consumption and increased costs, but also provide a higher possibility of overshooting of the temperature (overheating) of the sensor during heating by the heater.

On the other hand, if the predetermined value for determining whether or not the air-fuel ratio sensor has been activated is set to a lower value to start the air-fuel ratio feedback control earlier after the start of the engine, there arise inconveniences that immediately after the sensor is determined to be activated, the sensor output characteristic can vary so that the sensor output deviates from the actual air-fuel ratio, and the sensor can show a poor output response to a change in the air-fuel ratio. As a result, desired air-fuel ratio feedback control performance cannot be achieved.

SUMMARY OF THE INVENTION

It is the object of the invention to provide an air-fuel ratio control system for internal combustion engines, which is capable of carrying out air-fuel ratio feedback control even before the output from the air-fuel sensor becomes stable, to thereby achieve good air-fuel ratio feedback control performance.

To attain the above object, according to a first aspect of the invention, there is provided an air-fuel ratio control system for an internal combustion engine having an exhaust system, including air-fuel ratio-detecting means arranged in the exhaust system, activation-determining means for determining activation of the air-fuel ratio-detecting means, and feedback control means for carrying out feedback control of an air-fuel ratio of a mixture supplied to the engine in response to an output from the air-fuel ratio-detecting means, said air-fuel ratio control system being characterized by an improvement wherein:

the activation-determining means determines an intermediate state of the air-fuel ratio-detecting means corresponding to a transient state of the air-fuel ratio-detecting means from an inactive state thereof to an active state thereof; and the feedback control means corrects the output from the air-fuel ratio-detecting means for use in execution of the feedback control when the air-fuel ratio-detecting means is in the intermediate state.

In the present specification, the term "active state" of the air-fuel ratio-detecting means means a state where the air-fuel ratio-detecting means has been or is activated such that it generates a stable output, and the term "intermediate state" of the same means a state where the air-fuel ratio-detecting means is not inactive but in a transient state before its output becomes stabilized.

Preferably, the activation-determining means determines activation of the air-fuel ratio-detecting means by measuring internal resistance of the air-fuel ratio-detecting means.

More preferably, the activation-determining means determines that the air-fuel ratio-detecting means is activated to a larger degree as the internal resistance of the air-fuel ratio-detecting means is smaller.

Preferably, the feedback control means includes sampling means for sampling the output from the air-fuel ratio-detecting means whenever the crankshaft of the engine rotates through a predetermined rotational angle and sequentially storing sampled values of the output, selecting means for determining timing of sampling the output according to operating conditions of the engine and selecting one of the stored sampled values of the output corresponding to the determined sampling timing, and sampling timing-correcting means for correcting the determined sampling timing according to the measured internal resistance of the air-fuel ratio-detecting means.

More preferably, the sampling timing-correcting means sets the sampling timing to a more retarded value as the measured internal resistance of the air-fuel ratio-detecting means is larger.

Also preferably, the feedback control means includes converting means for converting the output from the air-fuel ratio-detecting means to an equivalent ratio, the converting means changing a conversion characteristic used to convert the output to the equivalent ratio according to the measured internal resistance of the air-fuel ratio-detecting means when the air-fuel ratio-detecting means is in the intermediate state.

Advantageously, the engine has catalyst means arranged in the exhaust system, the air-fuel ratio-detecting means being arranged in the exhaust system at a location upstream of the catalyst means, the air-fuel ratio-detecting means being a linear output oxygen concentration sensor which generates an output almost proportional to concentration of oxygen present in exhaust gases emitted from the engine.

To attain the above object, according to a second aspect of the invention, there is provided an air-fuel ratio control system for an internal combustion engine having an exhaust system, including air-fuel ratio-detecting means arranged in the exhaust system, activation-determining means for determining activation of the air-fuel ratio-detecting means, and feedback control means for carrying out feedback control having a predetermined control gain for controlling an air-fuel ratio of a mixture supplied to the engine to a desired value set based on a desired air-fuel ratio coefficient, in response to an output from the air-fuel ratio-detecting means, the air-fuel ratio control system being characterized by an improvement wherein:

the activation-determining means determines an intermediate state of the air-fuel ratio-detecting means corresponding to a transient state of the air-fuel ratio-detecting means from an inactive state thereof to an active state thereof; and the feedback control means corrects at least one of an output characteristic of the air-fuel ratio-detecting means, the desired air-fuel ratio coefficient, and the control gain, for use in execution of the feedback control when the air-fuel ratio-detecting means is in the intermediate state.

Preferably, the activation-determining means determines activation of the air-fuel ratio-detecting means by measuring internal resistance of the air-fuel ratio-detecting means.

More preferably, the activation-determining means determines that the air-fuel ratio-detecting means is activated to a larger degree as the internal resistance of the air-fuel ratio-detecting means is smaller.

Preferably, the feedback control means includes desired air-fuel ratio-correcting means for correcting the desired air-fuel ratio coefficient according to the measured internal resistance of the air-fuel ratio-detecting means when the air-fuel ratio-detecting means is in the intermediate state, the feedback control means carrying out the feedback control, by using the corrected desired air-fuel ratio coefficient when the air-fuel ratio-detecting means is in the intermediate state.

More preferably, the desired air-fuel ratio-correcting means corrects the desired air-fuel ratio coefficient to a richer value when the desired air-fuel ratio coefficient is richer than a stoichiometric air-fuel ratio and corrects the desired air-fuel ratio coefficient to a leaner value when the desired air-fuel ratio coefficient is leaner than the stoichiometric air-fuel ratio.

Further preferably, the engine has a plurality of cylinders, the air-fuel ratio control system including second feedback control means for carrying out feedback control of an air-fuel ratio of a mixture supplied to each of the cylinders in response to the output from the air-fuel ratio-detecting means by using a controller of a recurrence formula type, such that the air-fuel ratio of the mixture supplied to the each of the cylinders is converged to the desired value, and selecting means for selecting one of the feedback control means for carrying out the feedback control having the predetermined feedback gain and the second feedback control means and operating the selected feedback control means, the desired air-fuel ratio coefficient being used in the feedback control executed by the selected feedback control means.

Alternatively, the air-fuel ratio-detecting means is arranged in the exhaust system at a confluent portion thereof, the air-fuel ratio control system including cylinder-by-cylinder air-fuel ratio-estimating means for estimating an air-fuel ratio of a mixture supplied to each of the cylinders in response to the output from the air-fuel ratio-detecting means, by using an observer for observing an internal operative state of the exhaust system based on a model representative of a behavior of the exhaust system, the cylinder-by-cylinder air-fuel ratio-estimating means including confluent portion air-fuel ratio-estimating means for estimating an air-fuel ratio at the confluent portion of the exhaust system by using a time constant of response delay of the air-fuel ratio-detecting means, the cylinder-by-cylinder air-fuel ratio-estimating means estimating the air-fuel ratio of the mixture supplied to the each of the cylinders by using an output from the confluent portion air-fuel ratio-estimating means, the cylinder-by-cylinder air-fuel ratio-estimating means correcting the time constant of response delay of the air-fuel ratio-detecting means when the air-fuel ratio-detecting means is in the intermediate state.

Also alternatively, the air-fuel ratio-detecting means is arranged in the exhaust system at a confluent portion thereof, the air-fuel ratio control system including cylinder-by-cylinder air-fuel ratio-estimating means for estimating an air-fuel ratio of a mixture supplied to each of the cylinders in response to the output from the air-fuel ratio-detecting means, by using an observer for observing an internal operative state of the exhaust system based on a model representative of a behavior of the exhaust system, the cylinder-by-cylinder air-fuel ratio-estimating means including confluent portion air-fuel ratio-estimating means for estimating an air-fuel ratio at the confluent portion by using a time constant of response delay of the air-fuel ratio-detecting means, and inhibiting means for inhibiting operation of the cylinder-by-cylinder air-fuel ratio-estimating means when the air-fuel ratio-detecting means is in the intermediate state.

Alternatively, the feedback control means includes control gain-setting means for setting the control gain according to the measured internal resistance of the air-fuel ratio-detecting means when the air-fuel ratio-detecting means is in the intermediate state.

Preferably, the feedback gain-setting means sets the control gain to a larger value as the internal resistance of the air-fuel ratio-detecting means is smaller.

Advantageously, the engine has catalyst means arranged in the exhaust system, the air-fuel ratio-detecting means being arranged in the exhaust system at a location upstream of the catalyst means, the air-fuel ratio-detecting means being a linear output oxygen concentration sensor which generates an output almost proportional to concentration of oxygen present in exhaust gases emitted from the engine.

To attain the above object, according to a third aspect of the invention, there is provided an air-fuel ratio control system for an internal combustion engine having an exhaust system, and catalyst means arranged in the exhaust system, including air-fuel ratio-detecting means arranged in the exhaust system at a location upstream of the catalyst means and having an output characteristic such that an output thereof drastically changes when an air-fuel ratio of exhaust gases from the engine changes across a stoichiometric air-fuel ratio, activation-determining means for determining activation of the air-fuel ratio-detecting means, and feedback control means for carrying out feedback control of the air-fuel ratio of a mixture supplied to the engine in response to the output from the air-fuel ratio-detecting means, the air-fuel ratio control system being characterized by an improvement, wherein the activation-determining means determines an intermediate state of the air-fuel ratio-detecting means corresponding to a transient state of the air-fuel ratio-detecting means from an inactive state thereof to an active state thereof; and the feedback control means corrects a reference value which is compared with the output from the air-fuel ratio-detecting means when the air-fuel ratio-detecting means is in the intermediate state.

Preferably, the activation-determining means determines activation of the air-fuel ratio-detecting means by measuring internal resistance of the air-fuel ratio-detecting means.

The above and other objects, features, and advantages of the invention will become more apparent from the following detailed description taken in conjunction with the accompanying drawings.

BRIEF DESCRIPTION OF THE DRAWINGS

FIGS. 6A and 6B collectively form a timing chart showing the relationship between TDC signal pulses obtained from a multi-cylinder internal combustion engine and the air-fuel ratio detected at a confluent portion of the exhaust system of the engine, in which:

FIG. 6A shows TDC signal pulses obtained from the engine; and

FIG. 6B shows the air-fuel ratio detected at the confluent portion of the exhaust system;

FIGS. 7A and 7B show good and bad examples of timing of sampling an output from the LAF sensor, in which;

FIG. 7A shows examples of the sampling timing in relation to the actual air-fuel ratio; and FIG. 7B shows examples of the air-fuel ratio recognized by an ECU through sampling of the output from the LAF sensor;

FIG. 12 shows a table for determining a correction term CSELADD which is used in the FIG. 9 subroutine;

DETAILED DESCRIPTION

The invention will now be described in detail with reference to the drawings showing embodiments thereof.

Figure 1:
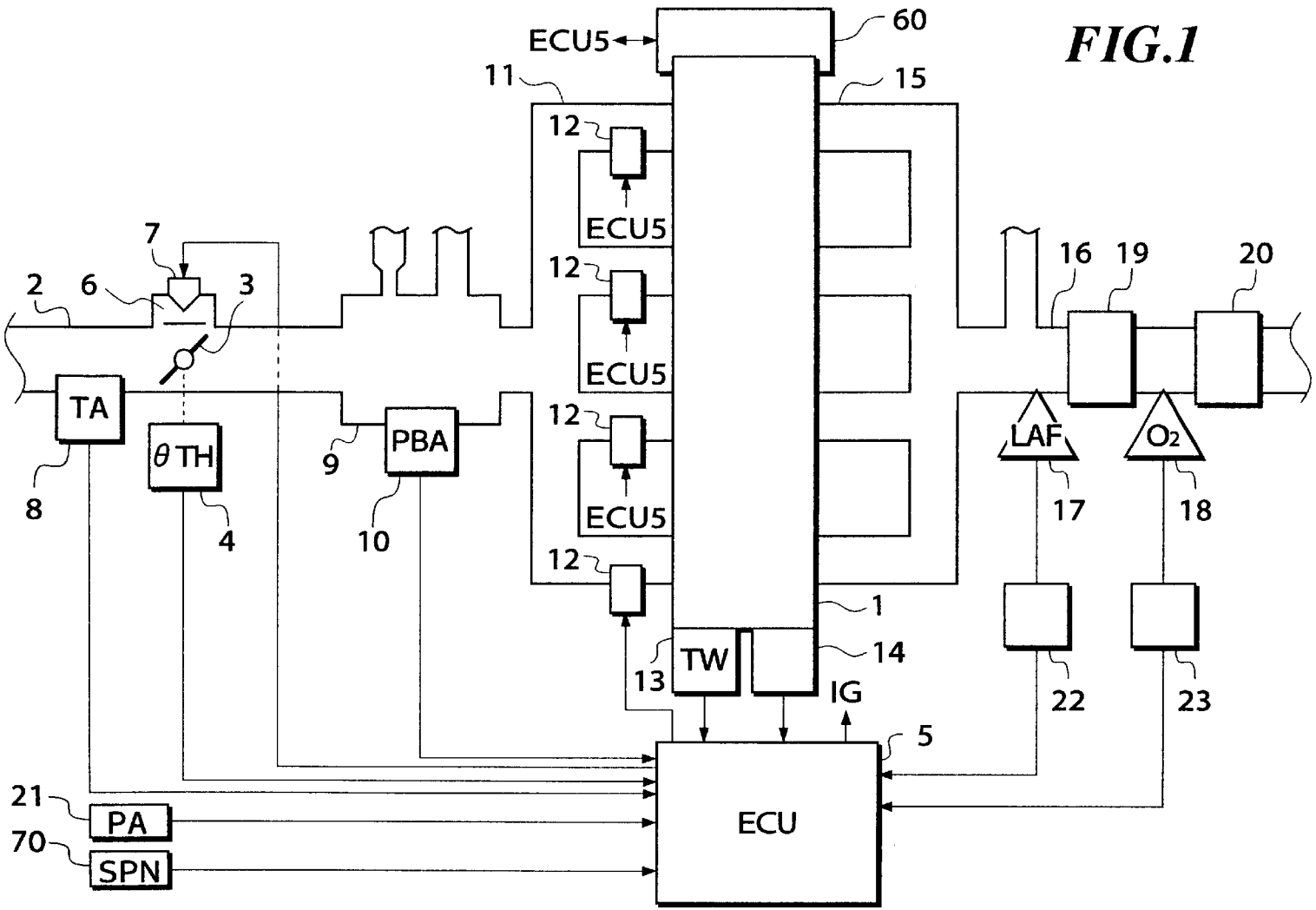
FIG. 1 is a block diagram showing the arrangement of an internal combustion engine and a control system therefor, including an air-fuel ratio control system according to an embodiment of the invention.

Referring first to FIG. 1, there is schematically shown the whole arrangement of an internal combustion engine and a control system therefor, including an air-fuel ratio control system according to a first embodiment of the invention. In the figure, reference numeral 1 designates a four-cylinder type internal combustion engine (hereinafter simply referred to as "the engine").

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5. The intake pipe 2 is provided with an auxiliary air passage 6 bypassing the throttle valve 3, and an auxiliary air amount control valve (electromagnetic valve) 7 is arranged across the auxiliary air passage 6. The auxiliary air amount control valve 7 is electrically connected to the ECU 5 to have an amount of opening thereof controlled by a signal therefrom.

An intake air temperature (TA) sensor 8 is inserted into the intake pipe 2 at a location upstream of the throttle valve 3, for supplying an electric signal indicative of the sensed intake air temperature TA to the ECU 5. The intake pipe 2 has a swelled portion 9 as a chamber interposed between the throttle valve 3 and the intake manifold 11. An intake pipe absolute pressure (PBA) sensor 10 is arranged in the chamber 9, for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant, for supplying an electric signal indicative of the sensed engine coolant temperature TW to the ECU 5. A crank angle position sensor 14 for detecting the rotational angle of a crankshaft, not shown, of the engine 1 is electrically connected to the ECU 5 for supplying an electric signal indicative of the sensed rotational angle of the crankshaft to the ECU 5.

The crank angle position sensor 14 is comprised of a cylinder-discriminating sensor, a TDC sensor, and a CRK sensor. The cylinder-discriminating sensor generates a signal pulse (hereinafter referred to as "a CYL signal pulse") at a predetermined crank angle of a particular cylinder of the engine 1, the TDC sensor generates a signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder, and the CRK sensor generates a signal pulse at each of predetermined crank angles (e.g. whenever the crankshaft rotates through 30 degrees) with a predetermined repetition period shorter than the repetition period of TDC signal pulses. The CYL signal pulse, TDC signal pulse, and CRK signal pulse are supplied to the ECU 5, which are used for controlling various kinds of timing, such as fuel injection timing and ignition timing, and for detecting the engine rotational speed NE.

Fuel injection valves 12 are inserted into the intake manifold 11 for respective cylinders at locations slightly upstream of intake valves, not shown. The fuel injection valves 12 are connected to a fuel pump, not shown, and electrically connected to the ECU 5 to have the fuel injection timing and fuel injection periods (valve opening periods) thereof controlled by signals therefrom. Spark plugs, not shown, of the engine 1 are also electrically connected to the ECU 5 to have the ignition timing θ IG thereof controlled by signals therefrom.

An exhaust pipe 16 of the engine has a manifold part (exhaust manifold) 15 directly connected to the combustion chambers of the cylinders of the engine 1. A linear output oxygen concentration sensor (hereinafter referred to as "the LAF sensor") 17 is arranged in a confluent portion of the exhaust pipe 16 at a location immediately downstream of the exhaust manifold 15. Further, a first three-way catalyst (immediate downstream three-way catalyst) 19 and a second three-way catalyst (bed-downstream three-way catalyst) 20 are arranged in the confluent portion of the exhaust pipe 16 at locations downstream of the LAF sensor 17, for purifying noxious components present in exhaust gases, such as HC, CO, and NOx. An oxygen concentration sensor (hereinafter referred to as "the O2 sensor") 18 is inserted into the exhaust pipe 16 at a location intermediate between the three-way catalysts 19 and 20.

The LAF sensor 17 is electrically connected via a low-pass filter 22 to the ECU 5, for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of exhaust gases from the engine changes across a stoichiometric air-fuel ratio to deliver a high level signal when the mixture is richer than the stoichiometric air-fuel ratio, and a low level signal when the mixture is leaner than the same. The O2 sensor 18 is electrically connected via a low-pass filter 23 to the ECU 5 for supplying the ECU 5 with the high or low level signal.

The LAF sensor 17 is provided with an output amplifier, not shown, which outputs a signal indicative of the internal resistance Ri of a detecting element of the LAF sensor 17 which is determined by a value of current flowing through the detecting element and a value of voltage output from the same, and supplies the signal to the ECU 5.

An automatic transmission, not shown, which is comprised of hydraulic clutches, etc. is interposed between the engine 1 and driving wheels of a vehicle in which the engine 1 is installed. The automatic transmission can have a shift position thereof, including a P range, an N range, and a D range, changed through operation of a shift lever, not shown.

The automatic transmission is provided with a shift position (SPN) sensor 70 which detects the selected shift position of the automatic transmission and generates a signal indicative of the sensed shift position to the ECU 5.

Further electrically connected to the ECU 5 are vehicle wheel speed sensors, not shown, for sensing driving wheel speed and driven wheel speed of the vehicle, signals indicative of the sensed vehicle wheel speeds being supplied to the ECU 5. The ECU 5 determines an excessive slip state of the driving wheel(s), based on the sensed driving wheel speed and driven wheel speed. When an excessive slip state is detected, the ECU 5 carries out traction control which includes leaning the air-fuel ratio, interrupting fuel supply to part of the cylinders of the engine, and/or retarding the ignition timing of the engine.

The engine 1 includes a valve timing changeover mechanism 60 which changes valve timing of at least the intake valves out of the the intake valves and exhaust valves, not shown, between a high speed valve timing suitable for operation of the engine in a high speed operating region thereof and a low speed valve timing suitable for operation of the engine in a low speed operating region thereof. The changeover of the valve timing includes not only timing of opening and closing of the valve but also changeover of the valve lift amount, and further, when the low speed valve timing is selected, one of the two intake valves is disabled, thereby ensuring stable combustion even when the air-fuel ratio of the mixture is controlled to a leaner value than the stoichiometric air-fuel ratio.

The valve timing changeover mechanism 60 changes the valve timing by means of hydraulic pressure, and an electromagnetic valve for changing the hydraulic pressure and a hydraulic pressure sensor, neither of which is shown, are electrically connected to the ECU 5. A signal indicative of the sensed hydraulic pressure is supplied to the ECU 5 which in turn controls the electromagnetic valve for changing the valve timing.

Further electrically connected to the ECU 5 is an atmospheric pressure (PA) sensor 21, for detecting atmospheric pressure PA, and supplying a signal indicative of the sensed atmospheric pressure PA to the ECU 5.

The ECU 5 is comprised of an input circuit having the functions of shaping the waveforms of input signals from various sensors including ones mentioned above, shifting the voltage levels of sensor output signals to a predetermined level, converting analog signals from analog-output sensors to digital signals, and so forth, a central processing unit (hereinafter referred to as "the CPU"), a memory circuit comprised of a ROM storing various operational programs which are executed by the CPU and various maps and tables, referred to hereinafter, and a RAM for storing results of calculations from the CPU, etc., and an output circuit which outputs driving signals to the fuel injection valves 12 and other electromagnetic valves, the spark plugs, etc.

The ECU 5 operates in response to the above-mentioned signals from the sensors to determine operating conditions in which the engine 1 is operating, such as an air-fuel ratio feedback control region in which air-fuel ratio feedback control is carried out in response to outputs from the LAF sensor 17 and the O2 sensor 18, and air-fuel ratio open-loop control regions, and calculates, based upon the determined engine operating conditions, the fuel injection period TOUT over which the fuel injection valves 12 are to be opened, by the use of the following equation (1), to output signals for driving the fuel injection valves 12, based on results of the calculation:

$$TOUT(N)=TIMF\times KTOTAL\times KCMDM\times KFB\times KOBSV\#N \quad (1)$$

where TIMF represents a basic value of the fuel injection amount TOUT(N), KTOTAL a correction coefficient, KCMDM a final desired air-fuel ratio coefficient, KFB a feedback control correction coefficient, and KOBSV#N a cylinder-by-cylinder correction coefficient, respectively.

Figure 2:
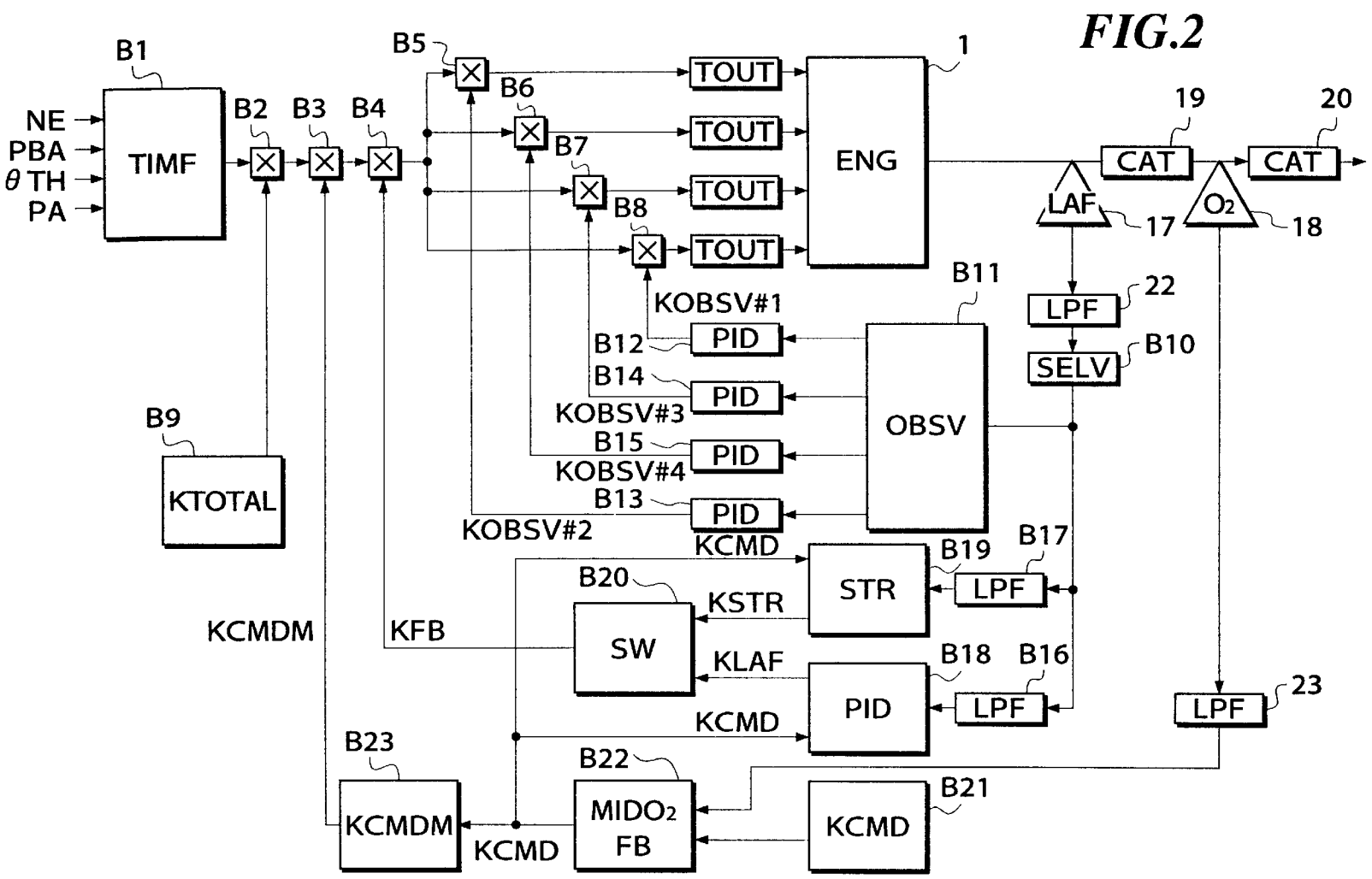
FIG. 2 is a block diagram useful in explaining a manner of controlling the air-fuel ratio of a mixture supplied to the engine.

FIG. 2 is a block diagram useful in explaining a manner of calculating the fuel injection period TOUT(N) by the use of the equation (1). With reference to the figure, an outline of the manner of calculating the fuel injection period TOUT (N) according to the present embodiment will be described. The suffix (N) represents a cylinder number, and a parameter with this suffix is calculated cylinder by cylinder. It should be noted that in the present embodiment, the amount of fuel to be supplied to the engine is calculated, actually, in terms of a time period over which the fuel injection valve 6 is opened (fuel injection period), but in the present specification, the fuel injection period TOUT is referred to as the fuel injection amount or the fuel amount since the fuel injection period is equivalent to the amount of fuel injected or to be injected.

In FIG. 2, a block B1 calculates the basic fuel amount TIMF corresponding to an amount of intake air supplied to the engine 1. The basic fuel amount TIMF is basically set according to the engine rotational speed NE and the intake pipe absolute pressure PBA. However, it is preferred that a model representative of a part of the intake system extending from the throttle valve 3 to the combustion chambers of the engine 1 is prepared in advance, and a correction is made to the basic fuel amount TIMF in dependence on a delay of the flow of intake air obtained based on the model. In this preferred method, the throttle valve opening θTH and the atmospheric pressure PA are also used as additional parameters indicative of operating conditions of the engine.

Reference numerals B2 to B8 designate multiplying blocks, which multiply the basic fuel amount TIMF by respective parameter values input thereto, and deliver the product values. These blocks carry out the arithmetic operation of the equation (1), and outputs from the multiplying blocks B5 to B8 provide fuel injection amounts TOUT(N) for the respective cylinders.

A block B9 multiplies together all feedforward correction coefficients, such as an engine coolant temperature-dependent correction coefficient KTW set according to the engine coolant temperature TW, an EGR-dependent correction coefficient KEGR set according to the amount of recirculation of exhaust gases during execution of the exhaust gas recirculation, and a purging-dependent correction coefficient KPUG set according to an amount of purged evaporative fuel during execution of purging by an evaporative fuel-processing system of the engine, not shown, to obtain the correction coefficient KTOTAL, which is supplied to the block B2.

A block B21 determines a desired air-fuel ratio coefficient KCMD based on the engine rotational speed NE, the intake pipe absolute pressure PBA, etc., and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on an output VMO2 from the O2 sensor 18 supplied via a low-pass filter 23, and delivers the corrected KCMD value to blocks B18, B19 and B23. The block B23 carries out fuel cooling-dependent correction of the corrected KCMD value to calculate the final desired air-fuel ratio coefficient KCMDM and supplies the same to the block B3.

A block B10 samples the output from the LAF sensor 17 supplied via a low-pass filter 22 with a sampling period in synchronism with generation of each CRK signal pulse, sequentially stores the sampled values in a ring buffer memory, not shown, and selects one of the stored values depending on operating conditions of the engine (LAF sensor output-selecting process), which was sampled at the optimum timing for each cylinder, to supply the selected value to a block B11 and the blocks B18 and B19 via respective low-pass filter blocks B16 and B17. The LAF sensor output-selecting process eliminates the inconveniences that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time of the LAF sensor per se changes depending on operating conditions of the engine.

The block B11 has the function of a so-called observer, i.e. a function of estimating a value of the air-fuel ratio for each cylinder from the air-fuel ratio (of a mixture of exhaust gases emitted from each cylinder) detected at the confluent portion of the exhaust system by the LAF sensor 17, and supplying the estimated value to a corresponding one of blocks B12 to B15 associated, respectively, with the four cylinders. In FIG. 2, the block B12 corresponds to a cylinder #1, the block B13 to a cylinder #2, the block B14 to a cylinder #3, and the block B15 to a cylinder #4. The blocks B12 to B15 calculate the cylinder-by-cylinder correction coefficient KOBSV#N (N=1 to 4) by PID control such that the air-fuel ratio of each cylinder (air-fuel ratio estimated by the observer B11 for each cylinder) becomes equal to a value of the air-fuel ratio detected at the confluent portion, and supply the KOBSV#N values to the blocks B5 to B8, respectively.

The block B18 calculates a PID correction coefficient KLAF through PID control, based on the difference between the actual air-fuel ratio and the desired air-fuel ratio, and delivers the calculated KLAF value to the block B20. The block B19 calculates an adaptive control correction coefficient KSTR through adaptive control (Self-Tuning Regulation), based on the actual air-fuel ratio detected by the LAF sensor 17 and the air-fuel ratio of each cylinder estimated by the observer block B11, and delivers the calculated KSTR value to the block B20. The reason for employing the adaptive control is as follows: If the basic fuel amount TIMF is merely multiplied by the desired air-fuel ratio coefficient KCMD (KCMDM), the resulting desired air-fuel ratio and hence the actual air-fuel ratio may become dull due to a response lag of the engine. The adaptive control is employed to dynamically compensate for the response lag of the engine to thereby improve the robustness of the air-fuel ratio control against external disturbances.

The block B20 selects either the PID correction coefficient KLAF or the adaptive control correction coefficient KSTR supplied thereto, depending upon operating conditions of the engine, and delivers the selected correction coefficient as the feedback correction coefficient KFB to the block B4. This selection is based on the fact that the use of the correction coefficient KLAF calculated by the ordinary PID control can be more suitable for the calculation of the TOUT value than the correction coefficient KSTR, depending on operating conditions of the engine.

According to the present embodiment, as described above, either the PID correction coefficient KLAF calculated by the ordinary PID control in response to the output from the LAF sensor 17, or the adaptive control correction coefficient KSTR calculated by the adaptive control is selectively applied as the correction coefficient KFB to the equation (1) to calculate the fuel injection amount TOUT (N). When the correction coefficient KSTR is applied, the responsiveness of the air-fuel ratio control to changes in the air-fuel ratio and the robustness of the same against external disturbances can be improved, and hence the purification rate of the catalysts can be improved to ensure good exhaust emission characteristics of the engine in various operating conditions of the engine. Further, the cylinder-by-cylinder correction coefficient KOBSV#N set according to the air-fuel ratio of each cylinder estimated based on the LAF sensor output is applied to the above equation (1) to calculate the fuel injection amount TOUT(N) for each cylinder. By virtue of the application of the cylinder-by-cylinder correction coefficient KOBSV#N, variations in the air-fuel ratio between the cylinders can be eliminated, and hence the purification rate of the catalysts can be improved to ensure good exhaust emission characteristics of the engine in various operating conditions.

In the present embodiment, the functions of the blocks appearing in FIG. 2 are realized by arithmetic operations executed by the CPU of the ECU 5, and details of the operations will be described with reference to program routines illustrated in the drawings.

Figure 3:
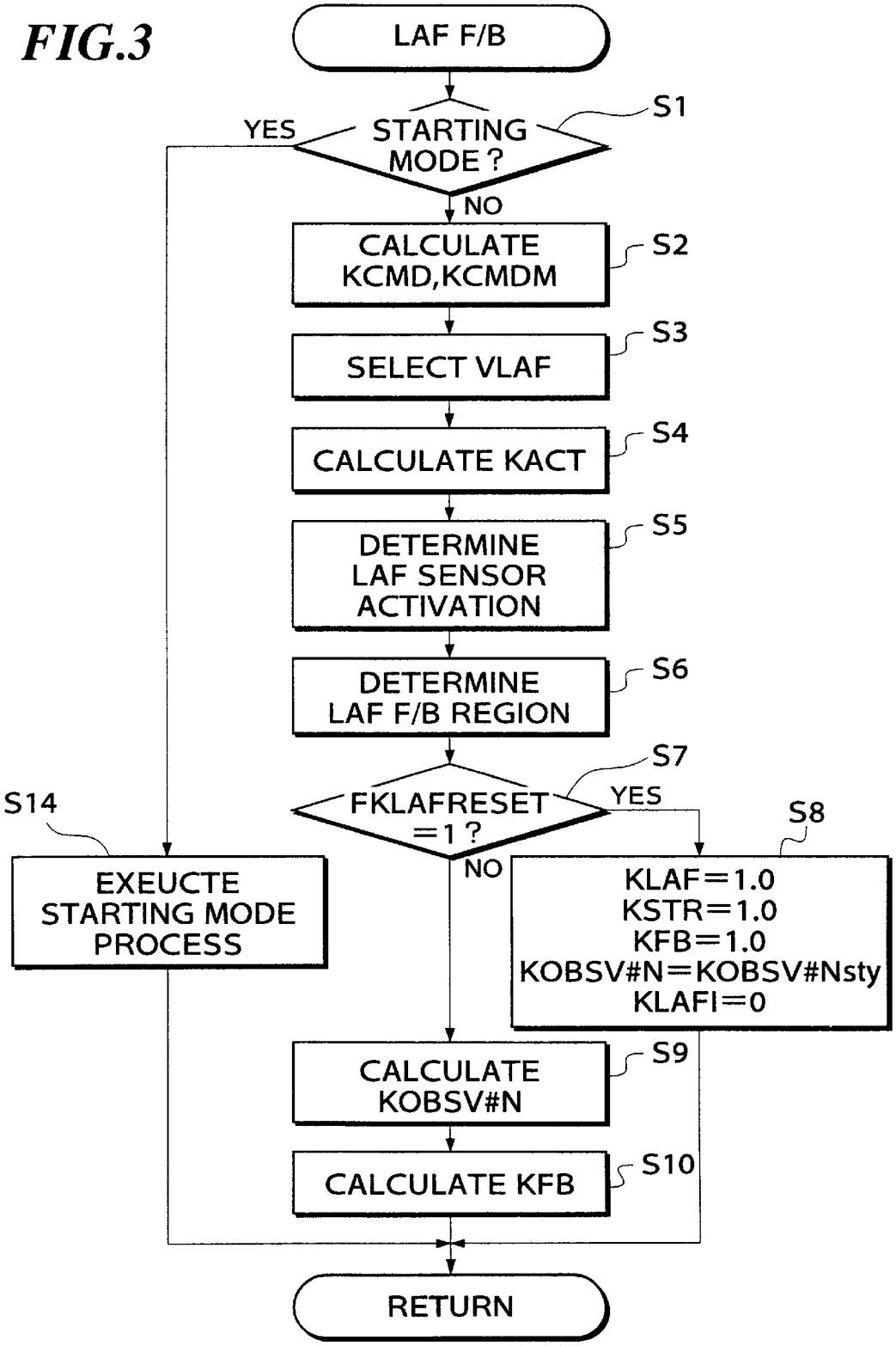
FIG. 3 is a flowchart showing a main routine for calculating a feedback correction coefficient KFB and a cylinder-by-cylinder correction coefficient KOBSV#N in response to an output from a LAF sensor appearing in FIG. 1.

FIG. 3 shows a main routine for calculating the PID correction coefficient KLAF and the adaptive control correction coefficient KSTR to thereby finally calculate the feedback correction coefficient KFB as well as for calculating the cylinder-by-cylinder correction coefficient KOBSV#N according to the output from the LAF sensor 17. This routine is executed in synchronism with generation of TDC signal pulses.

At a step S1, it is determined whether or not the engine is in starting mode, i.e. whether or not the engine is cranking. If the engine is in the starting mode, the program proceeds to a step S14 to execute a subroutine for the starting mode, not shown. If the engine is not in the starting mode, the desired air-fuel ratio coefficient (desired equivalent ratio) KCMD and the final desired air-fuel ratio coefficient KCMDM are calculated at a step S2, and a LAF sensor output-selecting process is executed at a step S3. Further, an actual equivalent ratio KACT is calculated at a step S4. The actual equivalent ratio KACT is obtained by converting the output from the LAF sensor 17 to an equivalent ratio value.

Then, it is determined at a step S5 whether or not the LAF sensor 17 has been activated. More specifically, if the internal resistance Ri of the LAF sensor 17 is smaller than a predetermined value, it is determined that the LAF sensor 17 has been activated.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region, e.g. when the LAF sensor 17 has been activated but at the same time neither fuel cut nor wide open throttle operation is being carried out. If it is determined that the engine is not in the LAF feedback control region, a reset flag FKLAFRESET which, when set to "1", indicates that the engine is not in the LAF feedback control region, is set to "1", whereas if it is determined the engine is in the LAF feedback control region, the reset flag FKLAFRESET is set to "0".

At the following step S7, it is determined whether or not the reset flag FKLAFRESET assumes "1". If FKLAFRSET=1 holds, the program proceeds to a step S8, wherein the PID correction coefficient KLAF, the adaptive control correction coefficient KSTR, and the feedback correction coefficient KFB are all set to "1.0", the cylinder-by-cylinder correction coefficient KOBSV#N is set to a learned value KOBSV#Nsty thereof, referred to hereinafter, and an integral term KLAFI used in the PID control is set to "0", followed by terminating the program. On the other hand, if FKLAFRESET=0 holds, the cylinder-by-cylinder correction coefficient KOBSV#N and the feedback correction coefficient KFB are calculated at respective steps S9 and S10, followed by terminating the present routine.

Figure 4:
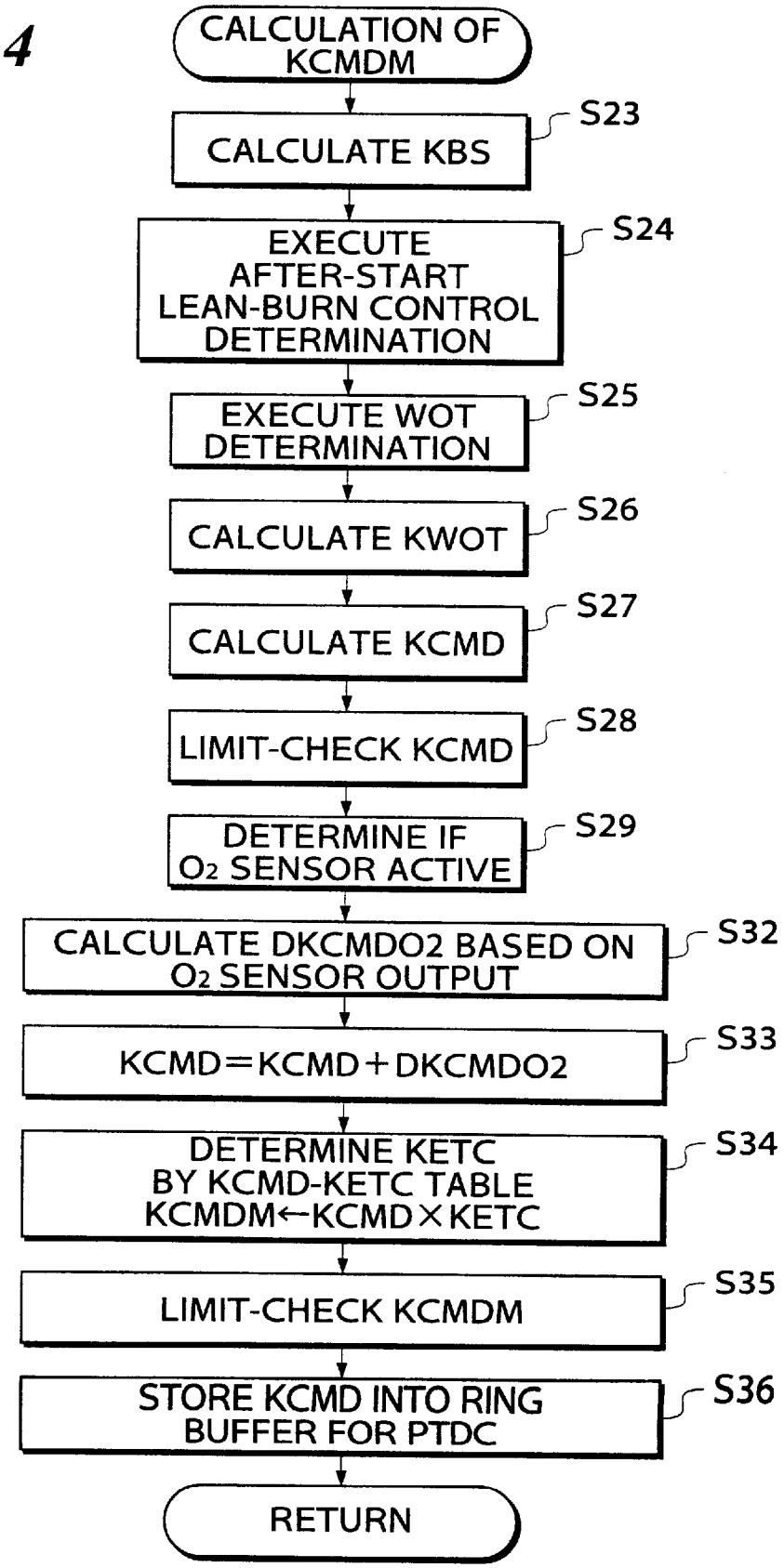
FIG. 4 is a flowchart showing a subroutine for calculating a final desired air-fuel ratio coefficient KCMDM, which is executed at a step S2 in FIG. 3.

FIG. 4 shows a subroutine for calculating the final desired air-fuel ratio correction coefficient KCMDM, which is executed at the step S2 in FIG. 3.

At a step S23, a basic value KBS is determined by retrieving a map according to the engine rotational speed NE and the intake pipe absolute pressure PBA. The map also contains values of the basic value KBS to be applied during idling of the engine.

At the following step S24, it is determined whether or not conditions for carrying out so-called after-start lean-burn control are fulfilled. If the conditions are fulfilled, an after-start leaning flag FASTLEAN is set to "1", whereas if they are not fulfilled, the flag FASTLEAN is set to "0". The conditions for the after-start lean-burn control are determined to be fulfilled when a predetermined time period has not elapsed after the start of the engine and at the same time the engine coolant temperature TW, the engine rotational speed NE and the intake pipe absolute pressure PBA are within respective predetermined ranges. The after-start lean-burn control is carried out for the purpose of preventing an increase in emission of HC occurring when the catalysts are inactive immediately after the start of the engine.

Then, at a step S25, it is determined whether or not the throttle valve is fully open (i.e. the engine is in a WOT condition). If the throttle valve is fully open, a WOT flag FWOT is set to "1", whereas if the throttle valve is not fully open, the same flag is set to "0". Then, an enriching correction coefficient KWOT is calculated according to the engine coolant temperature TW at a step S26. At the same time, a correction coefficient KXWOT to be applied in a high coolant temperature condition is also calculated.

At the following step S27, the desired air-fuel ratio coefficient KCMD is calculated, and then limit-checking of the calculated KCMD value is carried out to limit the KCMD value to a range defined by predetermined upper and lower limit values at a step S28. A subroutine for executing the step S27 will be described in detail hereinafter with reference to FIG. 5.

At the following step S29, it is determined whether or not the O2 sensor 18 has been activated. If the O2 sensor 18 has been activated, an activation flag FMO2 is set to "1", whereas if the O2 sensor has not been activated, the same flag is set to "0". The O2 sensor 18 is determined to have been activated e.g. when a predetermined time period has elapsed after the start of the engine. At the following step S32, a correction term DKCMDO2 for correcting the desired air-fuel ratio coefficient KCMD is calculated according to the output VMO2 from the O2 sensor 18. More specifically, the correction term DKCMDO2 is calculated through the PID control according to the difference between the O2 sensor output VMO2 and a reference value VREFM.

Then, at a step S33, the desired air-fuel ratio coefficient KCMD is corrected by the use of the following equation (2):

$$KCMD=KCMD+DKCMDO2 \quad (2)$$

This correction makes it possible to set the desired air-fuel ratio coefficient KCMD such that a deviation of the LAF sensor output from a proper value is corrected.

At the following step S34, a KCMD-KETC table is retrieved according to the calculated KCMD value to determine a correction coefficient KETC, and the final desired air-fuel ratio coefficient KCMDM is calculated by the use of the following equation (3):

$$KCMDM=KCMD\times KETC \quad (3)$$

The correction coefficient KETC compensates for the influence of fuel cooling effects caused by fuel injection, the degree of which increases as the KCMD value increases to increase the fuel injection amount. The correction coefficient KETC is set to a larger value as the KCMD value is larger.

Then, limit-checking of the calculated KCMDM value is carried out at a step S35, and the KCMD value obtained at the step S33 is stored in a ring buffer memory at a step S36, followed by terminating the subroutine.

Figure 5:
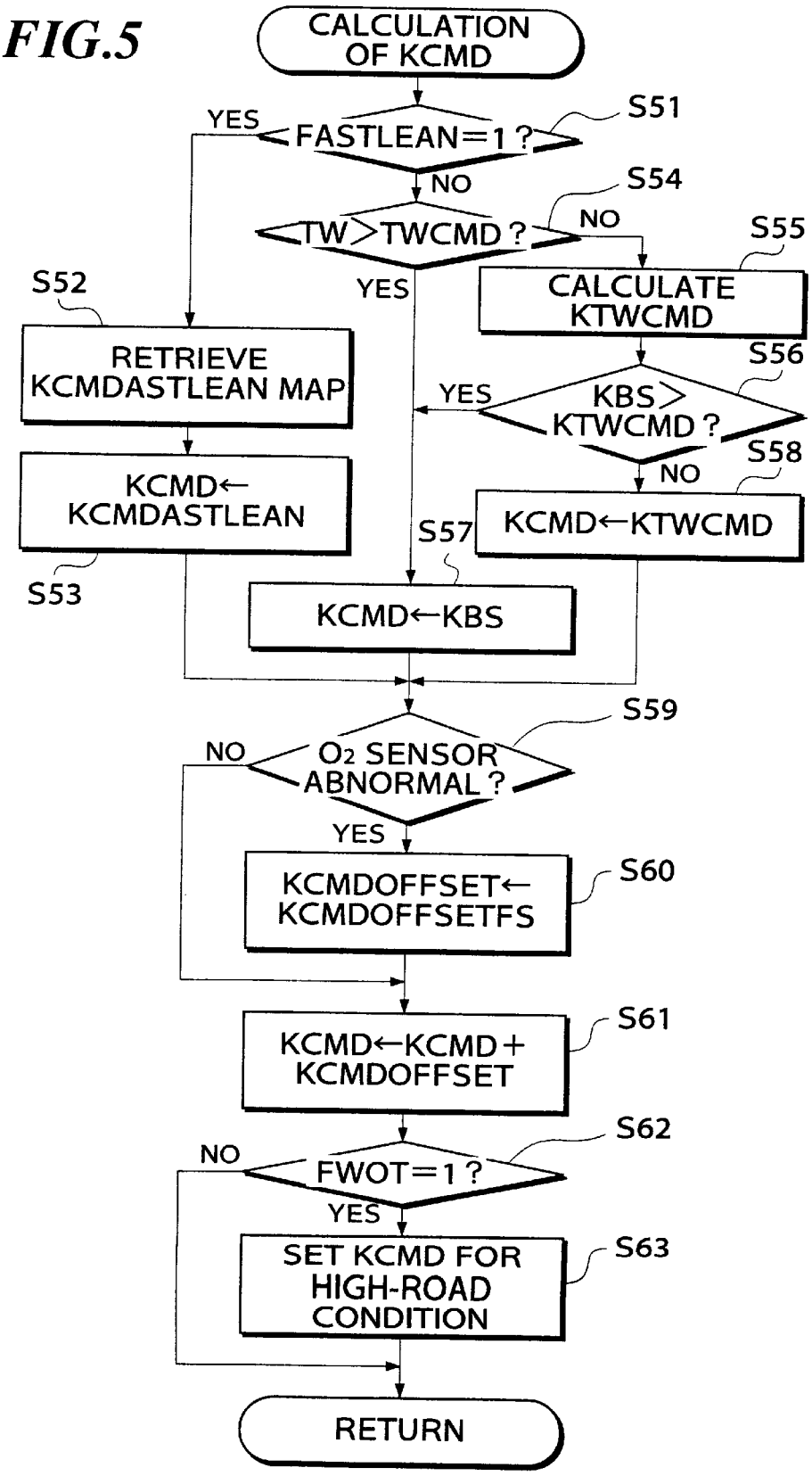
FIG. 5 is a flowchart showing a subroutine for calculating a desired air-fuel ratio coefficient KCMD, which is executed at a step S27 in FIG. 4.

FIG. 5 shows a subroutine for calculating the KCMD value, which is executed at the step S27 in FIG. 4.

First, at a step S51, it is determined whether or not the after-start leaning flag FASTLEAN which has been set at the step S24 in FIG. 4 is equal to "1". If FASTLEAN=1 holds, a KCMDASTLEAN map is retrieved to determine a leaning desired value KCMDASTLEAN which corresponds to a central air-fuel ratio suitable for the after-start lean-burn control, at a step S52. The KCMDASTLEAN map is set such that map values of the leaning desired value KCMDASTLEAN are set according to the engine coolant temperature TW and the intake pipe absolute pressure PBA. Then, at a step S53, the desired air-fuel ratio coefficient KCMD is set to the thus determined KCMDASTLEAN value, followed by the program proceeding to a step S59.

On the other hand, if FASTLEAN=0 holds at the step S51, which means that the conditions for executing the after-start lean-burn control are not satisfied, it is determined at a step S54 whether or not the engine coolant temperature TW is higher than a predetermined value TWCMD (e.g. 80° C.). If TW>TWCMD holds, the KCMD value is set to the basic value KBS calculated at the step S23 in FIG. 4, at a step S57, followed by the program proceeding to a step S59. If TW≦TWCMD holds, a map which is set according to the engine coolant temperature TW and the intake pipe absolute pressure PBA is retrieved to determine a desired value KTWCMD suitable for low coolant temperature at a step S55, and then it is determined at a step S56 whether or not the basic value KBS is larger than the determined KTWCMD value. If KBS>KTWCMD holds, the program proceeds to the step S57, whereas if KBS≦KTWCMD holds, the KCMD value is replaced by the determined desired value KTWCMD suitable for low coolant temperature at a step S58, followed by the program proceeding to the step S59.

At the step S59, it is determined whether or not abnormality of the O2 sensor 18 has been detected. If abnormality of the O2 sensor 18 has not been detected, the program skips to a step S61. On the other hand, if abnormality of the O2 sensor has been detected, an addend correction term KCMDOFFSET is set to a predetermined value KCMDOFFSETFS to be applied when the O2 sensor is abnormal at a step S60, followed by the program proceeding to the step S61.

At the step S61, the KCMD value is corrected by the use of the following equation (4), followed by the program proceeding to a step S62:

$$KCMD=KCMD+KCMDOFFSET \quad (4)$$

The addend correction term KCMDOFFSET is for finely adjusting the desired air-fuel ratio coefficient KCMD so as to compensate for variations in characteristics of the exhaust system of the engine and the LAF sensor, as well as changes in the exhaust system and the LAF sensor due to aging such that the actual air-fuel ratio assumes an optimum value for window zones of the three-way catalysts. The addend correction term KCMDOFFSET is set based on the characteristics of the LAF sensor 17, etc. Desirably, the KCMDOFF- SET value is a learned value obtained by learning based on the output from the O2 sensor 18, etc.

At a step S62, it is determined whether or not the WOT flag FWOT which has been set at the step S25 in FIG. 4 is equal to "1". If FWOT=0 holds, the program is immediately terminated, whereas if FWOT=1 holds, the desired air-fuel ratio correction coefficient KCMD is set to a value suitable for a high-load condition of the engine at a step S63, followed by terminating the present program. The step S63 is executed more specifically by comparing the KCMD value with the enriching correction coefficients KWOT and KXWOT for the high-load condition of the engine calculated at the step S26 in FIG. 4, and if the KCMD value is smaller than these values, the KCMD value is multiplied by the correction coefficient KWOT or KXWOT for correction of the same.

Next, the LAF sensor output-selecting process executed at the step S3 in FIG. 3 will be described.

Figures 7A, 7B:
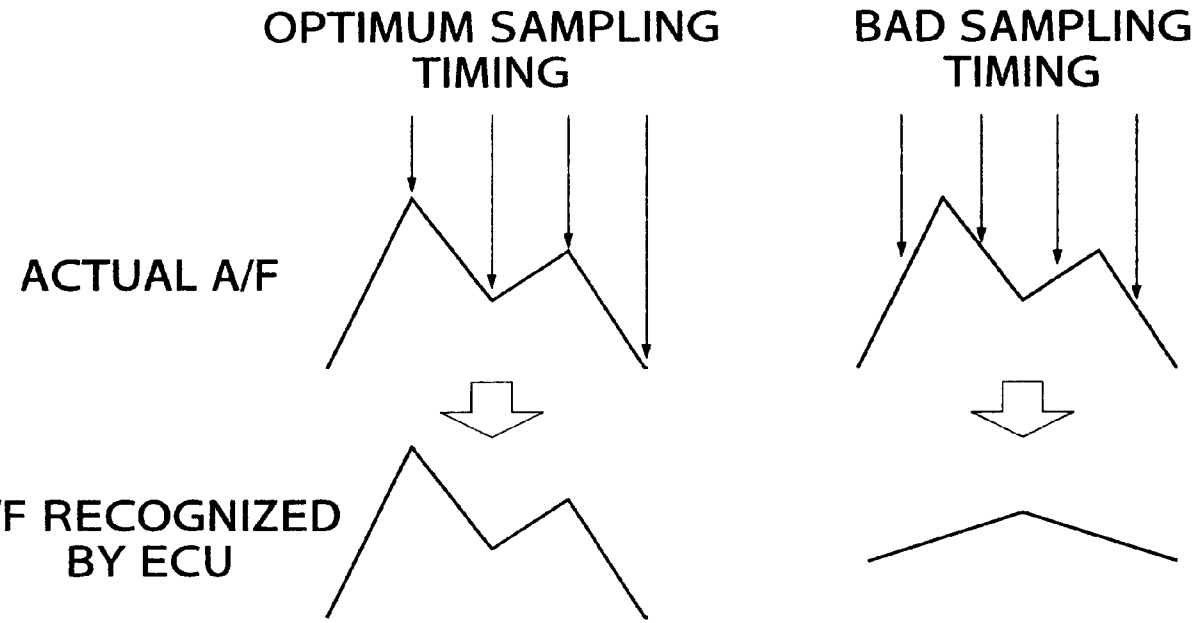

Exhaust gases are emitted from the engine on the exhaust stroke, and accordingly clearly the behavior of the air-fuel ratio detected at the confluent portion of the exhaust system of the multi-cylinder engine is synchronous with generation of each TDC signal pulse. Therefore, detection of the air-fuel ratio by the LAF sensor 17 is also required to be carried out in synchronism with generation of each TDC signal pulse. However, depending on the timing of sampling the output from the LAF sensor 17, there are cases where the behavior of the air-fuel ratio cannot be accurately grasped. For example, if the air-fuel ratio detected at the confluent portion of the exhaust system varies as shown in FIG. 6B in comparison with timing of generation of each TDC signal pulse shown in FIG. 6A, the air-fuel ratio recognized by the ECU 5 can have quite different values depending on the timing of sampling, as shown in FIG. 7B. Therefore, it is desirable that the sampling of the output from the LAF sensor 17 should be carried out at such timing as enables the ECU 5 to recognize actual variation of the sensor output as accurately as possible.

Further, the variation in the air-fuel ratio also depends upon a time period required for exhaust gases emitted from the cylinder to reach the LAF sensor 17 as well as upon the response time of the LAF sensor 17. The required time period depends on the pressure and volume of exhaust gases, etc. Further, sampling of the sensor output in synchronism with generation of each TDC signal pulse is equivalent to sampling of the same based on the crank angle position, so that the sampling result is inevitably influenced by the engine rotational speed NE. The optimum timing of detection of the air-fuel ratio thus largely depends upon operating conditions of the engine.

Figure 8:
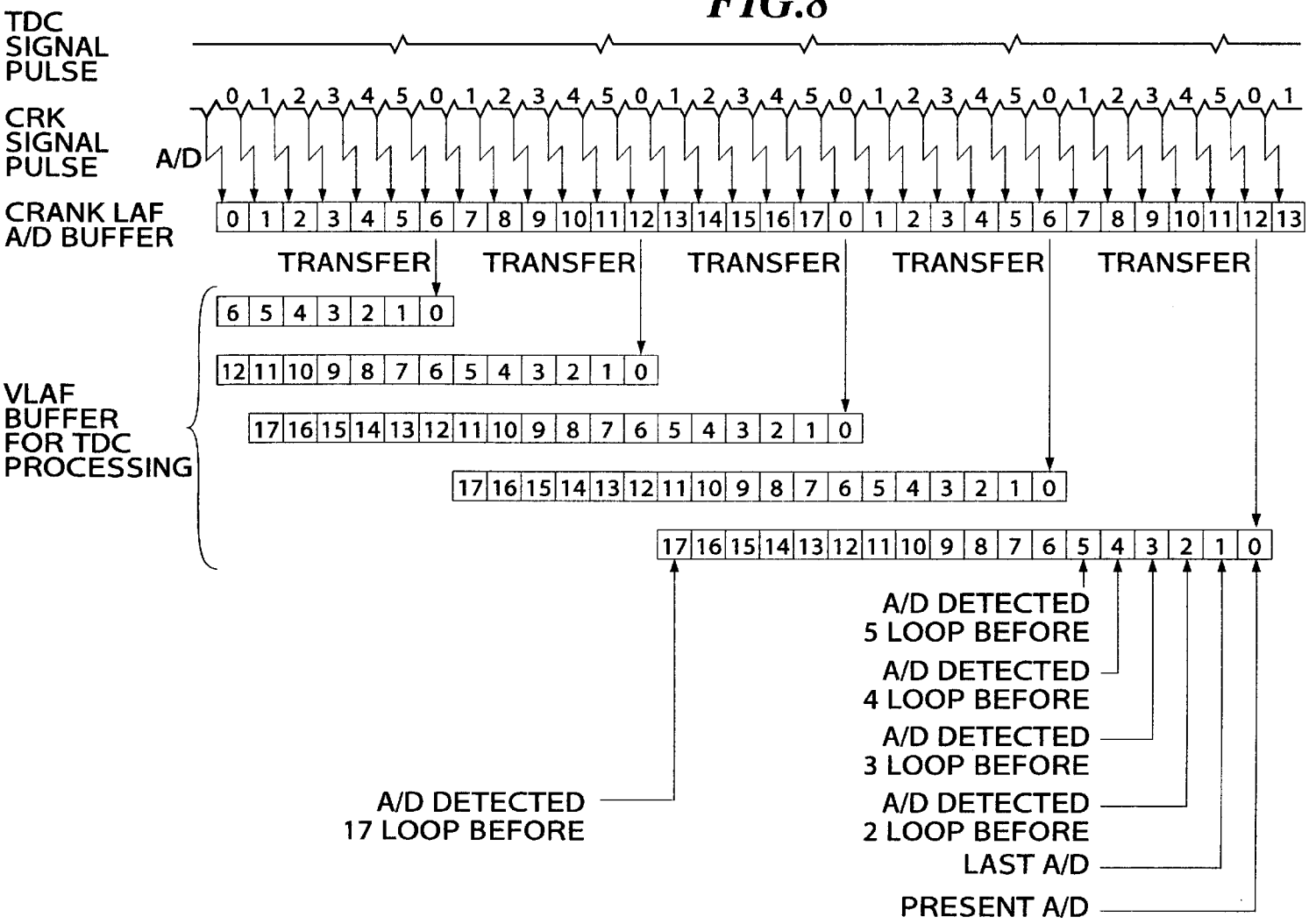
FIG. 8 is a diagram which is useful in explaining how to select a value of the output from the LAF sensor sampled at the optimum timing from values of the same sampled whenever a CRK signal pulse is generated.

In view of the above fact, in the present embodiment, as shown in FIG. 8, values of the output VLAF from the LAF sensor 17 sampled in synchronism generation of each CRK signal pulse (at crank angle intervals of 30 degrees) are sequentially stored in a ring buffer (VLAF buffer) (having 18 storage locations in the present embodiment), and one sampled at the optimum timing (selected out of the values from a value obtained 17 loops before to the present value) is converted to the actual equivalent ratio KACT for use in the feedback control.

Figure 9:
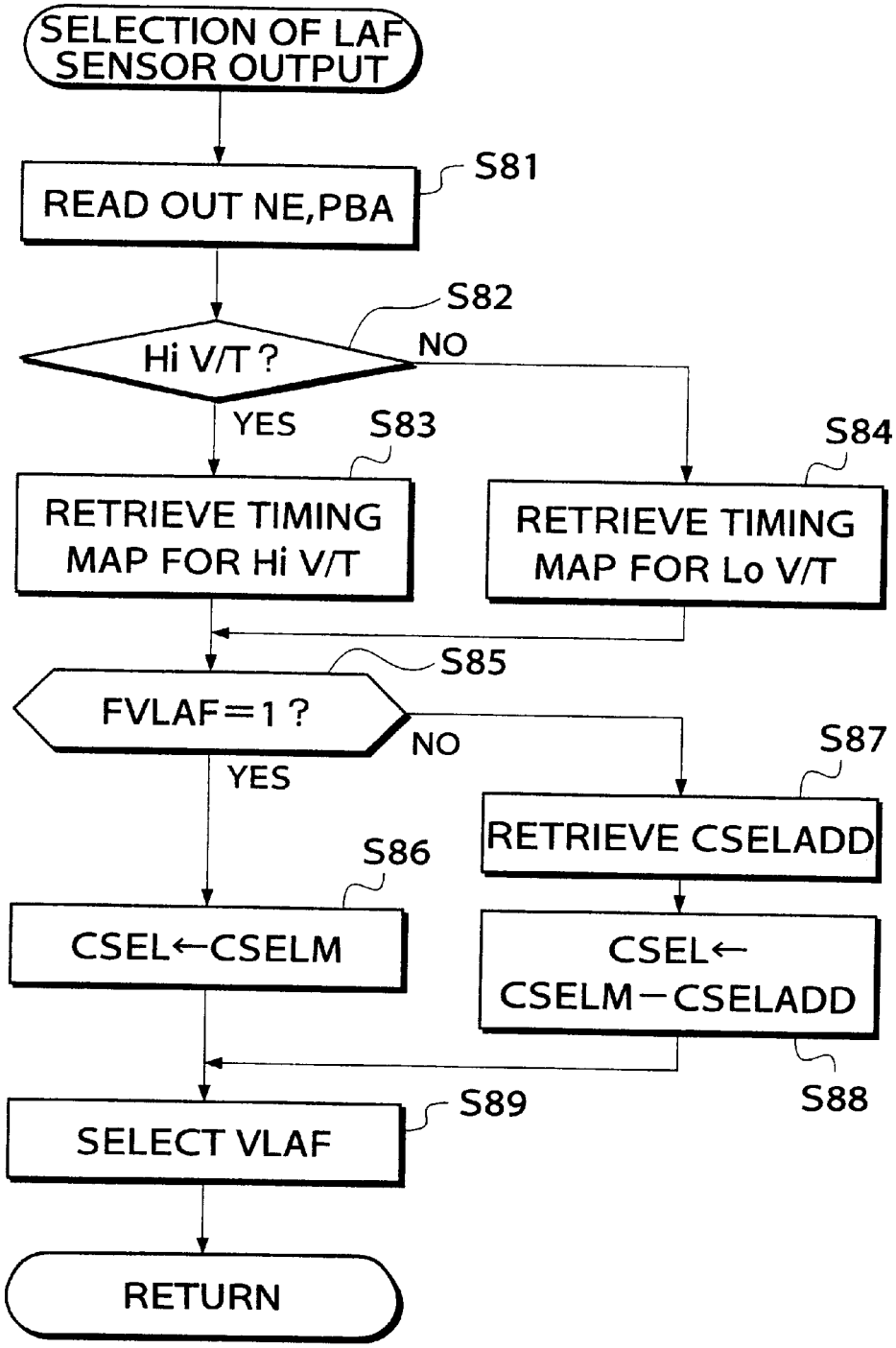
FIG. 9 is a flowchart showing a subroutine for selecting a value of the output from the LAF sensor (LAF sensor output value), which is executed at a step S3 in FIG. 3.

FIG. 9 shows a subroutine for carrying out the LAF sensor output-selecting process, which is executed at the step S3 in FIG. 3.

First, at a step S81, the engine rotational speed NE and the intake pipe absolute pressure PBA are read out, and then it is determined at a step S82 whether or not the present valve timing has been set to the high-speed valve timing. If the valve timing has been set to the high-speed valve timing, a timing map for the high-speed valve timing is retrieved at a step S83, to obtain a map value CSELM of sampling timing of the LAF sensor output. On the other hand, if the valve timing has been set to the low-speed valve timing, a timing map for the low-speed valve timing is retrieved at a step S84, to obtain the map value CSELM. The map value CSELM is a value within a range of 0 to 17 in the present embodiment (see FIG. 8).

Then, it is determined at a step S85 whether or not an output stableness flag FVLAF which, when set to "1" indicates that the LAF sensor 17 has been activated, assumes "1". If FVLAF=1 holds, which means that the LAF sensor 17 has been activated, the sampling timing CSEL is set to the map value CSELM obtained at the step S83 or S84, at a step S86, followed by the program proceeding to a step S89. On the other hand, if FVLAF=0 holds, which means that the LAF sensor 17 has not been activated (i.e. it is in the intermediate state or in an inactive state), a CSELADD table shown in FIG. 12 is retrieved according to the internal resistance Ri of the LAF sensor 17, to determine a correction term CSELADD at a step S87. The internal resistance Ri lowers as the temperature of the LAF sensor 17 becomes higher. If Ri>R1 (first predetermined value, e.g. 140 Ω) holds, it is determined that the LAF sensor 17 is in the inactive state, and therefore the air-fuel ratio feedback control is not carried out, as described hereinafter.

Then, at a step S88, the correction term CSELADD is subtracted from the map value CSELM to calculate a value of the sampling timing CSEL, followed by the program proceeding to a step S89.

At the step S89, one of the LAF sensor output VLAF values stored in the ring buffer is selected according to the calculated CSEL value, followed by terminating the program.

Figure 10:
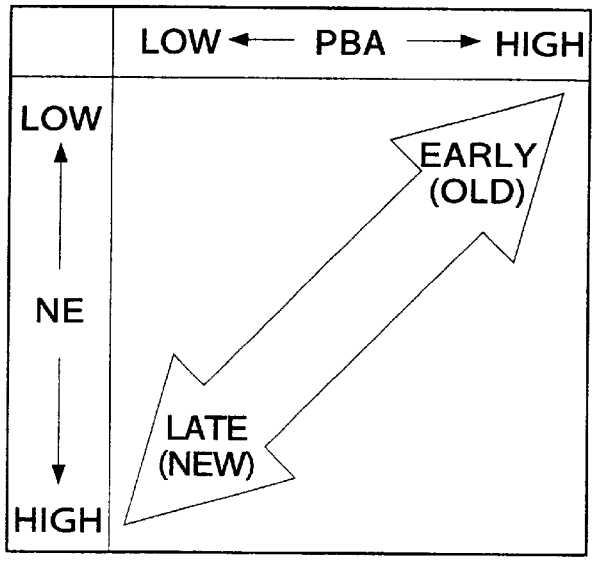
FIG. 10 is a diagram showing characteristics of timing maps used in the FIG. 9 subroutine.
Figure 11A:
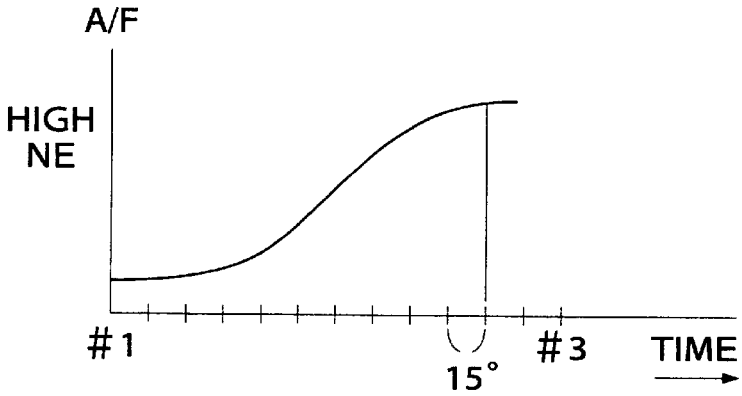
FIG. 11A is a diagram showing characteristics of the output from the LAF sensor assumed at a high engine rotational speed, which is useful in explaining the characteristics of the timing maps shown in FIG. 10.
Figure 11B:
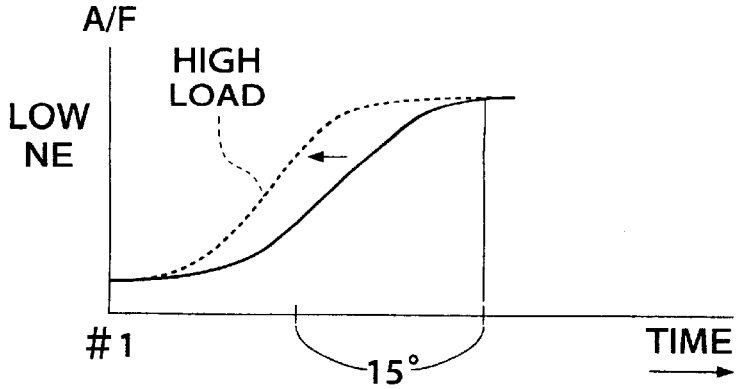
FIG. 11B is a diagram showing characteristics of the output from the LAF sensor assumed at a low engine rotational speed with a shift to be effected when a change in load on the engine occurs, which is useful in explaining the characteristics of the timing maps shown in FIG. 10.

The timing maps are set e.g. as shown in FIG. 10 such that as the engine rotational speed NE is lower and/or the intake pipe absolute pressure PBA is higher, a value sampled at an earlier crank angle position is selected. The word "earlier" in this case means "closer to the immediately preceding TDC position of the cylinder" (in other words, an "older" sampled value is selected). The setting of these maps is based on the fact that as shown in FIGS. 7A and 7B referred to before, the air-fuel ratio is best sampled at timing closest to time points corresponding to maximal and minimal values (hereinafter both referred to as "extreme values" of the actual air-fuel ratio), and assuming that the response time of the LAF sensor 17 is constant, an extreme value, e.g. a first peak value, occurs at an earlier crank angle position as the engine rotational speed NE is lower, and the pressure and volume of exhaust gases emitted from the cylinders increase with increase in the load on the engine, so that the exhaust gases reach the LAF sensor 17 in a shorter time period, as shown in FIGS. 11A and 11B.

In the above described manner, according to the FIG. 9 subroutine, the sensor output VLAF value sampled at the optimum timing is selected depending on operating conditions of the engine, which improves the accuracy of detection of the air-fuel ratio. As a result, the accuracy of estimation of the air-fuel ratio of each cylinder by the observer is improved, to thereby improve the accuracy of the air-fuel ratio feedback control for each cylinder.

Further, when the LAF sensor 17 is in the intermediate state, i.e. before the LAF sensor becomes activated, the sampling timing CSEL is corrected to a more retarded (later) value according to the internal resistance Ri of the LAF sensor 17, to thereby achieve good air-fuel ratio feedback control performance.

Figure 13:
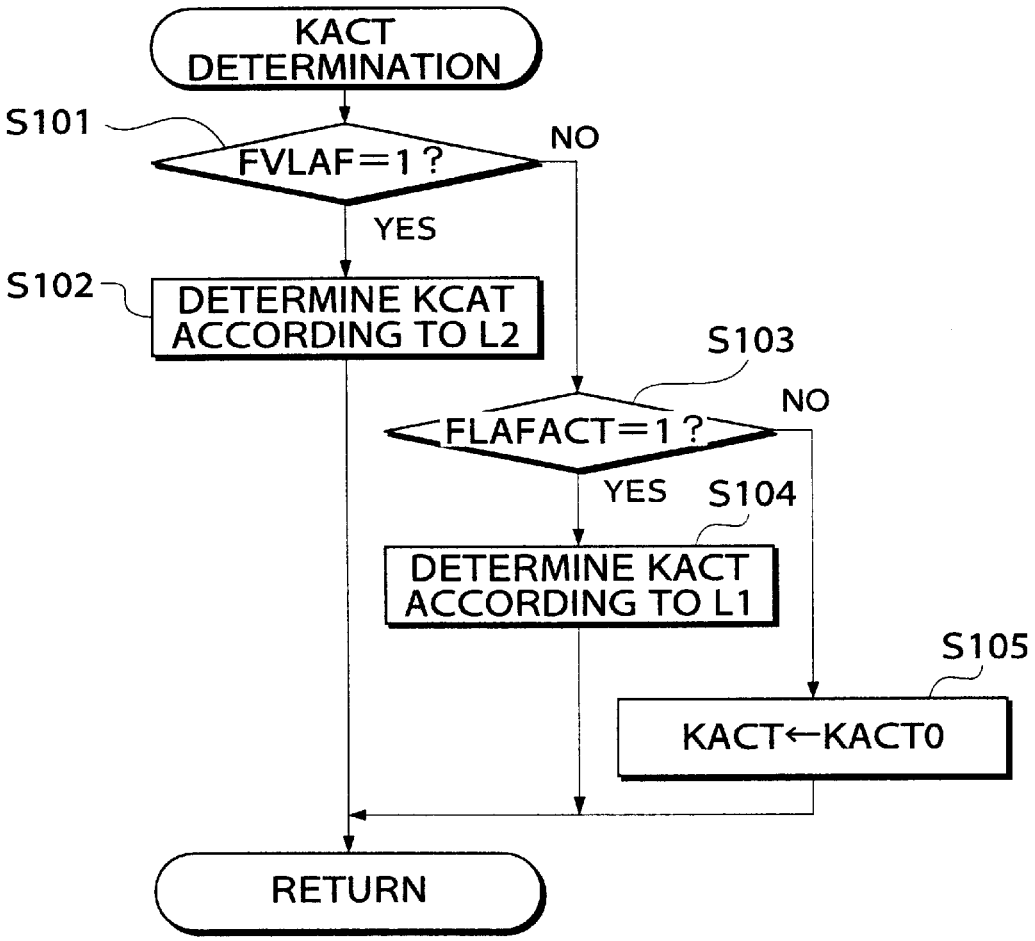
FIG. 13 is a flowchart showing a subroutine for converting the LAF sensor output to an actual equivalent ratio KACT, which is executed at a step S4 in FIG. 3.

FIG. 13 shows a subroutine for calculating the KACT value, which is executed at the step S4 in FIG. 3.

Figure 14:
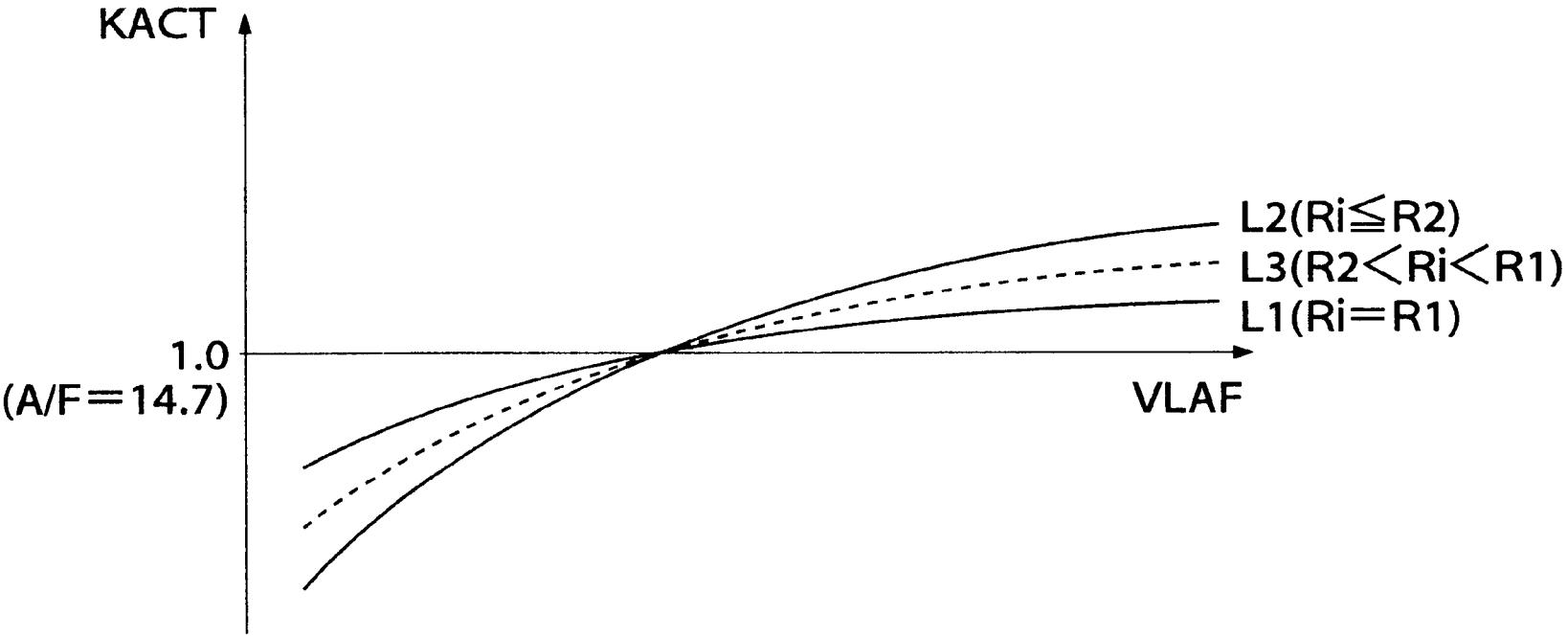
FIG. 14 shows a table for determining the KACT value, which is used in the FIG. 13 subroutine.

First, at a step S101, it is determined whether or not the output stableness flag FVLAF is equal to "1". If FVLAF=1 holds, which means that the LAF sensor 17 has been activated, the sensor output VLAF is converted to the actual equivalent ratio KACT by using a curve L2 in FIG. 14, at a step S102. The curve L2 represents a conversion characteristic applied when the internal resistance Ri of the LAF sensor 17 is below a predetermined value R2 and hence the LAF sensor 17 is activated.

On the other hand, if FVLAF=0 holds at the step S101, it is determined at a step S103 whether or not an activation flag FLAFACT which, when set to "1", indicates that the LAF sensor 17 is activated or in the intermediate state, is equal to "1". If FLAFACT=1 holds, which means that the LAF sensor 17 is in the intermediate state, the VLAF value is converted to the equivalent ratio KACT by using a curve, e.g. a curve L3, obtained by interpolation based on curves L1 and L2 in FIG. 14, at a step S104. The curve L1 represents a conversion characteristic applied when the internal resistance Ri is equal to the first predetermined value R1. On the other hand, if FLAFACT=0 holds, which means that the LAF sensor 17 is in the inactive state, the equivalent ratio KACT is set to a predetermined value KACT0 at a step S105.

Thus, when the LAF sensor 17 is in the intermediate state, the conversion characteristic applied to convert the LAF sensor output VLAF to the equivalent ratio KACT is changed according to the internal resistance Ri, and therefore the LAF sensor output can be converted to almost the same KACT value so long as the air-fuel ratio remains constant, irrespective of the activation degree of the LAF sensor, to thereby achieve good air-fuel ratio feedback control performance.

Figure 15:
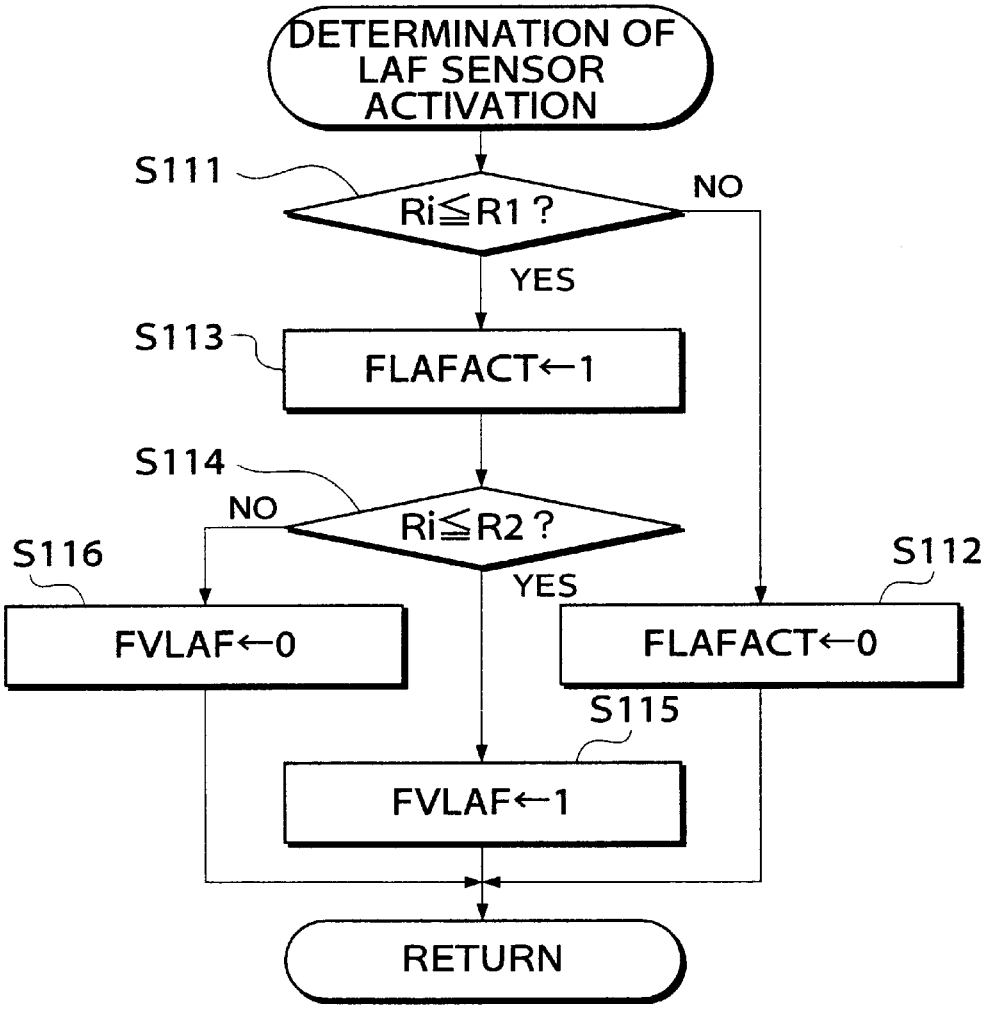
FIG. 15 is a flowchart showing a subroutine for carrying out a LAF sensor activation-determining process, which is executed at a step S5 in FIG. 3.

FIG. 15 shows a subroutine for carrying out a LAF sensor activation-determining process, which is executed at the step S5 in FIG. 3.

First, at a step S111, it is determined whether or not the internal resistance Ri is smaller than the first predetermined value R1. If Ri>R1 holds, it is determined that the LAF sensor 17 is in the inactive state, and then the activation flag FLAFACT is set to "0" at a step S112, followed by terminating the present subroutine.

On the other hand, if Ri≦R1 holds, the activation flag FLAFACT is set to "1" at a step S113, and then it is determined at a step S114 whether or not the internal resistance Ri is smaller than a second predetermined value R2 (e.g. 90 Ω). If Ri>R2 holds, it is determined that the LAF sensor 17 is in the intermediate state, and then the output stableness flag FVLAF is set to "1" at a step S115, followed by terminating the present subroutine.

Thus, in the present embodiment, if FLAFACT=0 holds, the LAF sensor 17 is determined to be in the inactive state, while if FLAFACT=1 and at the same time FVLAF=0 hold, the LAF sensor is determined to be in the intermediate state. Further, if FVLAF=1 holds, the LAF sensor 17 is determined to be in the active state.

Figure 16:
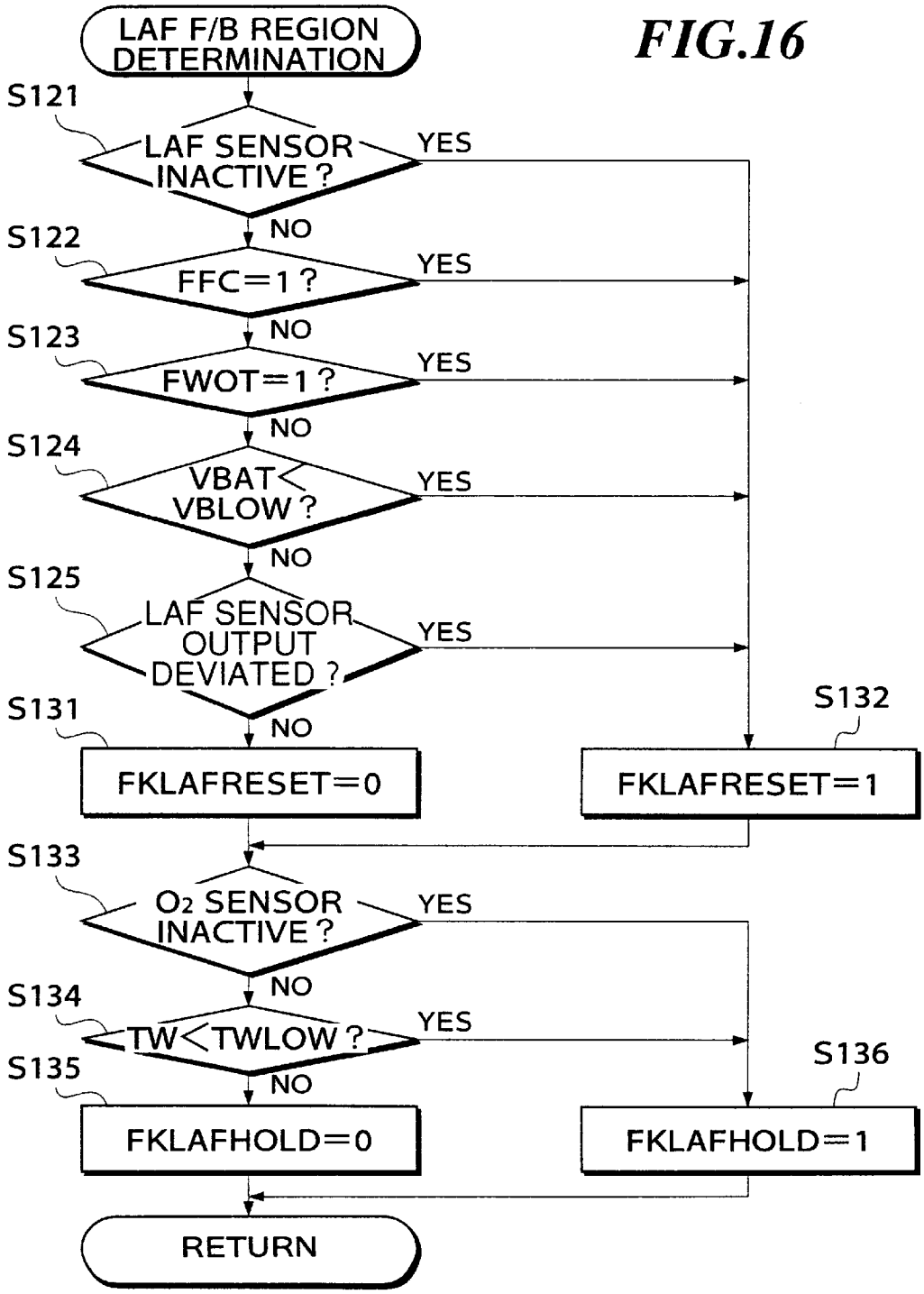
FIG. 16 is a flowchart showing a subroutine for carrying out a LAF feedback control region-determining process, which is executed at a step S6 in FIG. 3.

FIG. 16 shows a subroutine for carrying out a LAF feedback control region-determining process, which is executed at the step S6 in FIG. 3.

First, at a step S121, it is determined whether or not the LAF sensor 17 is in the inactive state, i.e. if the activation flag FLAFACT is equal to "0". If FLAFACT=1 holds, it is determined at a step S122 whether or not a flag FFC which, when set to "1", indicates that fuel cut is being carried out, assumes "1". If FFC=0 holds, it is determined at a step S123 whether or not the WOT flag FWOT which, when set to "1", indicates that the engine is operating in the wide open throttle condition, assumes "1". If FWOT=1 does not hold, it is determined at a step S124 whether or not battery voltage VBAT detected by a battery voltage sensor, not shown, is lower than a predetermined lower limit value VBLOW. If VBAT≦VBLOW holds, it is determined at a step S125 whether or not there is a deviation of the LAF sensor output from the proper value corresponding to the stoichiometric air-fuel ratio (LAF sensor output deviation). If any of the answers to the questions of the steps S121 to S125 is affirmative (YES), the reset flag FKLAFRESET which, when set to "1", indicates that the feedback control based on the LAF sensor output should be terminated, is set to "1" at a step S132.

On the other hand, if all the answers to the questions of the steps S121 to S125 are negative (NO), it is determined that the feedback control based on the LAF sensor output can be carried out, and therefore the reset flag FKLAFRESET is set to "0" at a step S131.

At the following step S133, it is determined whether or not the O2 sensor 18 is in the inactive state. If the O2 sensor 18 is in the active state, it is determined at a step S134 whether or not the engine coolant temperature TW is lower than a predetermined lower limit value TWLOW (e.g. 0° C.). If the O2 sensor 18 is in the inactive state or if TW<TWLOW holds, a hold flag FKLAFHOLD which, when set to "1", indicates that the PID correction coefficient KLAF should be held at the present value, is set to "1" at a step S136, followed by terminating the program. If the O2 sensor 18 has been activated and at the same time TW≧TWLOW holds, the hold flag FKLAFHOLD is set to "0" at a step S135, followed by terminating the program.

Next, description will be made of the manner of calculation of the cylinder-by-cylinder correction coefficient KOBSV#N executed at the step S9 in FIG. 3.

In the following description, first, a manner of estimating the cylinder-by-cylinder air-fuel ratio by the observer will be described, and then a manner of calculating the cylinder-by-cylinder correction coefficient KOBSV#N according to the estimated cylinder-by-cylinder air-fuel ratio will be described.

The air-fuel ratio detected at the confluent portion of the exhaust system is regarded as a weighted average value of air-fuel ratio values of the cylinders, which reflects time-dependent contributions of all the cylinders, whereby values of the air-fuel ratio detected at time points (k), (k+1), and (k+2) are expressed by equations (5A), (5B), and (5C), respectively. In preparing these equations, the fuel amount (F) was used as an operation amount, and accordingly the fuel-air ratio F/A is used in these equations:

$$[F/A](k) = C_1[F/A\#1] + C_2[F/A\#3] + C_3[F/A\#4] + C_4[F/A\#2] \quad (5A)$$

$$[F/A](k+1) = C_1[F/A\#3] + C_2[F/A\#4] + C_3[F/A\#2] + C_4[F/A\#1] \quad (5B)$$

$$[F/A](k+2) = C_1[F/A\#4] + C_2[F/A\#2] + C_3[F/A\#1] + C_4[F/A\#3] \quad (5C)$$

Figure 17:
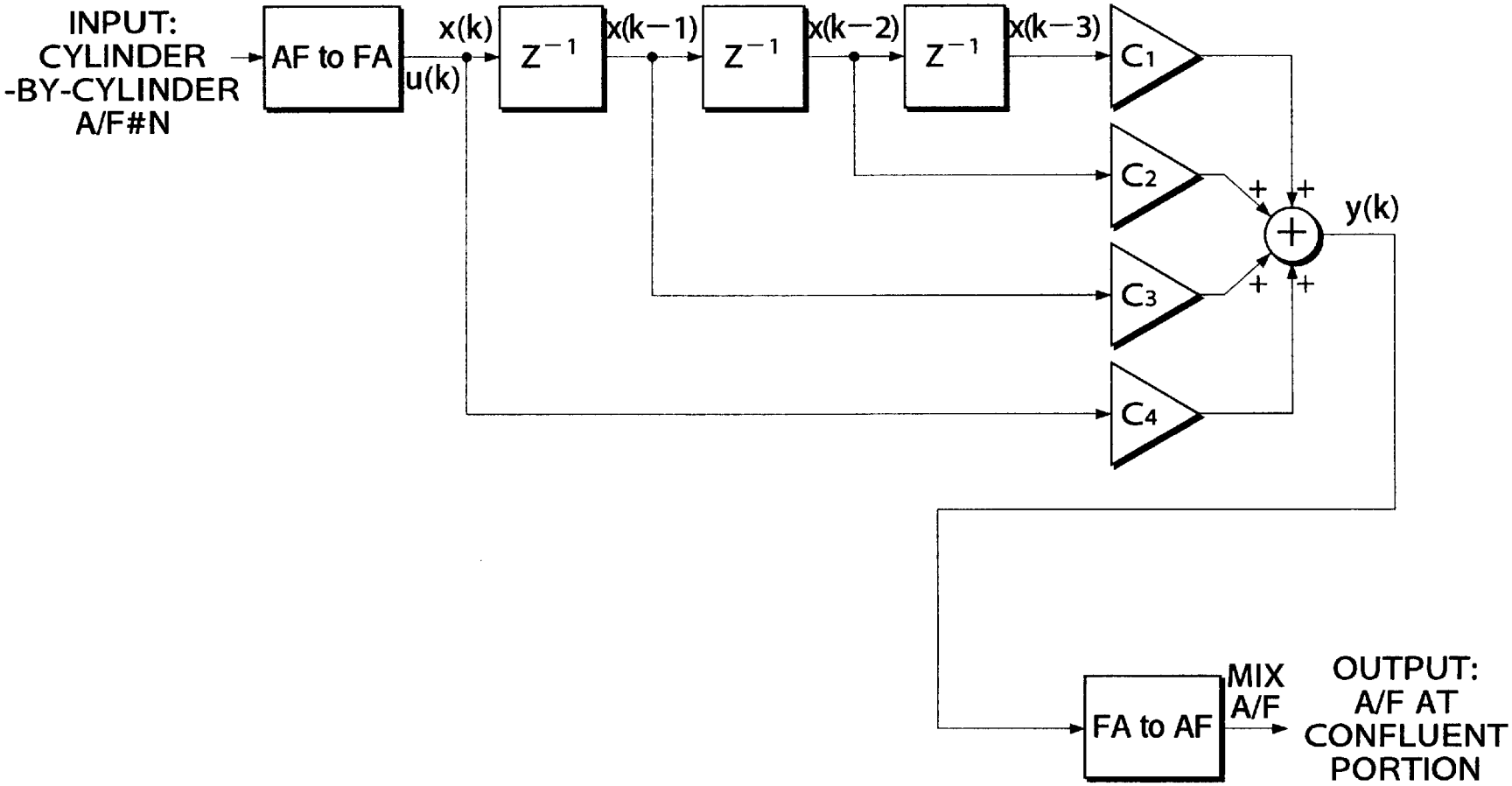
FIG. 17 is a block diagram showing a model representative of the behavior of the exhaust system of the engine.

More specifically, the fuel-air ratio detected at the confluent portion of the exhaust system is expressed as the sum of values of the cylinder-by-cylinder fuel-air ratio multiplied by respective weights C varying in the order of combustion (e.g. 40% for a cylinder corresponding to the immediately preceding combustion, 30% for one corresponding to the second preceding combustion, and so on). This model can be expressed in a block diagram as shown in FIG. 17, and the state equation therefor is expressed by the following equation (6):

$$\begin{bmatrix} x(k-2) \\ x(k-1) \\ x(k) \end{bmatrix} = \begin{bmatrix} 0 & 1 & 0 \\ 0 & 0 & 1 \\ 0 & 0 & 0 \end{bmatrix} \begin{bmatrix} x(k-3) \\ x(k-2) \\ x(k-1) \end{bmatrix} + \begin{bmatrix} 0 \\ 0 \\ 1 \end{bmatrix} u(k) \tag{6}$$

Further, if the fuel-air ratio detected at the confluent portion is designated by y(k), the output equation can be expressed by the following equation (7):

$$y(k) = [\, C_1 \quad C_2 \quad C_3 \,] \begin{bmatrix} x(k-3) \\ x(k-2) \\ x(k-1) \end{bmatrix} + C_4 u(k) \tag{7}$$

where, $C_1$: 0.05, $C_2$: 0.15, $C_3$: 0.30, $C_4$: 0.50.

In the equation (7), u(k) cannot be observed, and hence an observer designed based on this state equation cannot perform observation of x(k). Therefore, on the assumption that a value of the air-fuel ratio detected four TDC signal pulses earlier (i.e. the immediately preceding value for the same cylinder) represents a value obtained under a steady operating condition of the engine without any drastic change in the air-fuel ratio, it is regarded that x(k+1)=x(k−3), whereby the equation (7) can be changed into the following equation (8):

$$\begin{bmatrix} x(k-2) \\ x(k-1) \\ x(k) \\ x(k+1) \end{bmatrix} = \begin{bmatrix} 0 & 1 & 0 & 0 \\ 0 & 0 & 1 & 0 \\ 0 & 0 & 0 & 1 \\ 1 & 0 & 0 & 0 \end{bmatrix} \begin{bmatrix} x(k-3) \\ x(k-2) \\ x(k-1) \\ x(k) \end{bmatrix} \tag{8}$$

$$y(k) = [\, C_1 \quad C_2 \quad C_3 \quad C_4 \,] \begin{bmatrix} x(k-3) \\ x(k-2) \\ x(k-1) \\ x(k) \end{bmatrix}$$

It has been empirically ascertained that the thus set model well represents the exhaust system of a four-cylinder type engine. Therefore, a problem arising from estimating the cylinder-by-cylinder air-fuel ratio from the air-fuel ratio A/F at the confluent portion of the exhaust system is the same as a problem with an ordinary Kalman filter used in observing x(k) by the following state equation and output equation (9). If weight matrices Q, R are expressed by the following equation (10), the Riccati's equation can be solved to obtain a gain matrix K represented by the following equation (11):

$$\begin{bmatrix} X(k+1) = AX(k) + Bu(k) \\ y(k) = CX(k) + Du(k) \end{bmatrix} \tag{9}$$

-continued where $$A = \begin{bmatrix} 0 & 1 & 0 & 0 \\ 0 & 0 & 1 & 0 \\ 0 & 0 & 0 & 1 \\ 1 & 0 & 0 & 0 \end{bmatrix} \quad C = [\, C_1 \quad C_2 \quad C_3 \quad C_4 \,] \quad B = D = [0]$$

$$X(k) = \begin{bmatrix} x(k-3) \\ x(k-2) \\ x(k-1) \\ x(k) \end{bmatrix}$$

$$Q = \begin{bmatrix} 1 & 0 & 0 & 0 \\ 0 & 1 & 0 & 0 \\ 0 & 0 & 1 & 0 \\ 0 & 0 & 0 & 1 \end{bmatrix} \quad R = [1] \tag{10}$$

$$K = \begin{bmatrix} -0.3093 \\ 1.1916 \\ 0.3093 \\ 0.0803 \end{bmatrix} \tag{11}$$

Figure 18:
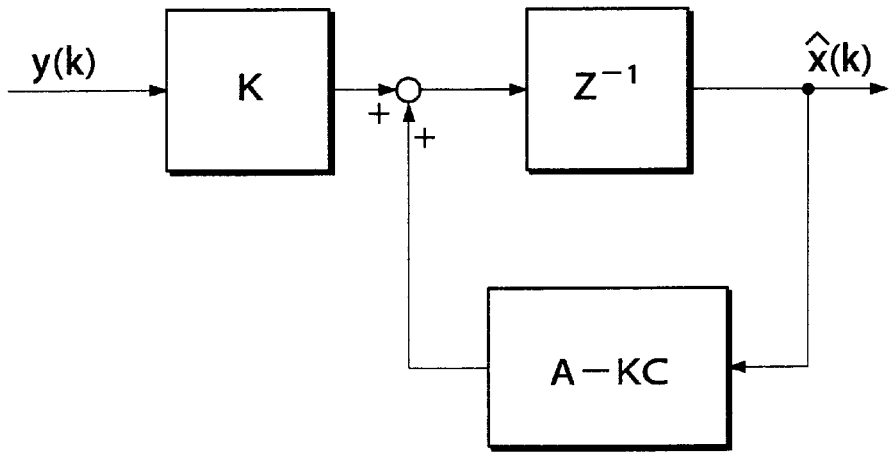
FIG. 18 is a block diagram showing the construction of an observer, which is applied to the model of the exhaust system.

In the model of the present embodiment, there is no inputting of u(k) which is input to an observer of a general type, so that the observer of the present embodiment is constructed such that y(k) alone is input thereto as shown in FIG. 18, which is expressed by the following equation (12):

$$\begin{aligned} \hat{X}(k+1) &= [A - KC]\hat{X}(k) + Ky(k) \\ &= A\hat{X}(k) + K\big(y(k) - C\hat{X}(k)\big) \end{aligned} \tag{12}$$

$$\hat{x}(k) = \begin{bmatrix} \hat{x}(k-3) \\ \hat{x}(k-2) \\ \hat{x}(k-1) \\ \hat{x}(k) \end{bmatrix}$$

Therefore, from the fuel-air ratio y(k) at the confluent portion and the estimated value X∧(k) of the cylinder-by-cylinder fuel-air ratio obtained in the past, the estimated value X∧(k+1) of the same in the present loop can be calculated.

When the above equation (12) is employed to calculate the cylinder-by-cylinder fuel-air ratio X∧(k+1), the actual equivalent ratio KACT(k) is substituted for the fuel-air ratio y(k) at the confluent portion. However, the actual equivalent ratio KACT(k) contains the response delay of the LAF sensor 17, whereas the CX∧(k) value (weighted sum of four cylinder-by-cylinder fuel-air ratio values) does not contain the response delay. Therefore, the cylinder-by-cylinder fuel-air ratio cannot be accurately estimated by the use of the equation (12), due to the influence of the response delay of the LAF sensor 17. Especially, at a high engine rotational speed NE when time intervals at which TDC signal pulses are generated are shorter, the influence of the response delay upon the accuracy of the estimation is large.

According to the present embodiment, therefore, an estimated value y∧(k) of the fuel-air ratio at the confluent portion is calculated by the use of the following equation (13), and the thus calculated value y∧(k) is applied to the following equation (14), to thereby calculate the estimated value X∧(k+1) of the cylinder-by-cylinder air-fuel ratio:

$$\hat{y}(k) = DL\hat{y}(k-1) + (1-DL)C\hat{X}(k) \quad (13)$$

$$\hat{X}(k+1) = A\hat{X}(k) + K(y(k) - \hat{y}(k)) \quad (14)$$

Figure 19:
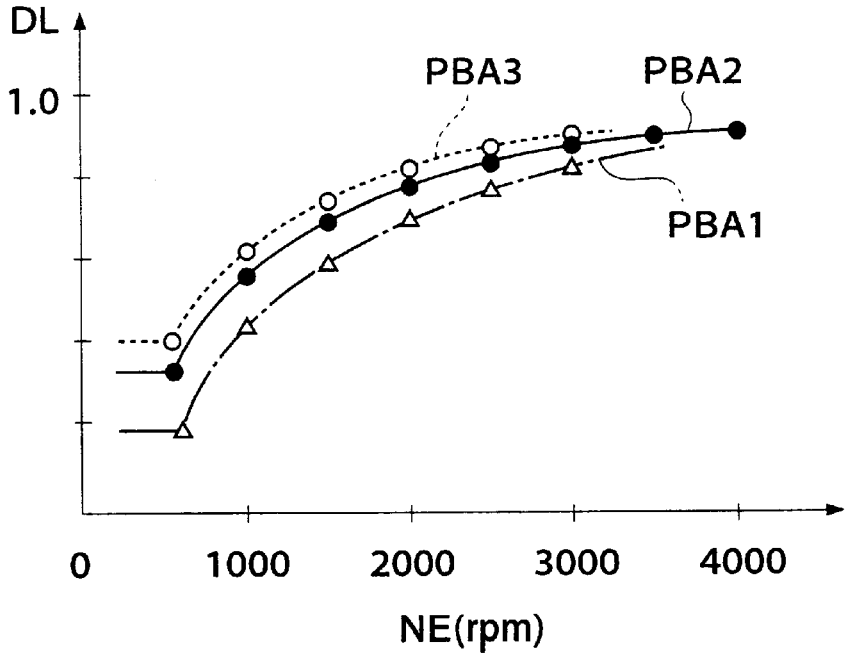
FIG. 19 shows a table for determining a response delay time constant DL for the LAF sensor.

In the above equation (13), DL represents a parameter corresponding to a time constant of the response delay of the LAF sensor 17, which is determined from a DL table shown in FIG. 19. The DL table is set such that the DL value is set to a value between 0 to 1.0 according to the engine rotational speed NE and the intake pipe absolute pressure PBA. In the figure, PBA1 to PBA3 represent 660 mmHg, 460 mmHg, and 260 mmHg, respectively, and an interpolation is carried out when the NE and/or PBA value falls between the predetermined values. It has been empirically ascertained that the best compensation for the response delay of the LAF sensor 17 can be obtained if the time constant DL is set to a value corresponding to a time period longer than the actual response delay by approximately 20%.

In the above equations (13) and (14), an initial vector of the X^(k) value is set such that component elements thereof (x^(k−3), x^(k−2), x^(k−1), x^(k)) all assume 1.0, and in the equation (13), an initial value of the estimated value y^(k−1) is set to 1.0.

By thus using the equation (14) which is obtained by replacing the CX^(k) in the equation (12) by the estimated value y^(k) of the fuel-air ratio at the confluent portion containing the response delay, the response delay of the LAF sensor can be properly compensated for, to thereby carry out accurate estimation of the cylinder-by-cylinder air-fuel ratio. In the following description, estimated equivalent ratio values KACT#1(k) to KACT#4(k) for the respective cylinders correspond to the x^(k) value.

Figure 20:
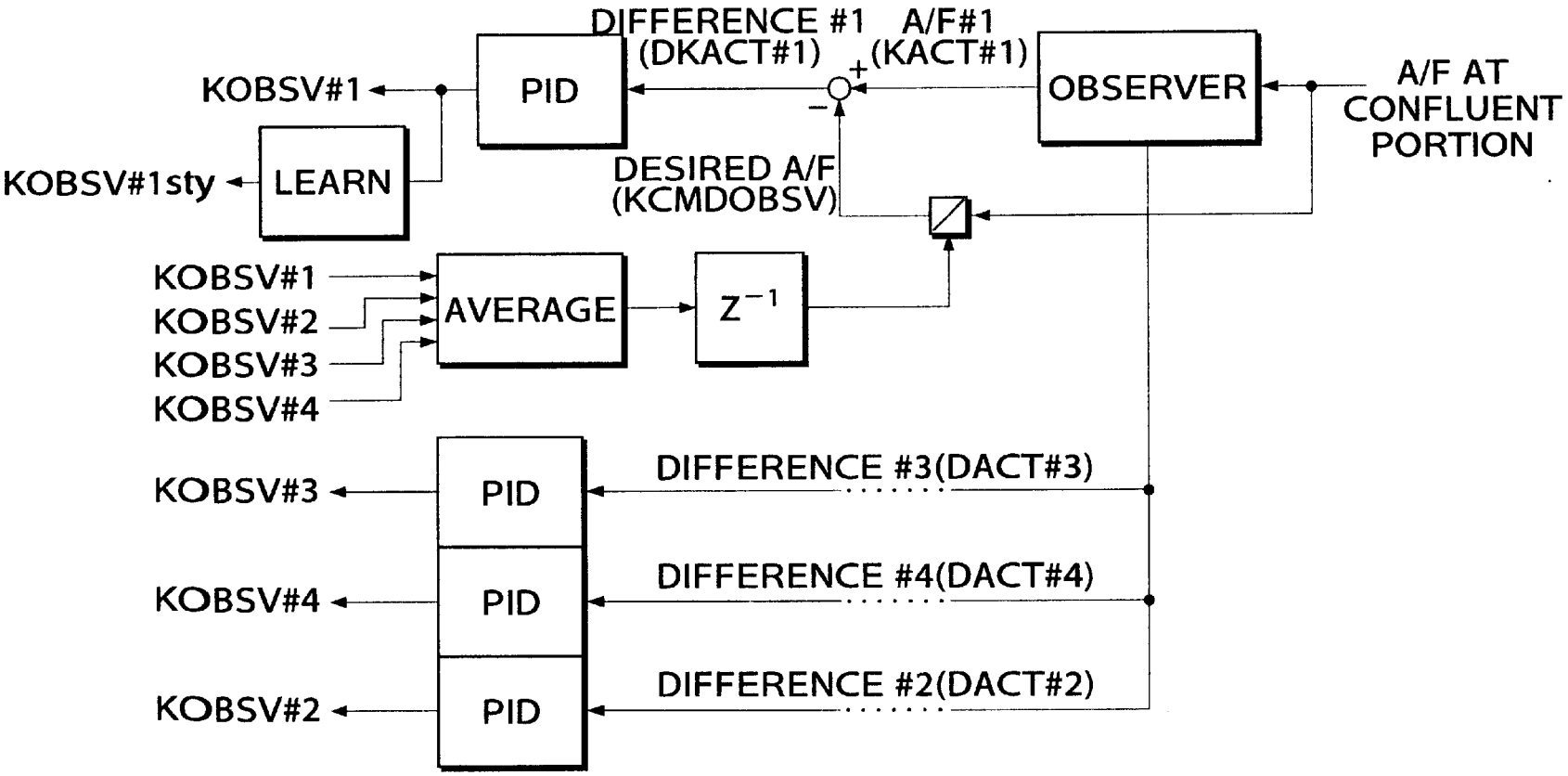
FIG. 20 is a diagram which is useful in explaining the manner of cylinder-by-cylinder air-fuel ratio feedback control.

Next, description will be made of the manner of calculating the cylinder-by-cylinder correction coefficient KOBSV#N, based on the thus estimated cylinder-by-cylinder air-fuel ratio, with reference to FIG. 20.

As shown in the following equation (15), the actual equivalent ratio KACT corresponding to the air-fuel ratio A/F at the confluent portion is divided by the immediately preceding value of an average value of the cylinder-by-cylinder correction coefficient KOBSV#N for all the cylinders, to thereby calculate a desired value KCMDOBSV (k) as an equivalent ratio corresponding to the desired air-fuel ratio. The cylinder-by-cylinder correction coefficient KOBSV#1 for the #1 cylinder is calculated by the PID control such that the difference DKACT#1(k) (=KACT#1 (k)−KCMDOBSV(k)) between the desired value KCMDOBSV(k) and the estimated equivalent ratio KACT#1(k) for the #1 cylinder becomes equal to zero:

$$KCMDOBSV(k) = KACT(k) \Big/ \left( \sum_{N=1}^{4} KOBSV\#N(k-1)/4 \right) \quad (15)$$

More specifically, a proportional term KOBSVP#1, an integral term KOBSVI#1, and a differential term KOBSVD#1 for use in the PID control are calculated by the use of the respective following equations (16A), (16B), and (16C), to thereby calculate the cylinder-by-cylinder correction coefficient KOBSV#1 by the use of the following equation (17):

$$KOBSVP\#1(k) = KPOBSV \times DKACT\#1(k) \quad (16A)$$

$$KOBSVI\#1(k) = KIOBSV \times DKACT\#1(k) + KOBSVI\#1(k-1) \quad (16B)$$

$$KOBSVD\#1(k) = KDOBSV \times (DKACT\#1(k) - DKACT\#1(k-1)) \quad (16C)$$

$$KOBSV\#1(k) = KOBSVP\#1(k) + KOBSVI\#1(k) + KOBSVD\#1(k) \quad (17)$$

where KPOBSV, KIOBSV and KDOBSV represent a basic proportional term, a basic integral term, and a basic differential term, respectively.

The same calculations are carried out with respect to the cylinders #2 to #4, to obtain the cylinder-by-cylinder correction coefficients KOBSV#2 to KOBSV#4 therefor.

By this control operation, the air-fuel ratio of the mixture supplied to each cylinder is converged to the air-fuel ratio detected at the confluent portion of the exhaust system. Since the air-fuel ratio at the confluent portion is converged to the desired air-fuel ratio by the use of the PID correction coefficient KLAF, the air-fuel ratio values of mixtures supplied to all the cylinders can be eventually converged to the desired-air fuel ratio.

Further, the learned value KOBSV#Nsty of the cylinder-by-cylinder correction coefficient KOBSV#N is calculated by the use of the following equation (18) and stored:

$$KOBSV\#Nsty = Csty \times KOBSV\#N + (1-Csty) \times KOBSV\#Nsty \quad (18)$$

where Csty represents a weighting coefficient, and KOBSV#Nsty on the right side the immediately preceding learned value.

Figure 21:
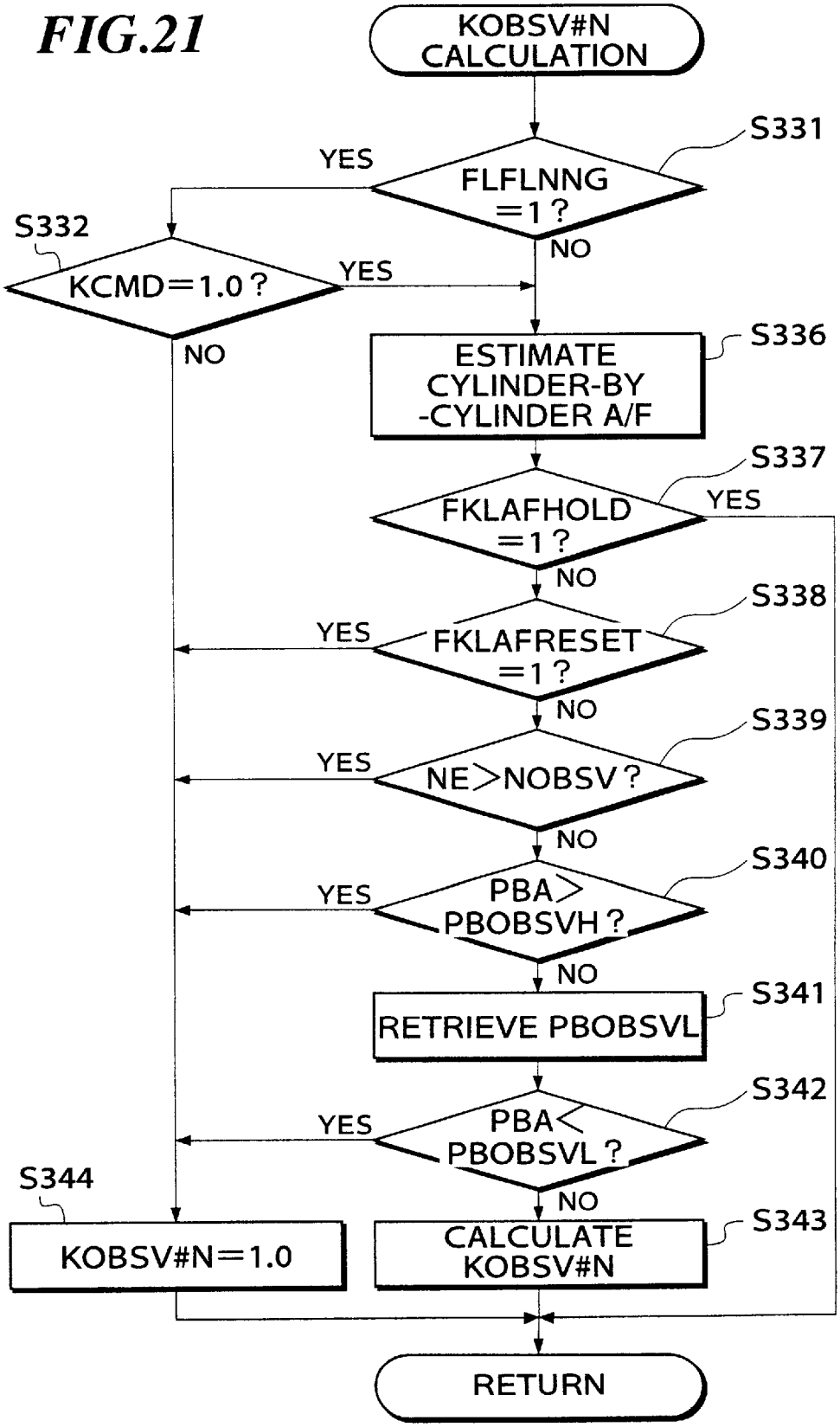
FIG. 21 is a flowchart showing a subroutine for calculating the cylinder-by-cylinder correction coefficient KOBSV#N, which is executed at a step S9 in FIG. 3.

FIG. 21 shows a subroutine for calculating the cylinder-by-cylinder correction coefficient KOBSV#N, which is executed at the step S9 in FIG. 3.

First, at a step S331, it is determined whether or not lean output deterioration of the LAF sensor 17 has been detected, and if the lean output deterioration has not been detected, the program proceeds to a step S336. On the other hand, if the lean output deterioration has been detected, it is determined at a step S332 whether or not the desired equivalent ratio KCMD is equal to 1.0, i.e. whether or not the desired air-fuel ratio assumes the stoichiometric air-fuel ratio. The lean output deterioration of the LAF sensor means such a deterioration of the LAF sensor that the output from the LAF sensor exhibited when the air-fuel ratio of the mixture is actually controlled to a leaner air-fuel ratio than the stoichiometric value deviates from a proper value by an amount larger than a predetermined amount. If KCMD=1.0 holds, the program proceeds to the step S336, whereas if KCMD≠1.0 holds, the cylinder-by-cylinder correction coefficient KOBSV#N for all the cylinders is set to 1.0 at a step S344, which means that the cylinder-by-cylinder feedback control is not executed, followed by terminating the present routine.

At the S336, the cylinder-by-cylinder air-fuel ratio estimation by the observer described above is executed. Then, it is determined at a step S337 whether or not the hold flag FKLAFHOLD assumes "1". If FKLAFHOLD=1 holds, the program is immediately terminated.

Figure 23:
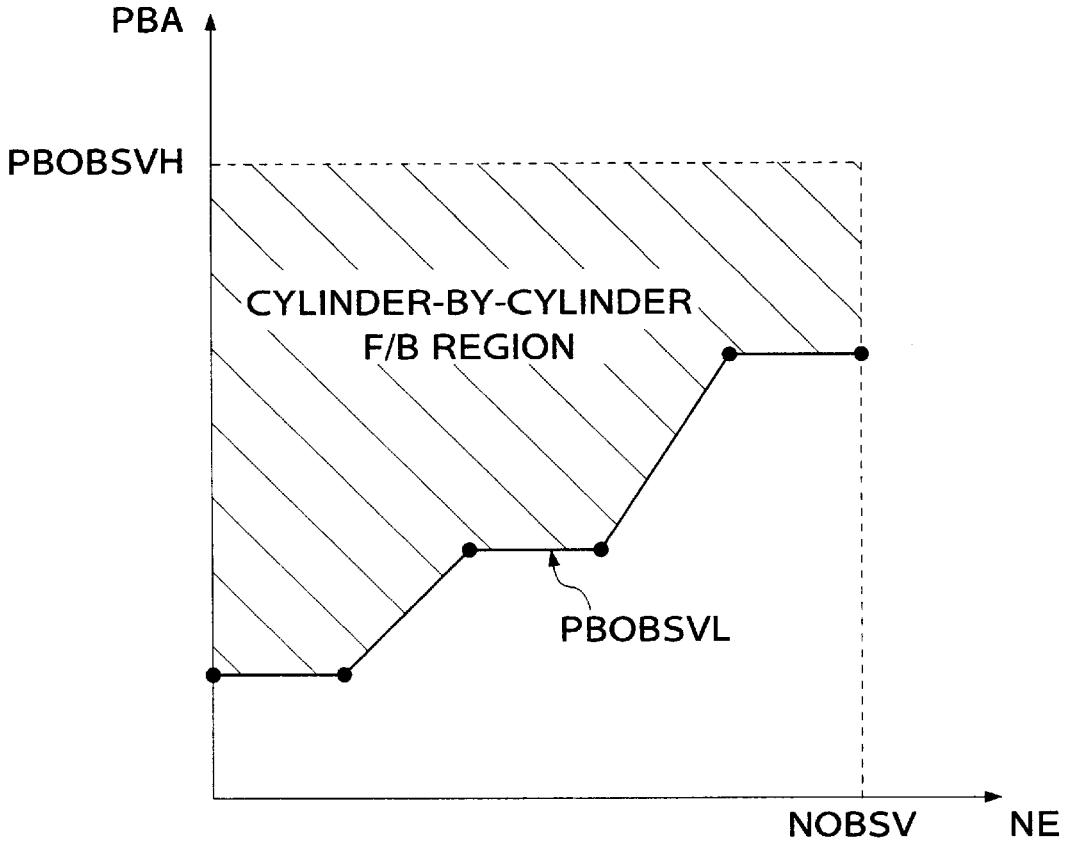
FIG. 23 is a diagram which is useful in explaining a cylinder-by-cylinder feedback control region.

If FKLAFHOLD=0 holds, it is determined at a step S338 whether or not the reset flag FKLAFRESET assumes "1". If FKLAFRESET=0 holds, it is determined at a step S339 whether or not the engine rotational speed NE is higher than a predetermined value NOBSV (e.g. 3500 rpm). If NE≦NOBSV holds, it is determined at a step S340 whether or not the intake pipe absolute pressure PBA is higher than a predetermined upper limit value PBOBSVH (e.g. 650 mmHg). If PBA≦PBOBSVH holds, a PBOBSVL table which is set according to the engine rotational speed NE, as shown in FIG. 23, is retrieved to determine a lower limit value PBOBSVL of the PBA value at a step S341, and then it is determined at a step S342 whether or not the PBA value is lower than the lower limit value PBOBSVL.

If any of the answers to the questions of the steps S338 to S340 and S342 is affirmative (YES), the program proceeds to the step S344, and therefore the cylinder-by-cylinder air-fuel ratio feedback control is not executed. On the other hand, if the answers to the questions of the steps S338 to S340 and S342 are all negative (NO), which means that the engine is in a operating condition corresponding to the shaded region in FIG. 23, it is determined that the cylinder-by-cylinder air-fuel ratio feedback control can be carried out. Therefore, the cylinder-by-cylinder correction coefficient KOBSV#N is calculated in the manner as described above at a step S343, followed by terminating the present program.

Figure 22:
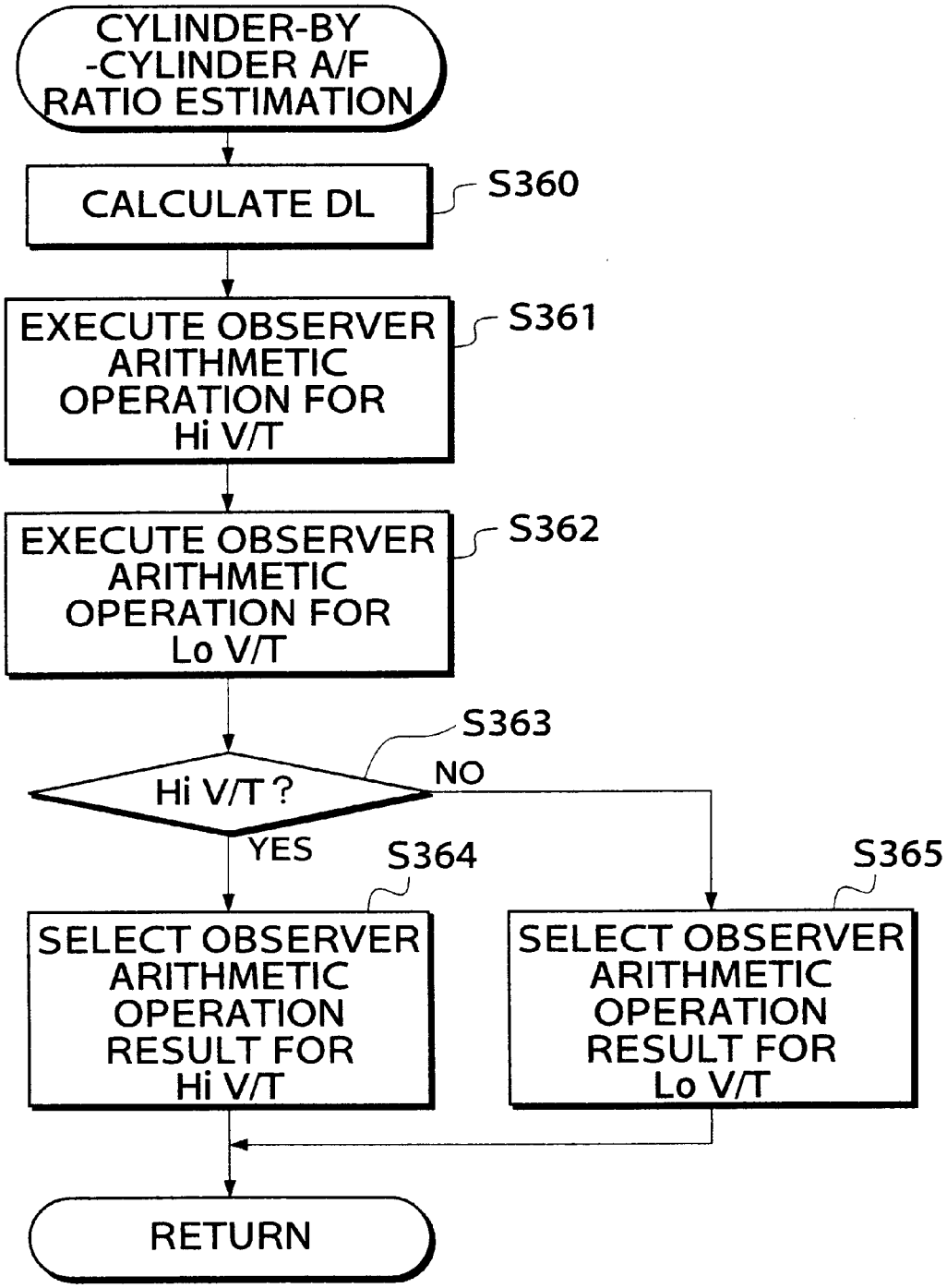
FIG. 22 is a flowchart showing a subroutine for carrying out a cylinder-by-cylinder air-fuel ratio-estimating process, which is executed at a step S336 in FIG. 21.

FIG. 22 shows a subroutine for estimating the cylinder-by-cylinder air-fuel ratio, which is executed at the step S336 in FIG. 21.

First, at a step S360, the time constant DL of response delay of the LAF sensor 17 is determined by retrieving the table shown in FIG. 19 according to the engine rotational speed NE and the intake pipe absolute pressure PBA. Then, at a step S361, an arithmetic operation by the use of the observer (i.e. estimation of the cylinder-by-cylinder air-fuel ratio value) for the high-speed valve timing is carried out, and at the following step S362, an arithmetic operation by the use of the observer for the low-speed valve timing is carried out. Then, it is determined at a step S363 whether or not the present valve timing is set to the high-speed valve timing. If the present valve timing is set to the high-speed valve timing, a result of the observer arithmetic operation for the high-speed valve timing is selected at a step S364, whereas if the present valve timing is set to the low-speed valve timing, a result of the observer arithmetic operation for the low-speed valve timing is selected at a step S365.

The reason why the observer arithmetic operations for the high-speed valve timing and the low-speed valve timing are thus carried out before determining the present valve timing is that the estimation of the cylinder-by-cylinder air-fuel ratio requires several times of arithmetic operations before the estimation results are converged. By the above manner of estimation, it is possible to enhance the accuracy of estimation of the cylinder-by-cylinder air-fuel ratio immediately after changeover of the valve timing.

Next, a subroutine for executing the step S10 in the FIG. 3 main routine to calculate the feedback correction coefficient KFB will be described.

The feedback correction coefficient KFB is set to the PID correction coefficient KLAF or to the adaptive control correction coefficient KSTR depending upon operating conditions of the engine. First, the manners of calculating these correction coefficients will be described with reference to FIGS. 24 to 25.

Figure 24:
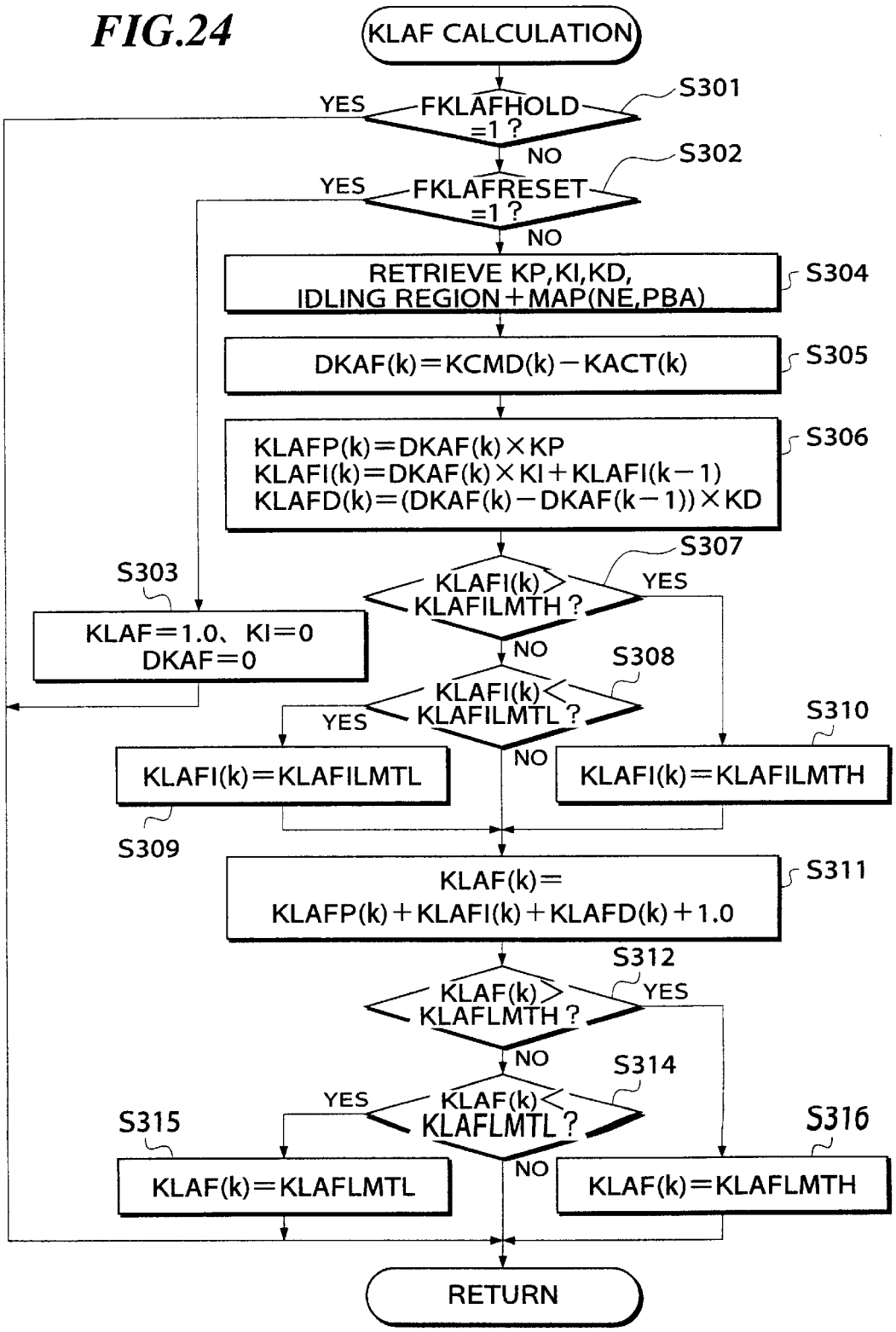
FIG. 24 is a flowchart showing a subroutine for calculating a PID correction coefficient KLAF, which is executed at a step S10 in FIG. 3.

FIG. 24 shows a subroutine for calculating the PID correction coefficient KLAF.

First, at a step S301, it is determined whether or not the hold flag FKLAFHOLD assumes "1". If FKLAFHOLD=1 holds, the present program is immediately terminated, whereas if FKLAFHOLD=0 holds, it is determined at a step S302 whether or not the reset flag FKLAFRESET assumes "1". If FKLAFRESET=1 holds, the program proceeds to a step S303, wherein the PID correction coefficient KLAF is set to "1.0" and at the same time an integral term control gain KI and the difference DKAF between the desired equivalent ratio KCMD and the actual equivalent ratio KACT are both set to "0", followed by terminating the present routine.

If FKLAFRESET=0 holds at the step S302, the program proceeds to a step S304, wherein a proportional term control gain KP, the integral term control gain KI and a differential term control gain KD are retrieved from respective maps according to the engine rotational speed NE and the intake pipe absolute pressure PBA. In this connection, during idling of the engine, gain values for the idling condition are adopted. Then, a difference DKAF(k) (=KCMD(k)−KACT(k)) between the desired equivalent ratio KCMD and the actual equivalent ratio KACT is calculated at a step S305, and the difference DKAF(k) and the gains KP, KI, and KD are applied to the following equations (19) to (21) to calculate a proportional term KLAFP(k), an integral term KLAFI(k), and a differential term KLAFD(k) at a step S306:

$$KLAFP(k)=DKAF(k)\times KP \tag{19}$$

$$KLAFI(k)=DKAF(k)\times KI+KLAFI(k-1) \tag{20}$$

$$KLAFD(k)=(DKAF(k)-DKAF(k-1))\times KD \tag{21}$$

At the following steps S307 to S310, limit-checking of the integral term KLAFI(k) is carried out. More specifically, it is determined whether or not the KLAFI(k) value falls within a range defined by predetermined upper and lower limit values KLAFILMTH and KLAFILMTL at the steps S307 and S308, respectively. If KLAFI(k)>KLAFILMTH holds, the integral term KLAFI(k) is set to the predetermined upper limit value KLAFILMTH at a step S310, whereas if FLAFI(k)<KLAFILMTL holds, the same is set to the predetermined lower limit value KLAFILMTL at the step S309.

At the following step S311, the PID correction coefficient KLAF(k) is calculated by the use of the following equation (22):

$$KLAF(k)=KLAFP(k)+KLAFI(k)+KLAFD(k)+1.0 \tag{22}$$

Then, it is determined at a step S312 whether or not the KLAF(k) value is larger than a predetermined upper limit value KLAFLMTH. If KLAF(k)>KLAFLMTH holds, the PID correction coefficient KLAF is set to the predetermined upper limit value KLAFLMTH at a step S316, followed by terminating the program.

If KLAF(k)≦KLAFLMTH holds at the step S312, it is determined at a step S314 whether or not the KLAF(k) value is smaller than a predetermined lower limit value KLAFLMTL. If KLAF(k)≧KLAFLMTL holds, the present program is immediately terminated, whereas if KLAF(k)<KLAFLMTL holds, the PID correction coefficient KLAF is set to the predetermined lower limit value KLAFLMTL at a step S315, followed by terminating the program.

By the above subroutine, the PID correction coefficient KLAF is calculated by the PID control such that the actual equivalent ratio KACT becomes equal to the desired equivalent ratio KCMD.

Next, description will be made of a calculation of the adaptive control correction coefficient KSTR with reference to FIG. 25.

Figure 25:
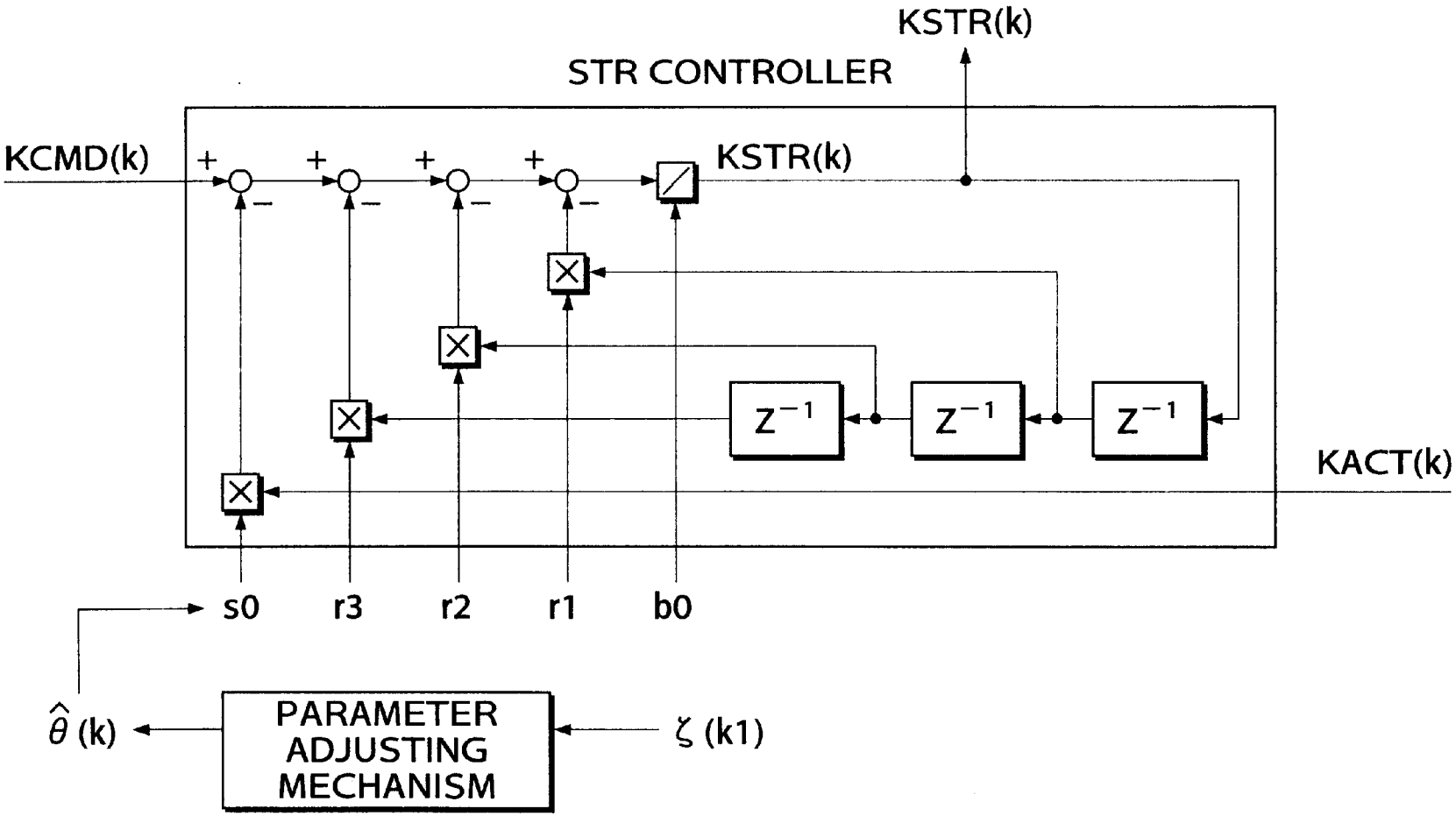
FIG. 25 is a block diagram useful in explaining the manner of calculating an adaptive control correction coefficient KSTR.

FIG. 25 shows the construction of the block B19 in FIG. 2, i.e. the adaptive controller self-tuning regulator (hereinafter referred to as "the STR") block. The STR block is comprised of a STR controller for setting the adaptive control correction coefficient KSTR such that the actual equivalent ratio KACT(k) becomes equal to the desired air-fuel ratio coefficient (desired equivalent ratio) KCMD(k), and a parameter adjusting mechanism for setting parameters to be used by the STR controller.

Adjustment laws (mechanisms) for adaptive control employed in the present embodiment include a parameter adjustment law proposed by Landau et al. According to this law, the stability of the so-called adaptive system is ensured by converting the so-called adaptive system to an equivalent feedback system formed of a linear block and a non-linear block, and setting the parameter adjustment law such that Popov's integral inequality holds in respect of inputting to and outputting from the non-linear block and at the same time the linear block is "strictly positive real". This method is known and described e.g. in "Computrole" No. 27, CORONA PUBLISHING CO., LTD., Japan, pp. 28–41, "Automatic control handbook" OHM, LTD., Japan, pp. 703–707, "A Survey of Model Reference Adaptive Techniques—Theory and Application", I. D. LANDAU "Automatica" Vol. 10, pp. 353–379, 1974, "Unification of Discrete Time Explicit Model Reference Adaptive Control Designs", I. D. LANDAU et al. "Automatica" Vol. 17, No. 4, pp. 593–611, 1981, and "Combining Model Reference Adaptive Controllers and Stochastic Self-tuning Regulators", I. D. LANDAU "Automatica" Vol. 18, No. 1., pp. 77–84, 1982.

In the present embodiment, the above parameter adjustment law proposed by Landau et al. is employed. This parameter adjustment law will be described in detail, hereinbelow: According to this adjustment law, if polynomials of the denominator and numerator of the transfer function $A(Z^{-1})/B(Z^{-1})$ of the object of control by a discrete system are expressed by the following equations (23) and (24), the adaptive parameter $\theta^T(k)$ and the input $\zeta^T(k)$ to the adaptive parameter adjusting mechanism are defined by the following equations (25) and (26). The equations (25) to (26) define an example of a plant in which m=1, n=1 and d=3 hold, i.e. a system of the first order thereof has an ineffective time as long as three control cycles. The symbol k used herein indicates that the parameter with (k) has the present value, one with (k−1) the immediately preceding value, and so forth. u(k) and y(k) in the equation (26) correspond to the KSTR(k) and KACT#N(k) values, respectively, in the present embodiment.

$$A(z^{-1}) = 1 + a_1 z^{-1} + \ldots + a_n z^{-n} \tag{23}$$

$$B(z^{-1}) = b_0 + b_1 z^{-1} + \ldots + b_m z^{-m} \tag{24}$$

$$\begin{aligned}\hat{\theta}^T(k) &= [b_0(k), r_1(k), \ldots r_{m+d-1}(k), S_0(k), \ldots, S_{n-1}(k)] \\ &= [b_0(k), r_1(k), r_2(k), r_3(k), s_0(k)]\end{aligned} \tag{25}$$

$$\begin{aligned}\zeta^T(k) &= [u(k), \ldots, u(k-m-d+1), y(k), \ldots, y(k-n+1)] \\ &= [u(k), u(k-1), u(k-2), u(k-3), y(k)]\end{aligned} \tag{26}$$

The adaptive parameter $\Theta(k)$ is expressed by the following equation (27):

$$\Theta(k) = \Theta(k-1) + \Gamma(k-1)\zeta(k-d)e^*(k) \tag{27}$$

where the symbols Γ(k) and e*(k) represent a gain matrix and an identification error signal, respectively, and can be expressed by the following recurrence formulas (28) and (29):

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k) + \lambda_2(k)\zeta^T(k-d)\Gamma(k-1)\zeta(k-d)}\right] \tag{28}$$

$$e^*(k) = \frac{D(z^{-1})y(k) - \hat{\theta}^T(k-1)\zeta(k-d)}{1 + \zeta^T(k-d)\Gamma(k-1)\zeta(k-d)} \tag{29}$$

Further, it is possible to provide various specific algorithms depending upon set values of λ1(k) and λ2(k). For example, if λ1(k)=1 and λ2(k)=λ(0<λ1<2) hold, a progressively decreasing gain algorithm is provided (if λ=1, the least square method), if λ1(k)=λ1 (0<λ1<1) and λ2(k)=λ2 (0<λ2<2) hold, a variable gain algorithm (if λ2=1, the method of weighted least squares), and if λ1(k)/λ2(k)=σ and if λ3 is expressed by the following equation (30), λ1(k)=λ3 provides a fixed trace algorithm. Further, if λ1(k)=1 and λ2(k)=0 hold, a fixed gain algorithm is obtained. In this case, as is clear from the equation (28), Γ(k)=Γ(k−1), and hence Γ(k)=Γ(fixed value) is obtained.

$$\lambda_3(k) = 1 - \frac{\|\Gamma(k-1)\zeta(k-d)\|^2}{\sigma + \zeta^T(k-d)\Gamma(k-1)\zeta(k-d)} \cdot \frac{1}{tr\Gamma(0)} \tag{30}$$

In the example of FIG. 25, the STR controller (adaptive controller) and the adaptive parameter adjusting mechanism are arranged outside the fuel injection amount-calculating system, and operate to calculate the feedback correction coefficient KSTR(k) such that the actual equivalent ratio KACT(k) becomes equal to the desired equivalent ratio KCMD(k−d') (d' represents an ineffective time period before the KCMD value reflects on the actual equivalent ratio KACT) in an adaptive manner.

In this manner, the adaptive control correction coefficient KSTR(k) and the actual equivalent ratio KACT#N(k) are determined, which are input to the adaptive parameter-adjusting mechanism, where the adaptive parameter (k) is calculated to be input to the STR controller. The STR controller is also supplied with the desired equivalent ratio KCMD(k) and calculates the adaptive control correction coefficient KSTR(k) such that the actual equivalent ratio KACT(k) becomes equal to the desired equivalent ratio KCMD(k), by the use of the following recurrence formula (31):

$$KSTR(k) = \frac{KCMD(k-d') - s_0 \times KACT(k) - r_1 \times KSTR(k-1) - r_2 \times KSTR(k-2) - r_3 \times KSTR(k-3)}{b_0} \tag{31}$$

Next, the manner of calculation of the feedback correction coefficient KFB by switching between the PID correction coefficient KLAF and the adaptive control correction coefficient KSTR, i.e. by switching between the PID control and the adaptive control.

Figure 26:
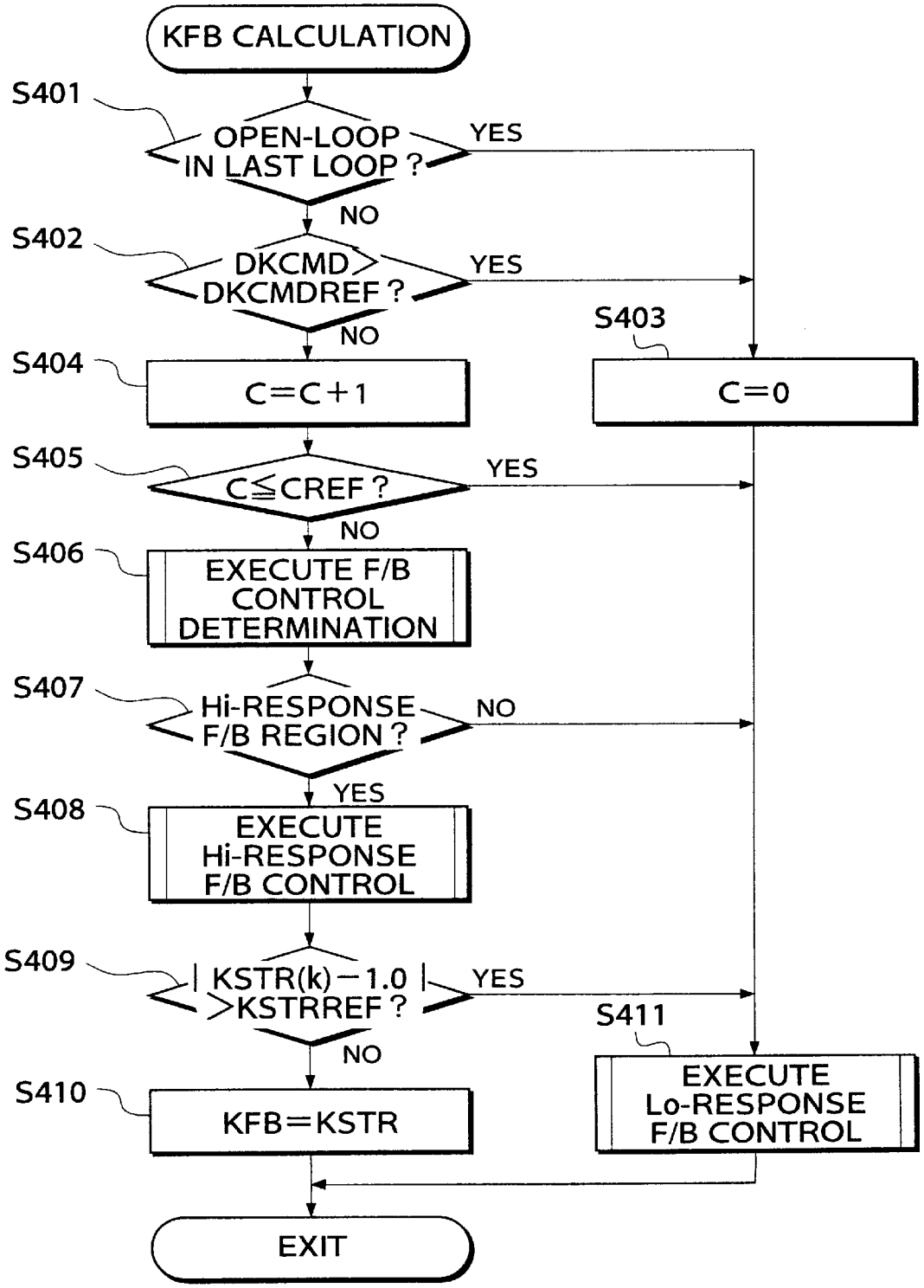
FIG. 26 is a flowchart showing a subroutine for calculating the feedback correction coefficient KFB, which is executed at the step S10 in FIG. 3.

FIG. 26 shows a subroutine for calculating the feedback correction coefficient KFB, which is executed at the step S10 in FIG. 3.

First, it is determined at a step S401 whether or not the control mode was an open-loop control mode in the last loop of execution of the FIG. 3 routine, i.e. whether or not FKLAFRESET=1 held. If the control mode was not the open-loop control mode, it is determined at a step S402 whether or not a rate of variation DKCMD in the desired equivalent ratio KCMD (=|KCMD(k)−KCMD(k−1)|) is larger than a reference value DKCMDREF. If the control mode was the open-loop control mode in the last loop of execution of the FIG. 3 routine, or if the control mode was the feedback control mode in the last loop of execution of the FIG. 3 routine and at the same time the rate of variation DKCMD is larger than the reference value DKCMDREF, it is judged that the engine is in a region where a low-response feedback control should be executed (hereinafter referred to as "the low-response F/B region"). Then, a counter C is reset to "0" at a step S403, followed by the program proceeding to a step S411. At the step S411, the low-response F/B control is executed, which will be described hereinafter with reference to FIG. 30, followed by terminating the program.

As noted above, the engine is determined to be in the low-response F/B region when the engine was in the open-loop region in the last loop because an air-fuel ratio value indicated by the LAF sensor output does not necessarily show a true or exact value of the air-fuel ratio due to a delay of detection by the LAF sensor, which will occur e.g. when the fuel supply is resumed after fuel cut, so that the air-fuel ratio feedback control can be unstable. For a similar reason, when the amount of change DKCMD in the desired equivalent ratio KCMD is large, which will occur e.g. when a WOT enriching operation is stopped to resume the normal air-fuel control, or when the air-fuel ratio control is switched over from the lean-burn control to the feedback control to the stoichiometric air-fuel ratio, the engine is determined to be in the low-response F/B region.

If the answers to the questions of the steps S401 and S402 are both negative (NO), i.e. if the control mode was the feedback control mode in the last loop and at the same time the rate of variation DKCMD in the desired equivalent ratio KCMD is equal to or smaller than the reference value DKCMDREF, the count of the counter C is incremented by "1" at a step S404, and then the count of the counter C is compared with a predetermined value CREF (e.g. 5) at a step S405. If C≦CREF holds, the program proceeds to the step S411, whereas if C>CREF holds, the program proceeds to a step S406, wherein it is determined by executing a subroutine, described hereinafter, whether the engine is operating in a region in which a high-response feedback control should be executed (hereinafter referred to as "high-response F/B region") or in the low-response F/B region. Then, at a step S407, it is determined whether or not the control region in which the engine has been determined to be operating at the step S406 is the high-response F/B region. If the determined control region is not the high-response F/B region, the program proceeds to the step S411, whereas if the control region is the high-response F/B region, the program proceeds to a step S408, wherein a subroutine for the high-response feedback control, described hereinafter, is executed to calculate the adaptive control correction coefficient KSTR. Then, it is determined at a step S409 whether or not the absolute value of the difference |KSTR(k)−1.0| between the adaptive control correction coefficient KSTR and 1.0 is larger than a predetermined reference value KSTRREF. If |KSTR(k)−1.0|>KSTRREF holds, the program proceeds to the step S411, whereas if |KSTR (k)−1.0|≦KSTRREF holds, the feedback correction coefficient KFB is set to the KSTR value at a step S410, followed by terminating the program.

When the absolute value of the difference between the adaptive control correction coefficient KSTR and 1.0 is larger than the predetermined reference value KSTRREF, the low-response feedback control is thus selected for the purpose of achieving stability of the control.

When the count of the counter C is smaller than the reference value CREF, the low-response feedback control is thus selected because immediately after returning of the engine operating condition from the open-loop control or immediately after a large variation in the desired equivalent ratio KCMD, a time lag before completion of the fuel combustion and a response lag of the LAF sensor are so large that influences thereof cannot be compensated for by the adaptive control.

Figure 27:
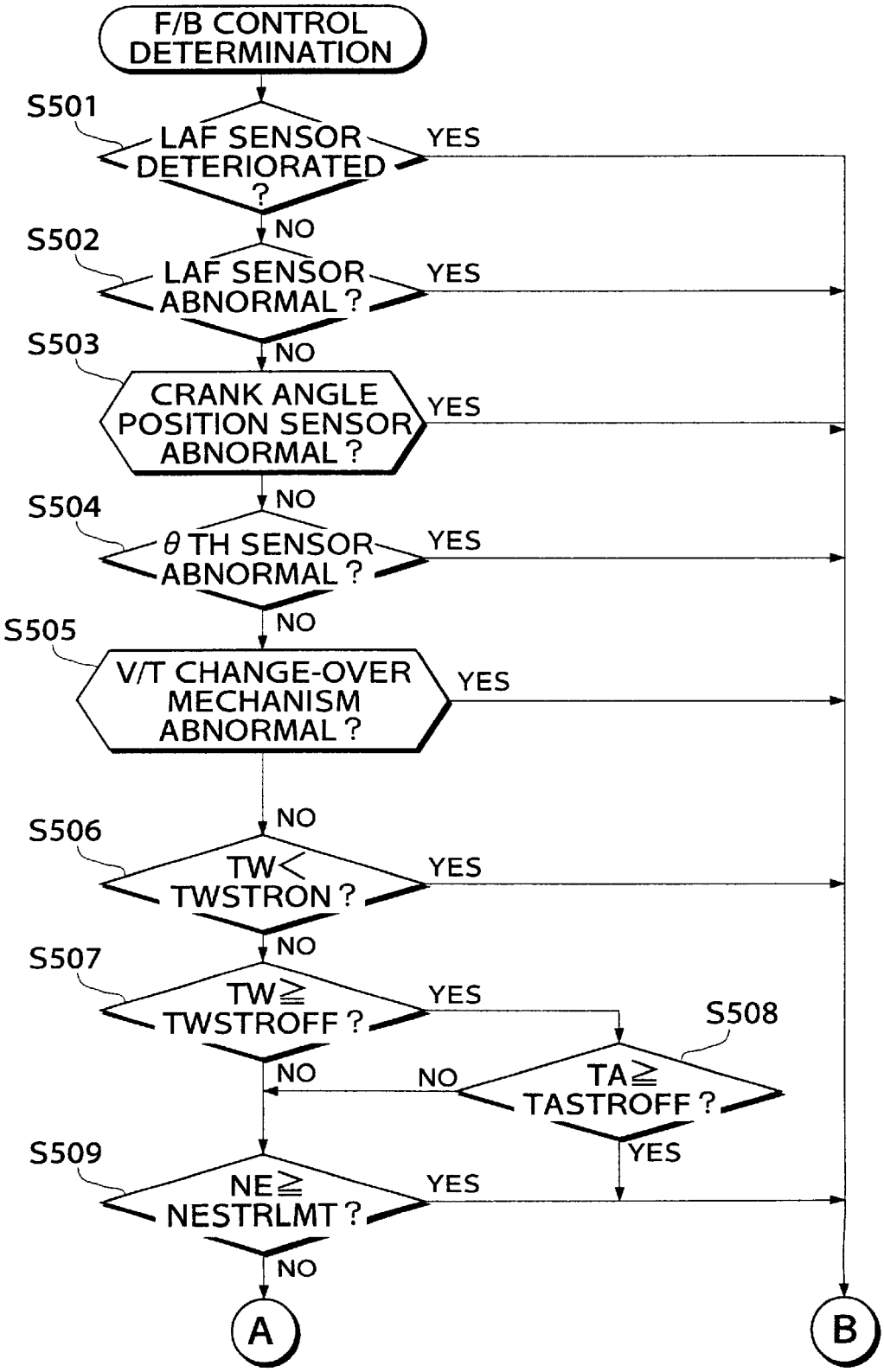
FIG. 27 is a flowchart showing a subroutine for selecting responsiveness of the air-fuel ratio feedback control, which is executed at a step S406 in FIG. 26.
Figure 28:
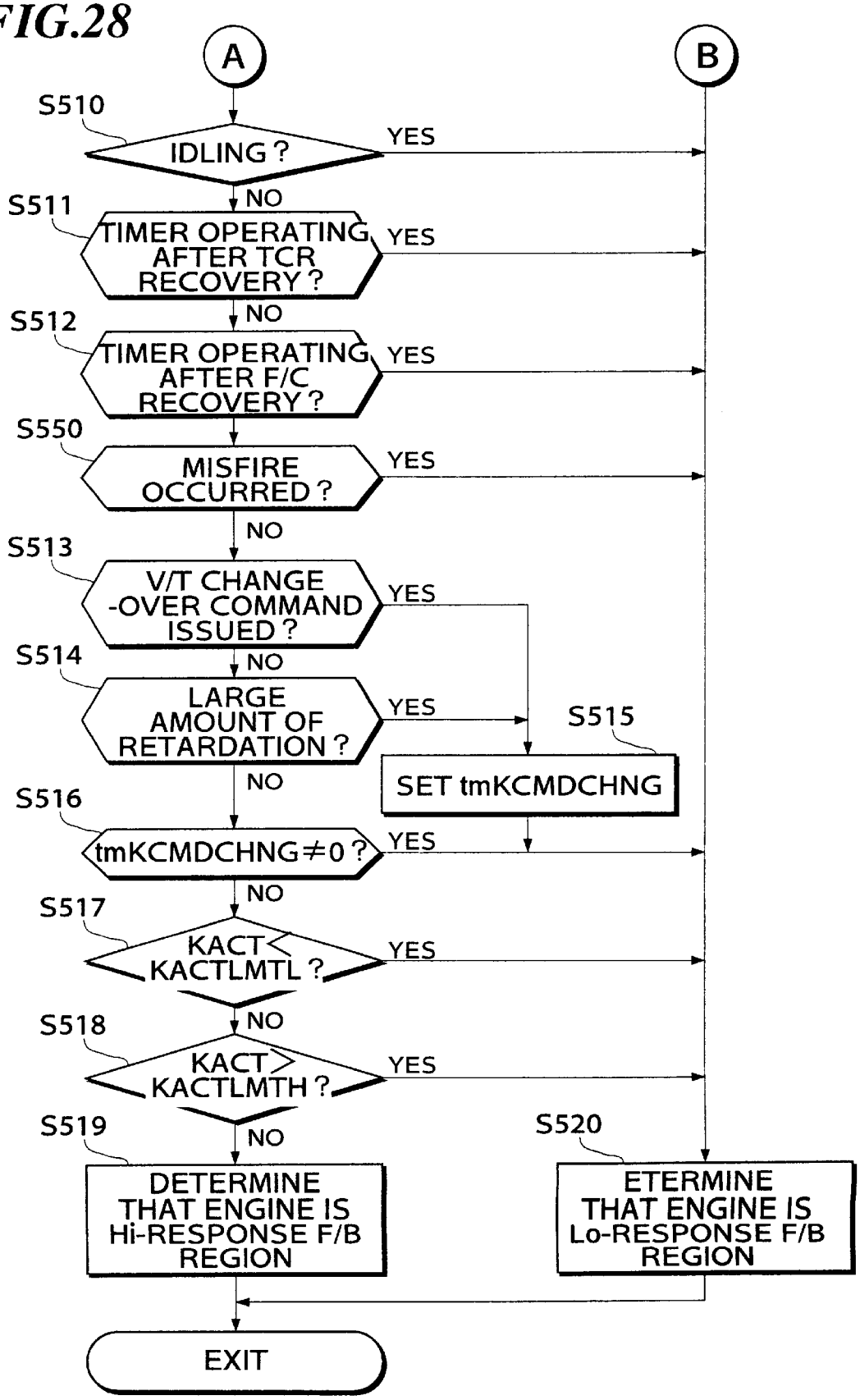
FIG. 28 is a continued part of the flowchart of the FIG. 26 subroutine.

Next, the subroutine executed at the step S406 in FIG. 26 for selecting the response speed of the air-fuel ratio feedback control, i.e. determining whether the engine is operating in the high-response F/B region or in the low-response F/B region will be described with reference to FIGS. 27 and 28.

First, at a step S501, it is determined whether or not the LAF sensor 17 is deteriorated in response characteristic. If the LAF sensor 17 is not deteriorated in response characteristic, the program proceeds to a step S502.

At the step S502, it is determined whether or not abnormality of the LAF sensor 17 has been detected. If no abnormality of the LAF sensor 17 has been detected, it is determined at a step S503 whether or not abnormality of the crank angle sensor 14 (cylinder-discriminating sensor, TDC sensor, CRK sensor) has been detected. If no abnormality of the crank angle sensor has been detected, it is determined at a step S504 whether or not abnormality of the throttle valve opening θTH sensor 4 has been detected. If no abnormality of the throttle valve opening sensor 4 has been detected, it is determined at a step S505 whether or not abnormality of the valve timing changeover mechanism 60 has been detected.

If all the answers to the questions of the steps S501 to S505 are negative (NO), the program proceeds to a step S506, whereas if any of the answers is affirmative (YES), it is determined at a step S520 that the engine is in the low-response F/B region, followed by terminating the program.

The low-response feedback control is thus selected when any of the above-mentioned sensors is abnormal, so as to prevent degradation of the controllability of the air-fuel ratio.

Then, at the step S506, it is determined whether or not the engine coolant temperature TW is lower than a predetermined value TWSTRON. If TW≧TWSTRON holds, it is determined at a step S507 whether or not the engine coolant temperature TW is equal to or higher than a predetermined value TWSTROFF (e.g. 100° C.). If TW≧TWSTROFF holds, it is determined at a step S508 whether or not the intake air temperature TA is equal to or higher than a predetermined value TASTROFF. If TW≧TWSTROFF holds at the step S507 or if TW≧TWSTROFF holds at the step S507 and at the same time TA<TASTROFF holds at the step S508, the program proceeds to a step S509, wherein it is determined whether or not the engine rotational speed NE is equal to or higher than a predetermined value NESTRLMT. If NE<NESTRLMT holds, it is determined at a step S510 whether or not the engine is idling. If the engine is not idling, it is determined at a step S511 whether or not a timer is in operation for measuring a time period elapsed after termination of traction control by the traction control system (TCS). This timer is formed by a down-counting timer, and set during TCS operation and started when the TCS operation is terminated.

If the timer is not in operation at the step S511, it is determined at a step S512 whether or not a timer is in operation for measuring a time period elapsed after termination of fuel cut. The fuel cut is carried out when the engine is in a predetermined decelerating condition, and the fuel cut flag FFC is set to "1" during the fuel cut operation. This timer is also formed by a down-counting timer, and set during the fuel cut operation and started upon termination of fuel cut.

If any of the answers to the questions of the steps S506 and S509 to S512 is affirmative (YES), or if both the answers to the questions of the steps S507 and S508 are affirmative (YES), it is determined at the step S520 that the engine is in the low-response F/B region, followed by terminating the program. If the answer to the question of the step S512 is negative (NO), the program proceeds to a step S550.

At the step S550, it is determined whether or not a misfire has occurred in the engine. A misfire can be determined to have occurred in the engine when the variation of the engine rotational speed NE is above a predetermined value, as disclosed in Japanese Laid-Open Patent Publication (Kokai) No. 6-146998 filed by the present assignee. When the engine suffers from a misfire, the program proceeds to the step S520, whereas when the engine does not suffer from a misfire, the program proceeds to a step S513.

At the step S513, it is determined whether or not changeover of the valve timing between the high-speed V/T and the low-speed V/T has been instructed. If the changeover has not been instructed, it is determined at a step S514 whether or not the ignition timing of the engine has been largely retarded. If the ignition timing has not been largely retarded, the program proceeds to a step S516. If either the answer to the question of the step S513 or the answer to the question of the step S514 is affirmative (YES), a down-counting timer tmKCMDCHNG is set to a predetermined time period TCHNG and started at a step S515, followed by the program proceeding to the step S520. The predetermined time period TCHNG is set to a time period sufficient for the combustion of the engine to become stable after the changeover of the valve timing has been instructed or after the ignition timing has been largely retarded.

At the step S516, it is determined whether or not the count of the down-counting timer tmKCMDCHNG is not equal to "0". If the count is not equal to "0", the program proceeds to the step S520, whereas if the count is equal to "0", it is determined at steps S517 and S518 whether or not the actual equivalent ratio KACT is within a predetermined range defined by a predetermined lower limit value KACTLMTL (e.g. 0.99) and a predetermined upper limit value KACTLMTH (e.g. 1.01). If KACT<KACTLMTL or KACT>KACTLMTH holds, the program proceeds to the step S520, whereas if KACTLMTL≦KACT≦KACTLMTH holds, the program proceeds to a step S519, wherein it is determined that the engine is in the high-response F/B region, followed by terminating the program.

By executing the steps S517 and S518, changeover of the feedback control from the low-response feedback control to the high-response feedback control is carried out only when the actual equivalent ratio KACT is equal to 1.0 or a value close thereto, to thereby achieve smooth changeover of the feedback control mode and hence ensure required stability of the fuel-ratio control. The reason why it is thus determined by the steps S506 to S516 that the low-response feedback control should be executed is as follows:

When the engine coolant temperature TW is low (TW<TWSTRON), the engine combustion is not stable due to insufficient atomization of fuel and increased friction between the piston and the cylinder, so that a misfire can occur. Therefore, a stable value of the detected equivalent ratio KACT cannot be obtained if the high-response feedback control is carried out in such a condition. Also when the engine coolant temperature TW is extremely high (TW≧TWSTROFF) and at the same time the intake air temperature is extremely high (TA≧TASTROFF), vapor lock can occur in the fuel supply line to decrease the actual amount of fuel injection. When the engine rotational speed NE is high, i.e. if NE≧NESTRLMT holds, the ECU 5 can have an insufficient calculation time and further the engine combustion is not stable.

Further, when the engine is idling, the engine operating condition is almost stable such that the high-response feedback control, which has a high gain, is not required to be carried out. Immediately after termination of the traction control in which the ignition timing is temporarily largely retarded or fuel cut is effected to decrease the torque of the engine so as to avoid excessive slippage of the wheels, the engine combustion is not stable before a predetermined time period elapses after the termination of the traction control, so that execution of the high-response feedback control can unexpectedly result in an increase in the variation of the air-fuel ratio. For a similar reason, immediately after termination of a usual decelerating fuel cut operation, the low-response feedback control is selected. Similarly, when a misfire occurs in the engine, the engine combustion is undoubtedly unstable, so that the low-response feedback control is selected. Further, before a predetermined time period (TCHNG) elapses after changeover of the valve timing, the combustion state of the engine drastically changes due to a change in the valve opening period over which the intake or exhaust valves are opened. Also, before the predetermined time period TCHNG elapses after termination of control of ignition timing to a largely retarded timing, the engine combustion is not stable, and hence a stable KACT value cannot be expected.

In addition to the traction control, large retardation of the ignition timing may be carried out in execution of other kinds of control such as torque shock-reducing control executed when the automatic transmission undergoes a change in the shift gear position, knocking-avoiding control executed when load on the engine is high, ignition timing control executed for the purpose of accelerating the rise of the temperature of the catalysts immediately after the engine is started, or on like occasions.

Next, the high-response/low-response feedback control executed by the control system according to the present embodiment will be described.

Figure 29:
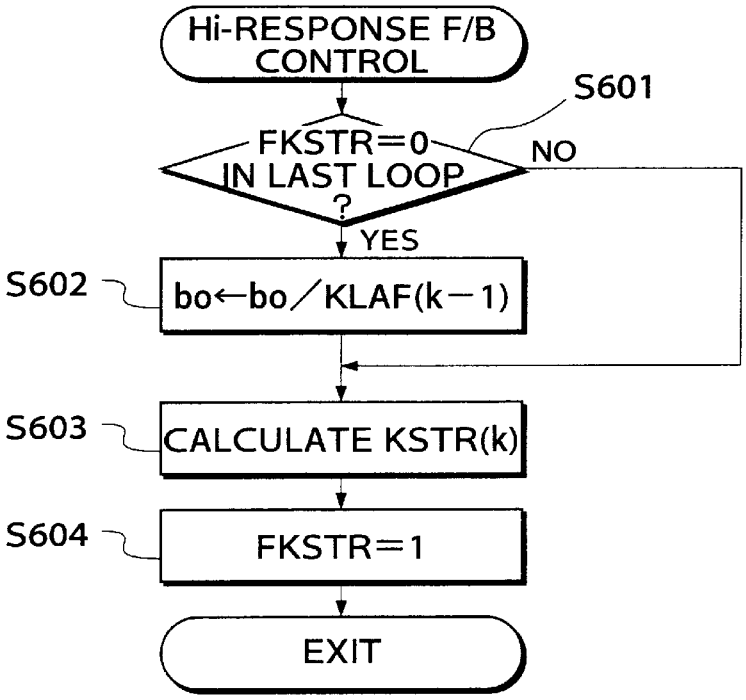
FIG. 29 is a flowchart showing a subroutine for carrying out a high-response air-fuel ratio feedback control, which is executed at a step S519 in FIG. 28.

FIG. 29 shows a subroutine for carrying out the high-response feedback control executed at the step S408 in FIG. 26. First, at a step S601, it is determined whether or not a flag FKSTR, which, when set to "1", indicates that the engine is operating in a region in which the feedback control by the use of the adaptive control correction coefficient KSTR should be executed (hereinafter referred to as "the adaptive control region"), assumed "0" in the immediately preceding loop. If the flag KSTR assumed "1" in the last loop, the program jumps to a step S603, wherein the adaptive control correction coefficient KSTR is calculated in the manner described hereinbefore, and then the flag FKSTR is set to "1" at a step S604, followed by terminating the program.

On the other hand, if the flag FKSTR assumed "0" in the last loop, the adaptive parameter b0 (scalar quantity determining the gain) is replaced by a value obtained by dividing the b0 value by the last value KLAF(k−1) of the PID correction coefficient KLAF at a step S602, followed by the program proceeding to the step S603.

By replacing the adaptive parameter b0 by the value b0/KLAF(k−1) at the step S602, further smooth changeover from the PID control to the adaptive control can be obtained to thereby ensure required stability of the control. The reason for carrying out the replacement is as follows: If the value b0 in the equation (31) is replaced by the value b0/KLAF(k−1), the following equation (32) is obtained, where the first term of the first equation is equal to "1" because the adaptive control correction coefficient KSTR is set to and held at 1 (KSTR(k)=1) during execution of the PID control. Accordingly, the value KSTR(k) at the start of the adaptive control becomes equal to the value KLAF(k−1), resulting in smooth changeover of the correction coefficients:

$$KSTR(k) = [\{KCMD(k-4\times d') - s_0 \times KACT(k) - r_1 \times KSTR(k-4) - r_2 \times KSTR(k-8) - r_3 \times KSTR(k-12)\}/b_0] \times KLAF(k-1) = 1 \times KLAF(k-1) = KLAF(k-1) \quad (32)$$

Figure 30:
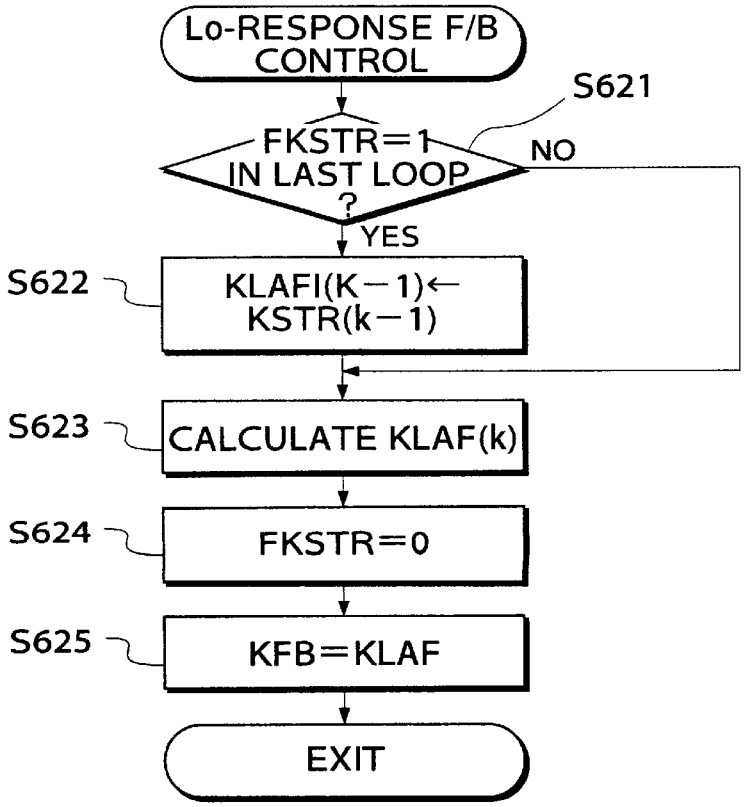
FIG. 30 is a flowchart showing a subroutine for carrying out a low-response air-fuel ratio feedback control, which is executed at a step S520 in FIG. 28.

FIG. 30 shows a subroutine for carrying out the low-response feedback control executed at the step S411 of the FIG. 26 subroutine. First, at a step S621, it is determined whether or not the STR flag FKSTR assumed "1" in the last loop. If FKSTR=0 held in the last loop, the program jumps to a step S623, wherein the PID correction coefficient KLAF is calculated by executing the FIG. 24 subroutine. Then, the flag FKSTR is set to "0" at a step S624, and the program proceeds to a step S625, wherein the feedback correction coefficient KFB is set to the PID correction coefficient KLAF(k) calculated at the step S623, followed by terminating the present program. on the other hand, if FKSTR=1 held in the last loop, the immediately preceding value KLAFI (k−1) of the integral term of the PID control is set to the immediately preceding value KSTR(k−1) of the adaptive control correction coefficient KSTR at a step S622, followed by the program proceeding to the step S623.

When changeover from the adaptive control to the PID control is carried out (if FKSTR=1 held in the immediately preceding loop and the engine is in the low-response F/B region in the present loop), there is a possibility of a drastic change in the integral term KLAFI of the PID control. Therefore, the step S622 is executed to set KLAF(k−1)= KSTR(k−1). This can reduce the difference between the adaptive control correction coefficient KSTR(k−1) and the PID correction coefficient KLAF(k), whereby smooth changeover from the adaptive control to the PID control can be carried out, to thereby ensure required stability of the engine control.

By virtue of the operations carried out by the FIGS. 26 to 30 subroutines, so long as the engine combustion is not in a steady condition, the air-fuel ratio feedback control is changed over from the adaptive control to the PID control, whereby sufficient accuracy and stability of the air-fuel ratio control can be ensured even when the engine is not in a steady operating condition, to thereby maintain excellent driveability and exhaust emission characteristics of the engine.

Next, description will be made of a second embodiment of the invention. In the first embodiment described above, when the LAF sensor 17 is in the intermediate state, the LAF sensor output is corrected (the sampling timing CSEL and the VLAF-KACT conversion characteristic are corrected). In the present embodiment, however, in place of or together with the correction of the sampling timing CSEL and the VLAF-KACT conversion characteristic, the desired air-fuel ratio coefficient KCMD is corrected according to the internal resistance Ri. Except for this, the second embodiment is identical with the first embodiment.

Figure 31:
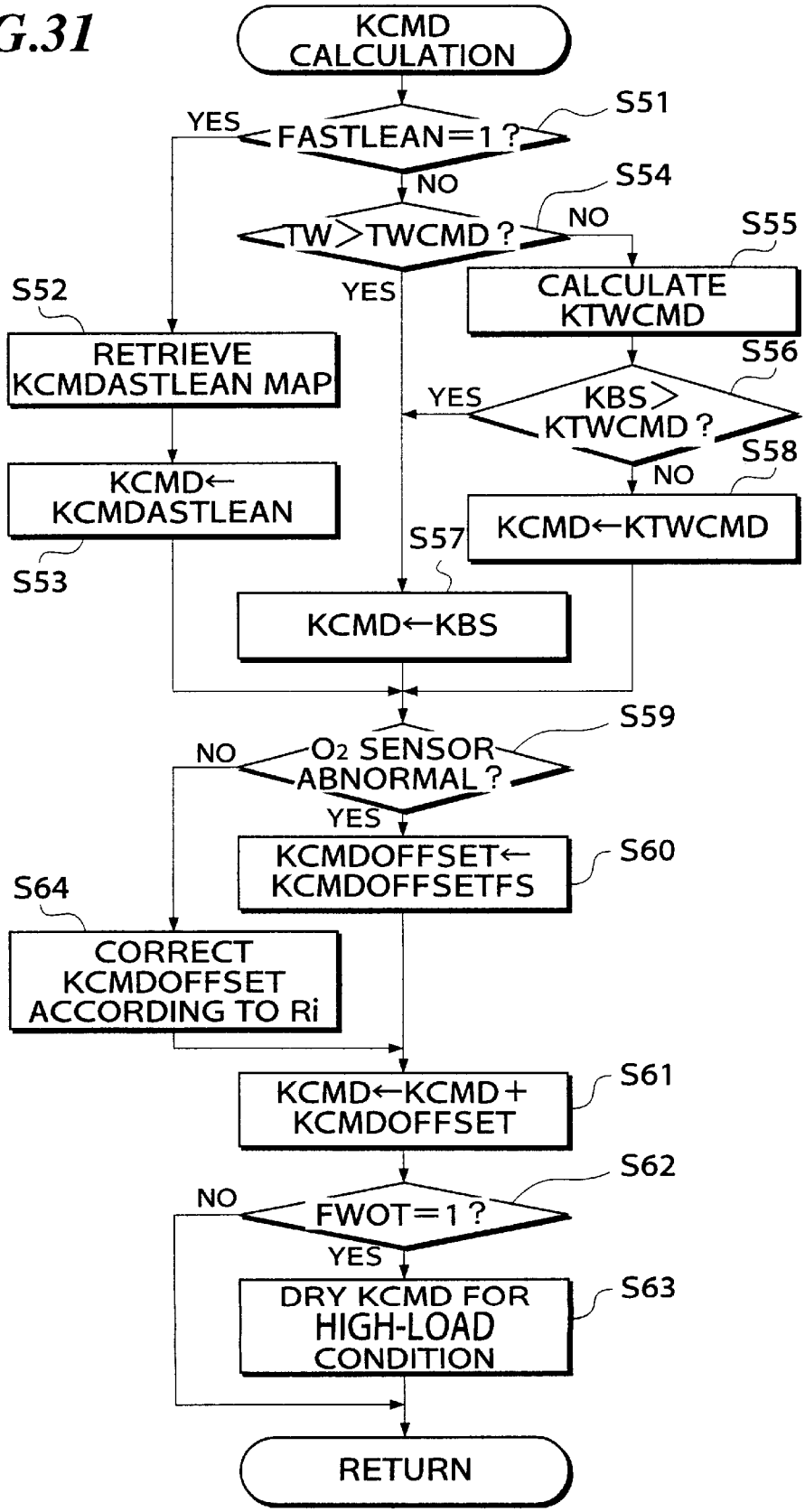
FIG. 31 is a flowchart showing a subroutine for calculating the desired air-fuel ratio coefficient KCMD, according to a second embodiment of the invention, which corresponds to FIG. 5 in the first embodiment.

FIG. 31 shows a program for calculating the KCMD value, according to the second embodiment, which corresponds to the FIG. 5 program in the first embodiment. The FIG. 31 program is different from the FIG. 5 program in that a step S64 is added to the steps of the FIG. 5 program. The other steps are identical with those in the FIG. 5 program, description of which is omitted.

At the step S64 in FIG. 31, the addend correction term KCMDOFFSET is corrected according to the Ri value.

Figure 32:
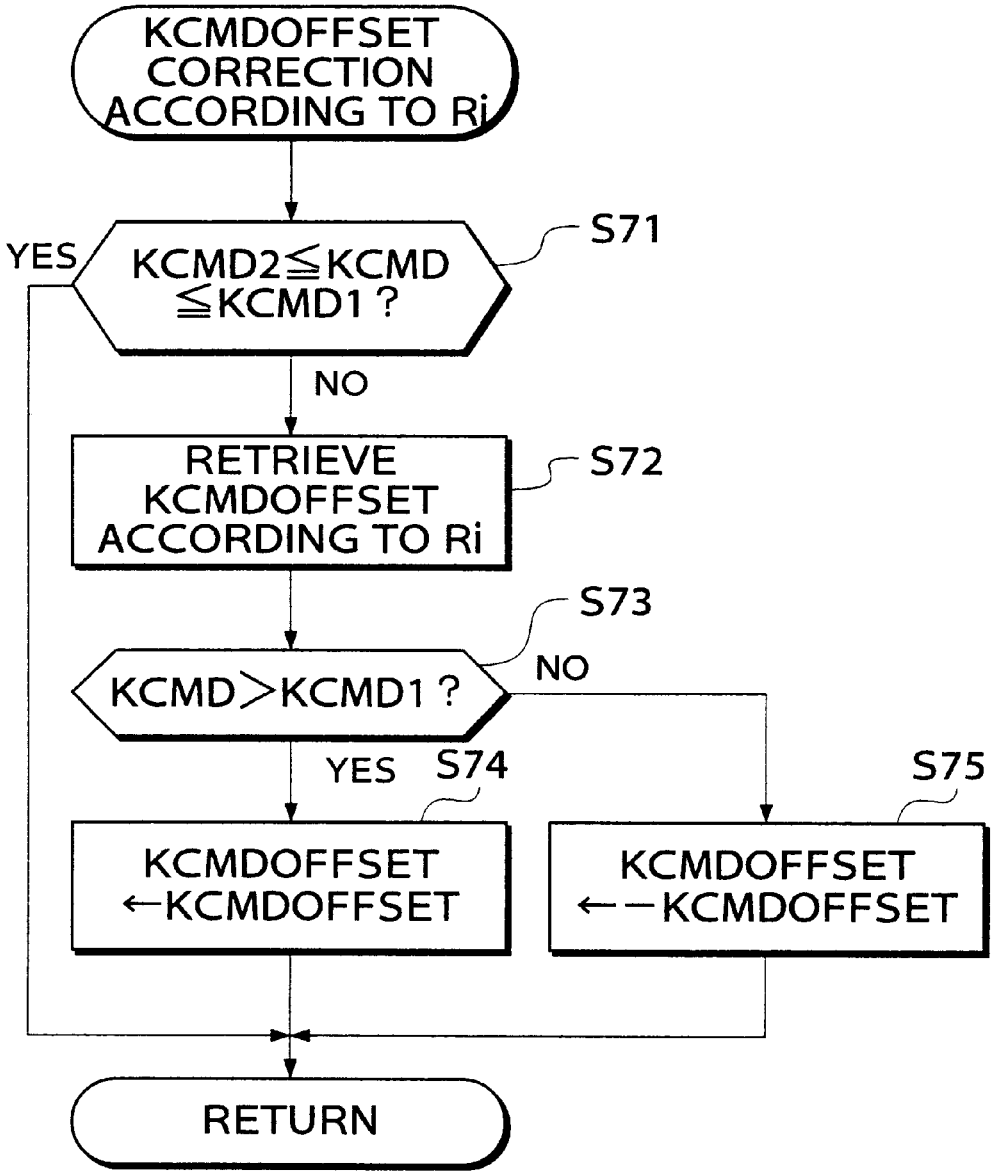
FIG. 32 is a flowchart showing a subroutine for correcting an addend correction term KCMDOFFSET, which is executed at a step S64 in FIG. 31.

FIG. 32 shows a subroutine for correcting the KCMD-OFFSET value according to the Ri value. First, at a step S71, it is determined whether or not the calculated desired air-fuel ratio coefficient KCMD falls within a range between predetermined values KCMD2 and KCMD1. The KCMD2 value is slightly leaner than the stoichiometric air-fuel ratio, while the KCMD1 value is slightly richer than the stoichiometric air-fuel ratio. If KCMD2≦KCMD≦KCMD1 holds, the program is immediately terminated without carrying out the KCMD correction according to the Ri value.

Figure 33:
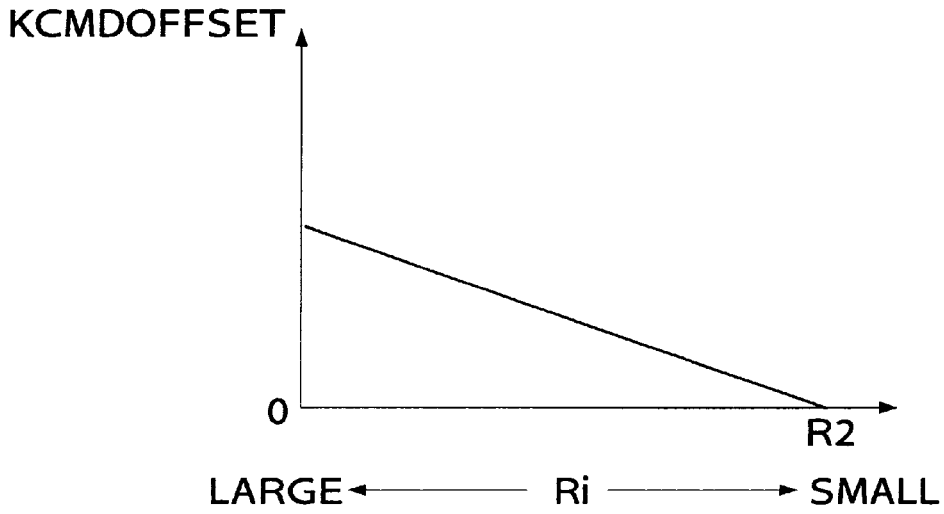
FIG. 33 shows a table for determining the KCMDOFFSET value.

On the other hand, if the answer to the question of the step S71 is negative (NO), i.e. if KCMD>KCMD1 or KCMD<KCMD2 holds, a KCMDOFFSET table shown in FIG. 33 is retrieved according to the internal resistance Ri, to thereby determine the addend correction term KCMD-OFFSET at a step S72. Then, it is determined at a step S73 whether or not the KCMD value is larger than the rich side predetermined value KCMD1, and if KCMD>KCMD1 holds, the KCMDOFFSET value determined at the step S72 is set as it is at a step S74. On the other hand, if KCMD≦KCMD1 holds, i.e. if KCMD<KCMD2 holds, the KCMDOFFSET value is set to a negative value which has the same absolute value as the value determined at the step S72, at a step S75, followed by terminating the present routine.

In this manner, by setting the addend correction term KCMDOFFSET, when the desired air-fuel ratio coefficient KCMD is richer than the stoichiometric air-fuel ratio, the KCMD value is corrected to a richer value, while the same is leaner than the stoichiometric air-fuel ratio, it is corrected to a leaner value. As a result, good air-fuel ratio feedback control performance can be achieved even when the LAF sensor 17 is in the intermediate state.

Next, a third embodiment of the invention will be described with reference to FIGS. 34 and 35. In the first embodiment, when the LAF sensor 17 is in the intermediate state, the LAF sensor output is corrected (the sampling timing CSEL and the VLAF-KACT conversion characteristic are corrected). In the present embodiment, however, in place of or together with the correction of the sampling timing CSEL and the VLAF-KACT conversion characteristic, the time constant DL of response delay of the LAF sensor is corrected. Except for this, the third embodiment is identical with the first embodiment.

Figure 34:
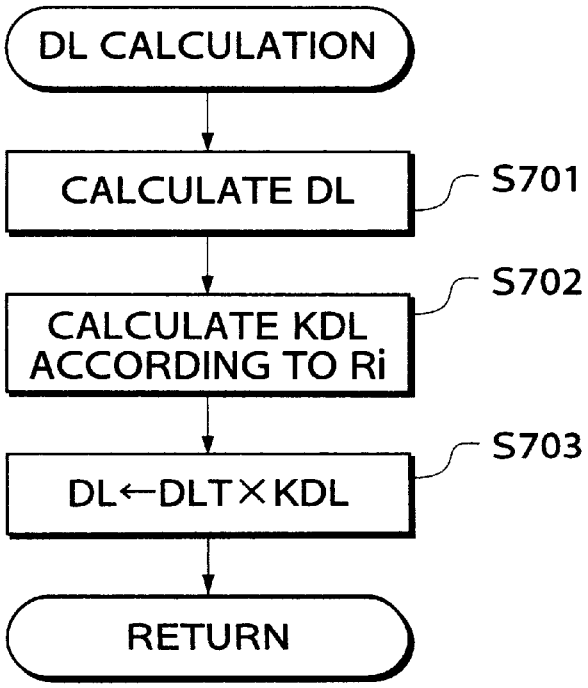
FIG. 34 is a flowchart showing a subroutine for determining the response delay time constant DL for the LAF sensor 17, which is executed at a step S360 in FIG. 22, according to a third embodiment of the invention.
Figure 35:
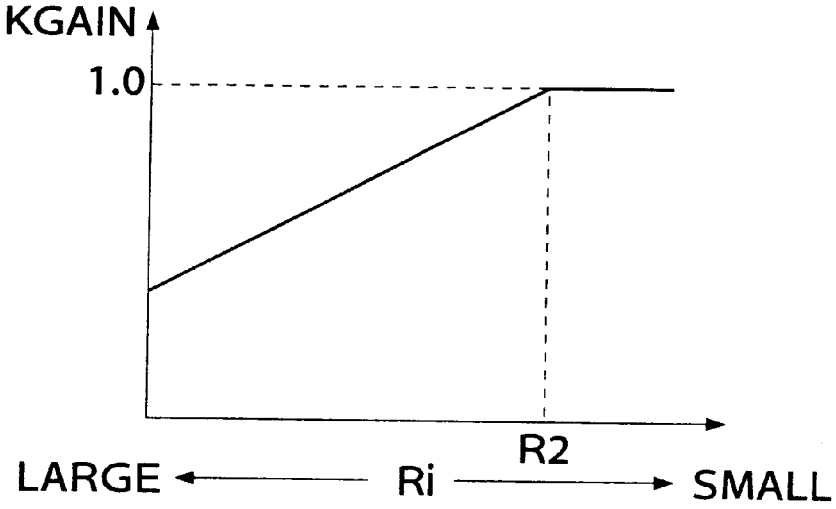
FIG. 35 shows a table for determining a table value KDL of the DL value which is used in the FIG. 34 subroutine.

FIG. 34 shows a subroutine for carrying out a DL-calculating process according to the third embodiment, which corresponds to the step S360 in FIG. 22 in the first embodiment.

First, at a step S701, the DL table shown in FIG. 19 is retrieved according to the engine rotational speed NE and the intake pipe absolute pressure PBA, to determine a table value DLT. Then, a KDL table shown in FIG. 35 is retrieved according to the internal resistance Ri, to determined a correction coefficient KDL at a step S702. The KDL value is set to a larger value as the Ri value decreases before full activation of the LAF sensor and to a non-corrective value (i.e. 1.0) when the LAF sensor has been fully activated.

Then, at a step S703, the table value DLT is multiplied by the correction coefficient KDL to obtain the corrected response delay time constant DL, followed by terminating the present routine.

As described above, according to the third embodiment, when the LAF sensor 17 is in the intermediate state, the table value DLT of the responses delay time constant DL is corrected according to the internal resistance Ri. As a result, when the LAF sensor is in the intermediate state, good air-fuel ratio feedback control performance can be achieved.

Next, a fourth embodiment of the invention will be described with reference to FIG. 36. In the first embodiment, when the LAF sensor 17 is in the intermediate state, the LAF sensor output is corrected (the sampling timing CSEL and the VLAF-KACT conversion characteristic are corrected). In the present embodiment, however, in place of or together with the correction of the sampling timing CSEL and the VLAF-KACT conversion characteristic, the cylinder-by-cylinder air-fuel ratio feedback control is inhibited during the intermediate state of the LAF sensor 17. Except for this, the fourth embodiment is identical with the first embodiment.

Figure 36:
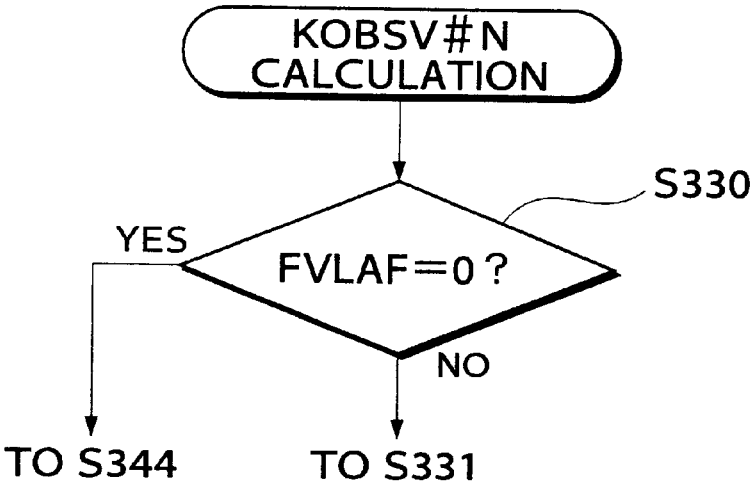
FIG. 36 is a part of a flowchart for calculating the KOBSV#N value, according to a fourth embodiment of the invention.

FIG. 36 shows a step S330 which is added to the FIG. 21 program in the first embodiment, for calculating the cylinder-by-cylinder air-fuel ratio correction coefficient KOBSV#N. It is determined at the step S330 whether or not the output stableness flag FVLAF is equal to "0". If FVLAF=1 holds, the program proceeds to the step S331, whereas if FVLAF=0 holds, which means that the LAF sensor has not been activated, the program immediately proceeds to the step S344, to thereby prevent execution of the cylinder-by-cylinder air-fuel ratio feedback control.

Next, a fifth embodiment of the invention will be described with reference to FIG. 37. In the first embodiment, when the LAF sensor 17 is in the intermediate state, the LAF sensor output is corrected (the sampling timing CSEL and the VLAF-KACT conversion characteristic are corrected). In the present embodiment, however, in place of or together with the correction of the sampling timing CSEL and the VLAF-KACT conversion characteristic, the control gains KP, KI and KD used in the calculation of the PID control correction coefficient KLAF are set according to the internal resistance Ri. Except for this, the fifth embodiment is identical with the first embodiment.

Figure 37:
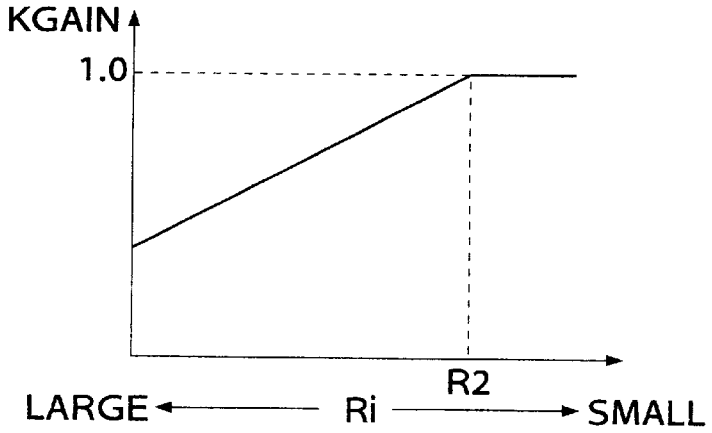
FIG. 37 shows a table for determining a correction coefficient KGAIN for control gains KP, KI and KD used in PID control, according to a fifth embodiment of the invention.

More specifically, a correction coefficient KGAIN for correcting the control gains KP, KI and KD which are used in the calculation at the step S306 in FIG. 24 is set, e.g. by retrieving a KGAIN table shown in FIG. 37, according to the internal resistance Ri, and the control gains KP, KI and KD are multiplied by the thus set correction coefficient KGAIN, and used in the calculation at the step S306. That is, when the LAF sensor 17 is in the intermediate state, the control gains KP, KI and KD are set to smaller values than values assumed when the LAF sensor has been activated, to thereby calculate the PID correction coefficient KLAF.

This invention is not limited to the embodiments described above, but may be implemented by various possible combinations of these embodiments.

Further, although in the embodiments described above, the STR (Self-Turning Regulator) is employed as the controller of the recurrence formula for determining the adaptive control correction coefficient KSTR, MRACS (Model Reference Adaptive Control System) may be employed as the controller.

Figure 38:
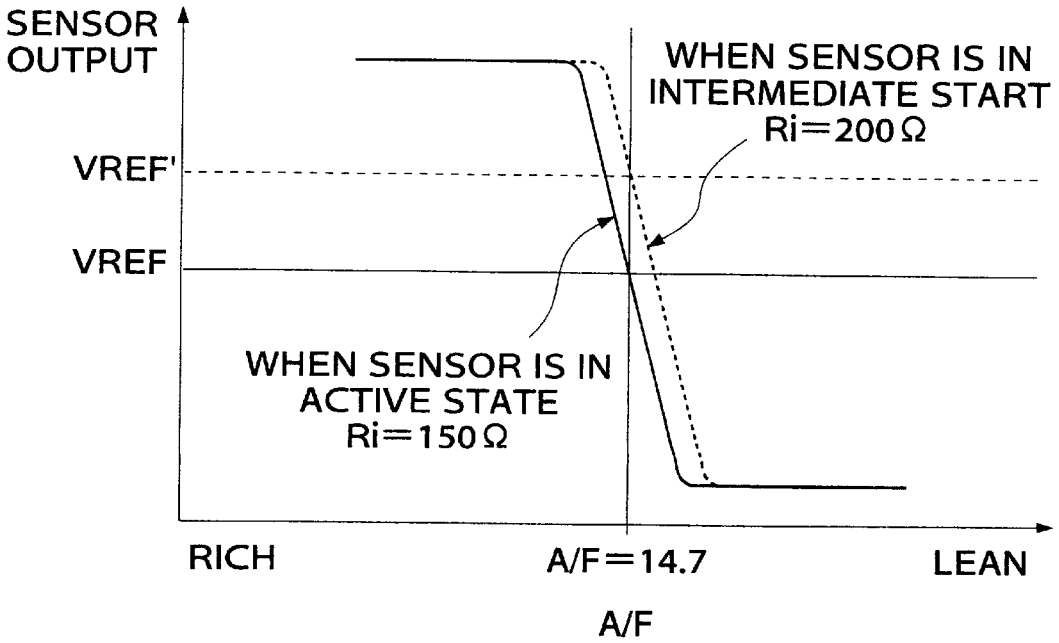
FIG. 38 shows the relationship between an output from an O2 sensor and an actual air-fuel ratio, according to a variation of the first embodiment.

Still further, in the first embodiment described above, when the LAF sensor 17 is in the intermediate state, the LAF sensor output is corrected (the sampling timing CSEL and the VLAF-KACT conversion characteristic are corrected). The invention may also be applied to an air-fuel ratio control system constructed such that in place of the LAF sensor 17 arranged upstream of the catalysts 19, 20, an O2 sensor similar to the O2 sensor 18 is arranged in the exhaust system at a location upstream of the catalysts, and the well-known air-fuel ratio feedback control is carried out based on the output from the O2 sensor. In this case, a reference voltage with which the output voltage from the O2 sensor is compared is corrected according to the internal resistance Ri of the O2 sensor, whereby the air-fuel ratio feedback control can be carried out in an accurate manner even when the O2 sensor is in a half activated state (intermediate state). That is, when the O2 sensor is activated, an output characteristic as indicated by the solid line in FIG. 38 is obtained, while when the O2 sensor is half activated, an output characteristic as indicated by the broken line in FIG. 38 is obtained. Therefore, when the O2 sensor is activated, a normal reference voltage VREF shown in FIG. 38 is used, while when the O2 sensor is in the half activated state, a reference voltage value VREF' shown in FIG. 38 which is corrected according to the internal resistance Ri is used.

As described hereinabove, according to the present invention, an intermediate state of air-fuel ratio-detecting means is determined, which is a transient state from an inactive state to a fully activated state. When the air-fuel ratio-detecting means is determined to be in the intermediate state, the output from the air-fuel ratio-detecting means is corrected, and the corrected output is used in the air-fuel ratio feedback control. As a result, even when the output from the air-fuel ratio-detecting means has not becomes stable, good controllability in the air-fuel ratio feedback control performance can be achieved.

What is claimed is:

1. In an air-fuel ratio control system for an internal combustion engine having an exhaust system, including air-fuel ratio-detecting means arranged in said exhaust system, activation-determining means for determining activation of said air-fuel ratio-detecting means, and feedback control means for carrying out feedback control of an air-fuel ratio of a mixture supplied to said engine in response to an output from said air-fuel ratio-detecting means, the improvement wherein:

said activation-determining means determines an intermediate state of said air-fuel ratio-detecting means corresponding to a transient state of said air-fuel ratio-detecting means from an inactive state thereof to an active state thereof; and said feedback control means corrects said output from said air-fuel ratio-detecting means obtained in said intermediate state for use in execution of said feedback control, when said air-fuel ratio-detecting means is in said intermediate state.

2. An air-fuel ratio control system as claimed in claim 1, wherein said activation-determining means determines activation of said air-fuel ratio-detecting means by measuring internal resistance of said air-fuel ratio-detecting means.

3. An air-fuel ratio control system as claimed in claim 2, wherein said activation-determining means determines that said air-fuel ratio-detecting means is activated to a larger degree as said internal resistance of said air-fuel ratio-detecting means is smaller.

4. An air-fuel ratio control system as claimed in claim 2, wherein said engine has a crankshaft, said feedback control means including sampling means for sampling said output from said air-fuel ratio-detecting means whenever said crankshaft rotates through a predetermined rotational angle and sequentially storing sampled values of said output, selecting means for determining timing of sampling said output according to operating conditions of said engine and selecting one of the stored sampled values of said output corresponding to the determined sampling timing, and sampling timing-correcting means for correcting the determined sampling timing according to the measured internal resistance of said air-fuel ratio-detecting means.

5. An air-fuel ratio control system as claimed in claim 4, wherein said sampling timing-correcting means sets said sampling timing to a more retarded value as the measured internal resistance of said air-fuel ratio-detecting means is larger.

6. An air-fuel ratio control system as claimed in claim 2, wherein said feedback control means includes converting means for converting said output from said air-fuel ratio-detecting means to an equivalent ratio, said converting means changing a conversion characteristic used to convert said output to said equivalent ratio according to the measured internal resistance of said air-fuel ratio-detecting means when said air-fuel ratio-detecting means is in said intermediate state.

7. An air-fuel ratio control system as claimed in any of claims 1 to 6, wherein said engine has catalyst means arranged in said exhaust system, said air-fuel ratio-detecting means being arranged in said exhaust system at a location upstream of said catalyst means, said air-fuel ratio-detecting means being a linear output oxygen concentration sensor which generates an output almost proportional to concentration of oxygen present in exhaust gases emitted from said engine.

8. In an air-fuel ratio control system for an internal combustion engine having an exhaust system, including air-fuel ratio-detecting means arranged in said exhaust system, activation-determining means for determining activation of said air-fuel ratio-detecting means, and feedback control means for carrying out feedback control having a predetermined control gain for controlling an air-fuel ratio of a mixture supplied to said engine to a desired value set based on a desired air-fuel ratio coefficient, in response to an output from said air-fuel ratio-detecting means, the improvement wherein:

said activation-determining means determines an intermediate state of said air-fuel ratio-detecting means corresponding to a transient state of said air-fuel ratio-detecting means from an inactive state thereof to an active state thereof by measuring internal resistance of said air-fuel ratio-detecting means; and said feedback control means corrects at least one of an output characteristic of said air-fuel ratio-detecting means, said desired air-fuel ratio coefficient, and said control gain according to the measured internal resistance of said air-fuel ratio-detecting means, for use in execution of said feedback control in said intermediate state when said air-fuel ratio-detecting means is in said intermediate state.

9. An air-fuel ratio control system as claimed in claim 8, wherein said activation-determining means determines that said air-fuel ratio-detecting means is activated to a larger degree as said internal resistance of said air-fuel ratio-detecting means is smaller.

10. An air-fuel ratio control system as claimed in claim 8, wherein said desired air-fuel ratio-correcting means corrects said desired air-fuel ratio coefficient to a richer value when said desired air-fuel ratio coefficient is richer than a stoichiometric air-fuel ratio and corrects said desired air-fuel ratio coefficient to a leaner value when said desired air-fuel ratio coefficient is leaner than said stoichiometric air-fuel ratio.

11. An air-fuel ratio control system as claimed in claim 10, wherein said engine has a plurality of cylinders, said air-fuel ratio control system including second feedback control means for carrying out feedback control of an air-fuel ratio of a mixture supplied to each of said cylinders in response to said output from said air-fuel ratio-detecting means by using a controller of a recurrence formula type, such that said air-fuel ratio of said mixture supplied to said each of said cylinders is converged to said desired value, and selecting means for selecting one of said feedback control means for carrying out said feedback control having said predetermined feedback gain and said second feedback control means and operating the selected feedback control means, said desired air-fuel ratio coefficient being used in the feedback control executed by the selected feedback control means.

12. An air-fuel ratio control system as claimed in claim 8, wherein said engine has a plurality of cylinders, said exhaust system having at least one confluent portion, said air-fuel ratio-detecting means being arranged in said exhaust system at said confluent portion, said air-fuel ratio control system including cylinder-by-cylinder air-fuel ratio-estimating means for estimating an air-fuel ratio of a mixture supplied to each of said cylinders in response to said output from said air-fuel ratio-detecting means, by using an observer for observing an internal operative state of said exhaust system based on a model representative of a behavior of said exhaust system, said cylinder-by-cylinder air-fuel ratio-estimating means including confluent portion air-fuel ratio-estimating means for estimating an air-fuel ratio at said confluent portion of said exhaust system by using a time constant of response delay of said air-fuel ratio-detecting means, said cylinder-by-cylinder air-fuel ratio-estimating means estimating said air-fuel ratio of said mixture supplied to said each of said cylinders by using an output from said confluent portion air-fuel ratio-estimating means, said cylinder-by-cylinder air-fuel ratio-estimating means correcting said time constant of response delay of said air-fuel ratio-detecting means when said air-fuel ratio-detecting means is in said intermediate state.

13. An air-fuel ratio control system as claimed in claim 8, wherein said engine has a plurality of cylinders, said exhaust system having at least one confluent portion, said air-fuel ratio-detecting means being arranged in said exhaust system at said confluent portion, said air-fuel ratio control system including cylinder-by-cylinder air-fuel ratio-estimating means for estimating an air-fuel ratio of a mixture supplied to each of said cylinders in response to said output from said air-fuel ratio-detecting means, by using an observer for observing an internal operative state of said exhaust system based on a model representative of a behavior of said exhaust system, said cylinder-by-cylinder air-fuel ratio-estimating means including confluent portion air-fuel ratio-estimating means for estimating an air-fuel ratio at said confluent portion by using a time constant of response delay of said air-fuel ratio-detecting means, and inhibiting means for inhibiting operation of said cylinder-by-cylinder air-fuel ratio-estimating means when said air-fuel ratio-detecting means is in said intermediate state.

14. An air-fuel ratio control system as claimed in claim 8, wherein said feedback control means includes control gain-setting means for setting said control gain according to the measured internal resistance of said air-fuel ratio-detecting means when said air-fuel ratio-detecting means is in said intermediate state.

15. An air-fuel ratio control system as claimed in claim 14, wherein said feedback gain-setting means sets said control gain to a larger value as said internal resistance of said air-fuel ratio-detecting means is smaller.

16. An air-fuel ratio control system as claimed in any of claims 9, to 10, wherein said engine has catalyst means arranged in said exhaust system, said air-fuel ratio-detecting means being arranged in said exhaust system at a location upstream of said catalyst means, said air-fuel ratio-detecting means being a linear output oxygen concentration sensor which generates an output almost proportional to concentration of oxygen present in exhaust gases emitted from said engine.

17. In an air-fuel ratio control system for an internal combustion engine having an exhaust system, and catalyst means arranged in said exhaust system, including air-fuel ratio-detecting means arranged in said exhaust system at a location upstream of said catalyst means and having an output characteristic such that an output thereof drastically changes when an air-fuel ratio of exhaust gases from said engine changes across a stoichiometric air-fuel ratio, activation-determination means for determining activation of said air-fuel ratio-detecting means, and feedback control means for carrying out feedback control of said air-fuel ratio of a mixture supplied to said engine in response to said output from said air-fuel ratio-detecting means, the improvement, wherein said activation-determining means determines an intermediate state of said air-fuel ratio-detecting means corresponding to a transient state of said air-fuel ratio-detecting means from an inactive state thereof to an active state thereof; and said feedback control means corrects a reference value which is compared with said output from said air-fuel ratio-detecting means obtained in said intermediate state, when said air-fuel ratio-detecting means is in said intermediate state.

18. An air-fuel ratio control system as claimed in claim 17, wherein said activation-determining means determines activation of said air-fuel ratio-detecting means by measuring internal resistance of said air-fuel ratio-detecting means.

* * * * *